US011594200B2

(12) United States Patent
Chen et al.

(10) Patent No.: US 11,594,200 B2
(45) Date of Patent: Feb. 28, 2023

(54) DRIVING APPARATUS OF DISPLAY PANEL AND OPERATION METHOD THEREOF

(71) Applicant: Novatek Microelectronics Corp., Hsinchu (TW)

(72) Inventors: Hung-Hsiang Chen, Hsinchu (TW); Tso-Hua Chien, Taoyuan (TW); Huang-Chin Tang, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/748,832

(22) Filed: Jan. 22, 2020

(65) Prior Publication Data

US 2020/0251072 A1 Aug. 6, 2020

Related U.S. Application Data

(63) Continuation-in-part of application No. 16/748,781, filed on Jan. 21, 2020, now Pat. No. 10,984,697.

(60) Provisional application No. 62/896,592, filed on Sep. 6, 2019, provisional application No. 62/799,724, filed on Jan. 31, 2019.

(51) Int. Cl.
*G09G 5/18* (2006.01)
*G09G 3/36* (2006.01)

(52) U.S. Cl.
CPC ..... *G09G 5/18* (2013.01); *G09G 3/3648* (2013.01); *G09G 2370/08* (2013.01)

(58) Field of Classification Search
CPC ..... G09G 2310/0213; G09G 2310/08; G09G 3/3614; G09G 2300/0408; G09G 2300/0417; G09G 2300/0452; G09G 2310/0202; G09G 2310/0216; G09G 2310/0235; G09G 2320/0219; G09G 2320/0233; G09G 2320/0242; G09G 2370/08; G09G 3/2003; G09G 3/2044; G09G 3/3648; G09G 3/3677; G09G 5/18; G09G 5/395
See application file for complete search history.

(56) References Cited

U.S. PATENT DOCUMENTS

2009/0040243 A1* 2/2009 Hisada ..... G09G 3/3648 345/690
2009/0179875 A1* 7/2009 Li ..... G09G 3/3648 345/204
2009/0213048 A1* 8/2009 Park ..... G09G 3/2092 345/77

(Continued)

OTHER PUBLICATIONS

"Office Action of Parent U.S. Appl. No. 16/748,781", dated Oct. 6, 2020, p. 1-p. 20.

*Primary Examiner* — Hong Zhou
(74) *Attorney, Agent, or Firm* — JCIPRNET

(57) ABSTRACT

This disclosure relates to techniques for a driving apparatus including a reordering circuit and a source driving circuit. The reordering circuit can be configured to reorder a plurality of sub-pixel data of an input data string to generate a reordered data string so as to reduce a color switching number associated with a target data line. The source driving circuit can be coupled to the reordering circuit to receive the reordered data string. The source driving circuit can be configured to drive the target data line of a display panel according to the reordered data string.

60 Claims, 26 Drawing Sheets

(56) References Cited

U.S. PATENT DOCUMENTS

| | | | | |
|---|---|---|---|---|
| 2009/0290081 | A1* | 11/2009 | Cho | G09G 3/3648 349/42 |
| 2011/0279443 | A1* | 11/2011 | Chang | G09G 3/3614 345/214 |
| 2015/0279295 | A1 | 10/2015 | Shikata | |
| 2015/0310816 | A1* | 10/2015 | Tzeng | G09G 3/3614 345/209 |
| 2015/0379947 | A1* | 12/2015 | Sang | G02F 1/134309 349/37 |
| 2016/0078826 | A1* | 3/2016 | Yoo | G09G 3/3648 345/691 |
| 2016/0335970 | A1* | 11/2016 | Cheng | G09G 3/3674 |
| 2017/0103695 | A1 | 4/2017 | Nishimura et al. | |
| 2018/0090046 | A1 | 3/2018 | Hong et al. | |
| 2018/0261171 | A1 | 9/2018 | Morein | |
| 2018/0307108 | A1 | 10/2018 | Jiang et al. | |
| 2020/0251038 | A1 | 8/2020 | Chien et al. | |
| 2020/0273394 | A1 | 8/2020 | Chen et al. | |

* cited by examiner

DRIVING APPARATUS OF DISPLAY PANEL AND OPERATION METHOD THEREOF

CROSS-REFERENCE TO RELATED APPLICATION

This application is a continuation-in-part application of and claims the priority benefit of a prior application Ser. No. 16/748,781, filed on Jan. 21, 2020, which claims the priority benefit of U.S. provisional application Ser. No. 62/799,724, filed on Jan. 31, 2019. This application also claims the priority benefit of U.S. provisional application Ser. No. 62/896,592, filed on Sep. 6, 2019. The entirety of the above-mentioned patent application is hereby incorporated by reference herein and made a part of this specification.

BACKGROUND

Field of the Invention

The invention relates to a display apparatus and more particularly, to a driving apparatus of a display panel and an operation method of the driving apparatus.

Description of Related Art

In a single gate amorphous-Si (α-Si) panel, each sub-pixel column is disposed with a data line (source signal line). In comparison with the single gate α-Si panel, each two sub-pixel columns share one data line in a dual-gate α-Si panel in order to reduce the number of the data lines. However, according to the panel arrangement, a same data line usually has to drive sub-pixels corresponding to different colors, i.e., a source driver has to frequently switch color data of the same data line. As a color switching number associated with the same data line is increased, which represents that the source driver continuously changes a voltage level of a source signal, power-consumption of the source driver is therefore increased.

It should be noted that the contents of the section of "Description of Related Art" is used for facilitating the understanding of the invention. A part of the contents (or all of the contents) disclosed in the section of "Description of Related Art" may not pertain to the conventional technology known to the persons with ordinary skilled in the art. The contents disclosed in the section of "Description of Related Art" do not represent that the contents have been known to the persons with ordinary skilled in the art prior to the filing of this invention application.

SUMMARY

The invention provides a driving apparatus and an operation method capable of reducing a color switching number associated with a target data line.

According to an embodiment of the invention, a driving apparatus including a reordering circuit and a source driving circuit is provided. The reordering circuit is configured to reorder an input data string to generate a reordered data string. The input data string includes a sub-pixel data string for the target data line of the display panel. The sub-pixel data string includes a plurality of original sub strings respectively corresponding to different scan lines. A color of first sub-pixel data in a first original sub string among the original sub strings is the same as a color of second sub-pixel data in a second original sub string among the original sub strings. The first original sub string corresponds to a first scan line, and the second original sub string corresponds to a second scan line different from the first scan line. The reordering circuit clusters the first sub-pixel data in the first original sub string and the second sub-pixel data in the second original sub string having the same color into a reordered sub string of the reordered data string. The sub-pixel sequence of the reordered data string in a current frame is different from a sub-pixel sequence of the reordered data string in a previous frame. The source driving circuit is coupled to the reordering circuit to receive the reordered data string. The source driving circuit is configured to convert the reordered sub string into a sub-pixel voltage string and drive the target data line of the display panel according to the sub-pixel voltage string.

According to an embodiment of the invention, an operation method of a driving apparatus is provided. The operation method includes: reordering an input data string to generate a reordered data string, wherein the input data string includes a sub-pixel data string for a target data line of a display panel, the sub-pixel data string includes a plurality of original sub strings respectively corresponding to the different scan lines, a color of first sub-pixel data in a first original sub string among the original sub strings is the same as a color of second sub-pixel data in a second original sub string among the original sub strings, the first original sub string corresponds to a first scan line, and the second original sub string corresponds to a second scan line different from the first scan line; clustering the first sub-pixel data in the first original sub string and the second sub-pixel data having the same color in the second original sub string into a reordered sub string of the reordered data string, wherein a sub-pixel sequence of the reordered data string in a current frame is different from a sub-pixel sequence of the reordered data string in a previous frame; and converting the reordered sub string into a sub-pixel voltage string and driving the target data line of the display panel according to the sub-pixel voltage string.

According to an embodiment of the invention, a driving apparatus configured to drive a display panel is provided. The driving apparatus includes a reordering circuit and a source driving circuit. The reordering circuit is configured to reorder a plurality of sub-pixel data of an input data string to generate a reordered data string so as to reduce a color switching number associated with a target data line, wherein a sub-pixel sequence of the reordered data string in a current frame is different from a sub-pixel sequence of the reordered data string in a previous frame. The source driving circuit is coupled to the reordering circuit to receive the reordered data string. The source driving circuit is configured to drive the target data line of the display panel according to the reordered data string.

According to an embodiment of the invention, an operation method of a driving apparatus is provided. The operation method includes: reordering a plurality of sub-pixel data of an input data string to generate a reordered data string so as to reduce a color switching number associated with a target data line, wherein a sub-pixel sequence of the reordered data string in a current frame is different from a sub-pixel sequence of the reordered data string in a previous frame; and driving the target data line of the display panel according to the reordered data string.

According to an embodiment of the invention, a driving apparatus configured to drive a display panel is provided. The display panel includes a plurality of data lines, a plurality of scan lines, and a plurality of sub-pixels connected to the data lines and the scan lines and arranged as a plurality of display lines extended along an extension direction of the scan lines. A target data line of the data lines is connected to different colors of the sub-pixels. The driving apparatus includes a driving circuit. The driving circuit is configured to output a sub-pixel voltage string to a target data line of the data lines. The sub-pixel voltage string includes at least three sub strings. Each of the at least three sub strings includes a plurality of sub-pixel voltages corresponding to a same color. Colors corresponding to the at least three sub strings are different from one another. The sub-pixel sequence of the sub-pixel voltage string in a current frame is different from a sub-pixel sequence of the sub-pixel voltage string in a previous frame.

According to an embodiment of the invention, an operation method of a driving apparatus is provided. The display panel includes a plurality of data lines, a plurality of scan lines, and a plurality of sub-pixels connected to the data lines and the scan lines and arranged as a plurality of display lines extended along an extension direction of the scan lines. A target data line of the data lines is connected to different colors of the sub-pixels. The operation method includes: outputting, by a driving circuit, a sub-pixel voltage string to a data line of the display panel, wherein the sub-pixel voltage string includes at least three sub strings, each of the at least three sub strings includes a plurality of sub-pixel voltages corresponding to a same color, and colors corresponding to the at least three sub strings are different from one another. The sub-pixel sequence of the sub-pixel voltage string in a current frame is different from a sub-pixel sequence of the sub-pixel voltage string in a previous frame.

According to an embodiment of the invention, a driving apparatus configured to drive a display panel is provided. The display panel includes a plurality of data lines, a plurality of scan lines and a plurality of sub-pixels connected to the data lines and the scan lines and arranged as a plurality of display lines extended along an extension direction of the scan lines. A target data line of the data lines is connected to different colors of the sub-pixels. The driving apparatus includes a gate driving circuit. The gate driving circuit is configured to control a scanning operation on the sub-pixels. The scanning operation includes sequentially scanning a first group of the sub-pixels and a second group of the sub-pixels both connected to the target data line, wherein the first group of the sub-pixels are scanned in a manner of jumping-across at least one display line and/or the first group of the sub-pixels and the second group of the sub-pixels are scanned in a forth-and-back manner without first completing scanning all of the sub-pixels arranged on a same display line. The scan sequence of the scan lines in a current frame is different from a scan sequence of the scan lines in a previous frame.

According to an embodiment of the invention, an operation method of a driving apparatus is provided. The display panel includes a plurality of data lines, a plurality of scan lines and a plurality of sub-pixels connected to the data lines and the scan lines and arranged as a plurality of display lines extended along an extension direction of the scan lines. A target data line of the data lines is connected to different colors of the sub-pixels. The operation method includes: controlling a scanning operation on the sub-pixels, wherein the scanning operation includes sequentially scan a first group of the sub-pixels and a second group of the sub-pixels both connected to the target data line, wherein the first group of the sub-pixels are scanned in a manner of jumping-across at least one display line and/or the first group of the sub-pixels and the second group of the sub-pixels are scanned in a forth-and-back manner without first completing scanning all of the sub-pixels arranged on a same display line. The can sequence of the scan lines in a current frame is different from a scan sequence of the scan lines in a previous frame.

According to an embodiment of the invention, a driving apparatus for controlling a display panel is provided. The display panel includes a plurality of scan lines, a plurality of data lines, and a plurality of sub-pixels connected to the scan lines and data lines. A target data line of the data lines is connected to different colors of the sub-pixels. The driving apparatus includes a gate driving circuit configured to control the display panel to scan a first group of the sub-pixels coupled to the target data line during a first period, wherein the first group of the sub-pixels have a same first color, and control the display panel to scan a second group of the sub-pixels coupled to the target data line during a second period after the first period. The second group of the sub-pixels have a same second color different from the first color. A scan sequence of the scan lines in a current frame is different from a scan sequence of the scan lines in a previous frame.

According to an embodiment of the invention, an method for controlling a display panel is provided. The display panel includes a plurality of scan lines, a plurality of data lines, and a plurality of sub-pixels connected to the scan lines and data lines. A target data line of the data lines is connected to different colors of the sub-pixels. The method includes: controlling the display panel to scan a first group of the sub-pixels coupled to the target data line during a first period, wherein the first group of the sub-pixels have a same first color; and controlling the display panel to scan a second group of the sub-pixels coupled to the target data line during a second period after the first period, wherein the second group of the sub-pixels have a same second color different from the first color. A scan sequence of the scan lines in a current frame is different from a scan sequence of the scan lines in a previous frame.

Based on the above, the driving apparatus provided by the embodiments of the invention can reorder the input data string to generate the reordered data string so as to reduce the color switching number associated with the target data line of the display panel. For example, by changing a scanning sequence for the scan lines of the display panel, the driving apparatus can cluster the sub-pixel data corresponding to the same color together so as to reduce the color switching number associated with the target data line.

To make the above features and advantages of the invention more comprehensible, embodiments accompanied with drawings are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
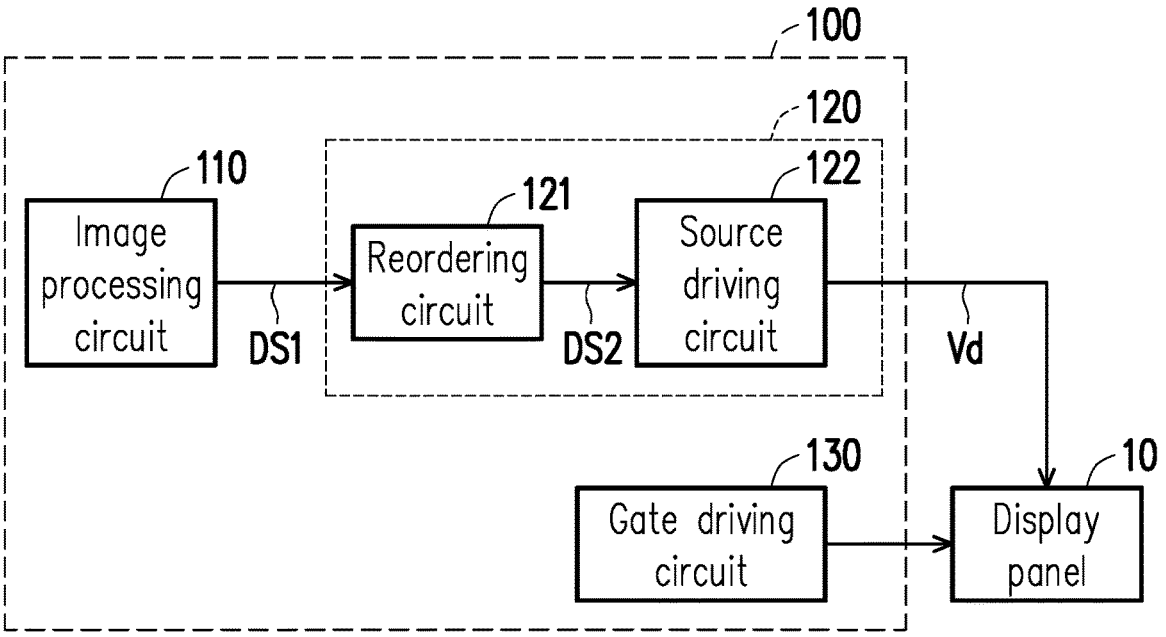
FIG. 1 is a schematic circuit block diagram illustrating a driving apparatus according to an embodiment of the invention.

The term "couple (or connect)" throughout the specification (including the claims) of this application are used broadly and encompass direct and indirect connection or coupling means. For example, if the disclosure describes a first apparatus being coupled (or connected) to a second apparatus, then it should be interpreted that the first apparatus can be directly connected to the second apparatus, or the first apparatus can be indirectly connected to the second apparatus through other devices or by a certain coupling means. In addition, terms such as "first" and "second" mentioned throughout the specification (including the claims) of this application are only for naming the names of the elements or distinguishing different embodiments or scopes and are not intended to limit the upper limit or the lower limit of the number of the elements not intended to limit sequences of the elements. Moreover, elements/components/steps with same reference numerals represent same or similar parts in the drawings and embodiments. Elements/components/notations with the same reference numerals in different embodiments may be referenced to the related description.

In some embodiments, a color switching number associated with a same data line can be reduced, thus reducing power consumption. In some embodiments, a sub-pixel sequence for data of a plurality of sub-pixels connected to a same data line and having a same color can be clustered to be to be more adjacent in a time sequence. In some embodiments, voltages for a plurality of sub-pixels connected to a same data line and having a same color can be output to drive the same data line more adjacently or as a group in a time sequence, which means that the output times for the voltages of such sub-pixels can be more adjacent or closer to each other. In some embodiments, a plurality of sub-pixels connected to a same data line and having a same color can be arranged to be scanned (by corresponding scan signals) more adjacently or as a group in a time sequence, which means that the scanning times for such sub-pixels can be more adjacent or closer to each other. In some embodiments, a timing sequence for scanning a plurality of sub-pixels connected to a same data line can be arranged according to a corresponding sequence of sub-pixel data or voltages output for driving the data line. In some embodiments, the sequences described in the above embodiments can be arranged according to an arrangement of the sub-pixels on a display panel which may have a specific regularity or pattern. In some embodiments, a scanning sequence can jump across at least one display line (or at least one or two scan lines) for scanning a plurality of sub-pixels connected to a same data line. In some embodiments, a scanning sequence can have forth-and-back directions for scanning a plurality of sub-pixels connected to a same data line. Before all of the sub-pixels having different colors on a certain display line are scanned, at least one other sub-pixel having the same color arranged on at least one other different display line can be scanned and then the scanning can return to the certain display line such that another sub-pixel having a different color on the certain display line can be scanned. It is noted that the embodiments can be implanted for at least one frame of a plurality of frames. The scanning sequence can be fixed or dynamically varied according to design requirement.

FIG. 1 is a schematic circuit block diagram illustrating a driving apparatus 100 according to an embodiment of the invention. The driving apparatus 100 may drive a display panel 10. According to a design requirement, the display panel 10 may be any type of display panel. For example, in some embodiments, the display panel 10 may be a dual-gate display panel. In other embodiments, the display panel 10 may be other types of display panels. In some other embodiments, the display panel 10 may be a zigzag display panel. For example, the display panel 10 may be a zigzag dual-gate display panel. In other embodiments, the display panel 10 may be a non-zigzag display panel. In other words, the display panel 10 may be a non-zigzag dual-gate display panel. A plurality of sub-pixels can be arranged as a plurality of display lines in a dual-gate display panel as shown in FIGS. 3, 7, 10, 14, 16 and 19. A target data line of the data lines can be connected to two sub-pixels in one same display line.

Referring to FIG. 1, the display panel 10 includes a plurality of data lines, a plurality of scan lines and a plurality of sub-pixels connected to the data lines and the scan lines. A same data line (referred to as a target data line) of the data lines is connected to different colors of the sub-pixels. In addition, the sub-pixels can be arranged as a plurality of display lines along an extension direction of the scan lines. The sub-pixels arranged on a same display line and connected to the target data line may have different colors. For example, a first sub-pixel and a second sub-pixel is arranged on a same display line and connected to the target data line may have different colors.

The sub-pixels connected to the target data line may have a same color every N display line(s), wherein N is a positive integer. In some implementations, for example, for non-zigzag dual-gate display panels, N can be 1 and in some implementations, for example, for zigzag dual-gate display panels, N can be greater than 1 (e.g., N=2). A number of sub-pixels having the same color and connected to the target data line and respectively arranged on at least two display lines (for example, an ith display line, an $(i+N)^{th}$ display line, and etc). can be scanned as a group (or adjacently in time sequence), by scanning across at least one (for example, N−1) display line between the two display lines (for example, the ith display line, the $(i+N)^{th}$ display line). The number of sub-pixels in the group can be equal or greater than two.

The display apparatus 100 illustrated in FIG. 1 can include an image processing circuit 110, a driving circuit 120 and a gate driving circuit 130. The driving circuit 120 can be coupled to drive a plurality of data lines of the display panel 10, and the gate driving circuit 130 is coupled to scan the plurality of scan lines of the display panel 10. The driving circuit 120 may be directly connected to the data lines or in directly connected to the data lines. Similarly, the gate driving circuit 130 may be directly connected to the plurality of scan lines or in directly connected to the data lines (for example, a gate on array (GOA) circuit can be connected between the gate driving circuit 130 and the scan lines). The gate driving circuit 130 may scan (drive) the plurality of scan lines of the display panel 10. The image processing circuit 110, the driving circuit 120 and the gate driving circuit 130 can be integrated into a chip or separated as different chips according to design or application requirement.

By clustering sub-pixel data corresponding to the same color into by correspondingly changing a scanning sequence for the scan lines of the display panel, the display apparatus 100 can reduce a color switching number associated with a target data line and thus reduce power consumption. The clustering operation may comprise clustering sub-pixel data for the sub-pixels connected to a target data line and having a same first color into a first group, and clustering sub-pixel data for the sub-pixels connected to the target data line and having a same second color into a second group. Correspondingly, the scanning operation may comprise sequentially scan the first group of the sub-pixels corresponding to the same first color and then sequentially scan the second group of the sub-pixels corresponding to the same second color.

The sub-pixels of the first group of the sub-pixels may be arranged on different display lines. Similarly, the sub-pixels of the second group of the sub-pixels may be arranged on different display lines. In other words, the sub-pixels having the colors arranged on different display lines may be scanned as a group. The different display lines may not be adjacent display lines. Accordingly, the scanning operation may be performed on a manner of jumping-across-at least one display line in some embodiments. Moreover, the sub-pixels having different colors arranged on the same display line may be scanned in different groups. Accordingly, the scanning operation may be performed on a forth-and-back manner without first completing scanning all of the sub-pixels on the same display line, because the sub-pixels having different colors on the same display line can belong to different groups in some embodiments.

The image processing circuit 110 can be coupled to the driving circuit 120 to provide an input data string DS1. The driving circuit 120 can then use the input data string DS1 to obtain a sub-pixel voltage string Vd and drive the display panel 10 according to the sub-pixel voltage string Vd. The driving circuit 120 can adjust a sub-pixel sequence of the input data string DS1 such that a sub-pixel sequence of the input data string DS1 of the driving circuit 120 is different from a sub-pixel sequence of a sub-pixel voltage string Vd. In accordance with a scan timing of the gate driving circuit 130, the driving circuit 120 may output the sub-pixel voltage string Vd to one of the data lines of the display panel 10. Thereby, the display panel 10 may display an image.

In other words, the sub-pixel voltage string Vd, obtained by reordering the sub-pixel sequence the input data string DS1, the sub-pixels having the same color can have more degree of concentration in data sequence. For example (but not limited to), the sub-pixel voltage string Vd can include at least three sub strings. Each of the sub strings includes a plurality of sub-pixel voltages corresponding to a same color. Colors corresponding to the sub strings are different from one another. Accordingly, source data for the same first color can be sequentially output first, and data for the same second color can be sequentially output later.

The scan timing of the gate driving circuit 130 can also be arranged such that the sub-pixels having the same color can be scanned as a group to fit the data sequence of the sub-pixel voltage string Vd. The sub-pixel voltage string Vd includes a first sub-pixel voltage and a second sub-pixel voltage adjacent to each other in time sequence. The first sub-pixel voltage is used to drive a first sub-pixel connected to the $i^{th}$ scan line and a target data line of the display panel 10, and the second sub-pixel voltage is used to drive a second sub-pixel connected to the $j^{th}$ scan line and the target data line of the display panel 10 and having the same color of the first sub-pixel, wherein i and j are integers, and j is different from (i+1) (e.g. greater than (i+1)), meaning jumping across at least one display line. In other words, source data for the same target data line is output in a sequence jumping across at least one display line. This also means that scanning timing for the scan lines can be arranged to jump across at least one display line.

The gate driving circuit 130 can be configured to scan the sub-pixels according to a scan sequence corresponding to a sub-pixel sequence of the sub-pixel voltage string Vd output by the driving circuit 120. More specifically, the gate driving circuit 130 may be configured to sequentially scan a first group of scan lines coupled to sub-pixels having a first color and a second group of scan lines coupled to sub-pixels having a second color. For example, for the sub-pixels connected to a certain target data line, the sub-pixels connected to a target data line can have the same color every N display line(s), wherein N is an integer larger than 1. Under this configuration, the first group of scan line can be arranged to include for example, an $i^{th}$ scan line and an $(i+N)^{th}$ scan line which are coupled to sub-pixels having the first color. N can be greater than 1, meaning that the scanning may not be performed in an order as $i^{th}$, $(i+1)^{th}$, $(i+2)^{th}$, and so on, and can jump across at least one display line. Similarly, the second group of scan lines can be arranged to include, for example, an $(i+1)^{th}$ scan line and an $(i+N+1)^{th}$ scan line which are coupled to sub-pixels having the second color. In embodiments applicable to a dual-gate display panel, the second group of scan lines can be arranged to include, for example, an $(i)^{th}$ scan line and an $(i+N)^{th}$ scan line which are coupled to sub-pixels having the second color. According to this arrangement, all of the sub-pixels of the first group of scan lines connected to the target data line can have a first same color, and all of the sub-pixels of the second group of scan lines connected to the target data line can have a second same color (which is different from the first same color).

In the embodiment illustrated in FIG. 1, the driving circuit 120 includes a reordering circuit 121 and a source driving circuit 122. In some embodiments, the image processing circuit 110 and the reordering circuit 121 may be configured in a timing controller, and the source driving circuit 122 may be configured in a source driver. In some other embodiments, the image processing circuit 110 may be configured in a timing controller, and the reordering circuit 121 and the source driving circuit 122 may be configured in a source driver.

The reordering circuit 121 is coupled to the image processing circuit 110 to receive the input data string DS1. The reordering circuit 121 may reorder the input data string DS1 to generate a reordered data string DS2. For example (but not limited to), the reordered data string DS2 has at least three sub-pixel data strings, each of the sub-pixel data strings includes a plurality of sub-pixel data corresponding to the same color, and colors of the sub-pixel data strings are different from one another. The source driving circuit 122 is coupled to the reordering circuit 121 to receive the reordered data string DS2. The source driving circuit 122 may convert the reordered data string DS2 into the sub-pixel voltage string Vd. The source driving circuit 122 may output the sub-pixel voltage string Vd to a data line of the display panel 10.

Figure 2:
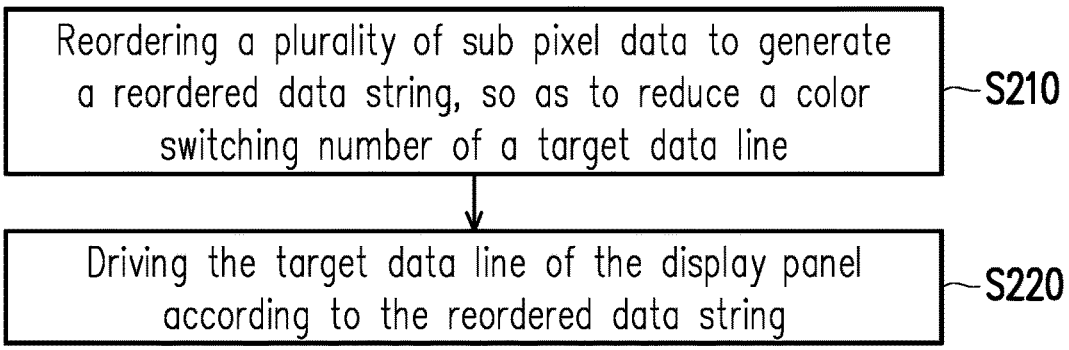
FIG. 2 is a flowchart illustrating an operation method of a driving apparatus according to an embodiment of the invention.

FIG. 2 is a flowchart illustrating an operation method of a driving apparatus according to an embodiment of the invention. Referring to FIG. 1 and FIG. 2, in step S210, the reordering circuit 121 may reorder a plurality of sub-pixel data of the input data string DS1 to generate the reordered data string DS2 so as to reduce a color switching number associated with at least one data line, for example, a target data line of the display panel 10. Wherein, a sub-pixel sequence of the reordered data string DS2 in a current frame is different from a sub-pixel sequence of the reordered data string DS2 in a previous frame. The source driving circuit 122 is coupled to the reordering circuit 121 to receive the reordered data string DS2. In step S220, the source driving circuit 122 may drive the target data line of the display panel 10 according to the reordered data string DS2. In accordance with a scanning sequence of the gate driving circuit 130, the source driving circuit 122 may output the sub-pixel voltage string Vd to one of the data line of the display panel 10 to display an image.

For example, the input data string DS1 includes a sub-pixel data string for a certain target data line of the display panel 10. The sub-pixel data string includes a plurality of original sub strings respectively corresponding to different scan lines of the display panel 10. A color of first sub-pixel data in a first original sub string among the original sub strings is the same as a color of second sub-pixel data in a second original sub string among the original sub strings. The first original sub string corresponds to a first scan line, and the second original sub string corresponds to a second scan line which is different from the first scan line. The reordering circuit 121 may reorder the original sub strings to obtain the reordered data string DS2. For example, the reordering circuit 121 may cluster the first sub-pixel data in the first original sub string and the second sub-pixel data in the second original sub string having the same color into a reordered sub string of the reordered data string DS2. Wherein, a sub-pixel sequence of the reordered data string DS2 in a current frame is different from a sub-pixel sequence of the reordered data string DS2 in a previous frame.

The input data string DS1 may have a color periodicity or regularity. For example, it is assumed that the input data string DS1 includes a first original sub string (including sub-pixel data R1, G1 and B1) and a second original sub string (including sub-pixel data R2, G2 and B2). A location of the sub-pixel data R1 in the first original sub string is the same as a location of the sub-pixel data R2 in the second original sub string, a location of the sub-pixel data G1 in the first original sub string is the same as a location of the sub-pixel data G2 in the second original sub string, and a location of the sub-pixel data B1 in the first original sub string is the same as a location of the sub-pixel data B2 in the second original sub string. Correspondingly, the output sequence of the input data string DS1 is "R1, G1, B1, R2, G2 and B2." The reordering circuit 121 clusters the sub-pixel data R1 and the sub-pixel data R2 having the same color to a reordered sub string of the reordered data string DS2, clusters the sub-pixel data G1 and the sub-pixel data G2 having the same color to the reordered sub string of the reordered data string DS2 and clusters the sub-pixel data B1 and the sub-pixel data B2 having the same color to the reordered sub string of the reordered data string DS2. Thus, an output sequence (sub-pixel sequence) of the reordered sub string of the reordered data string DS2 is "R1, R2, G1, G2, B1 and B2."

The source driving circuit 122 can be coupled to the reordering circuit 121 to receive the reordered data string DS2. The source driving circuit 122 may drive the target data line of the display panel 10 according to the reordered data string DS2. The source driving circuit 122 may convert the reordered data string DS2 into the sub-pixel voltage string Vd and drive the target data line of the display panel 10 according to the sub-pixel voltage string Vd. In the reordered sub string of the reordered data string DS2, since the sub-pixel data corresponding to the same color are clustered together, the reordering circuit 121 may achieve reducing the color switching number associated with the target data line of the display panel 10.

The reordering operation of the reordering circuit 121 will be described below according to different embodiments of the display panel 10.

Figure 3:
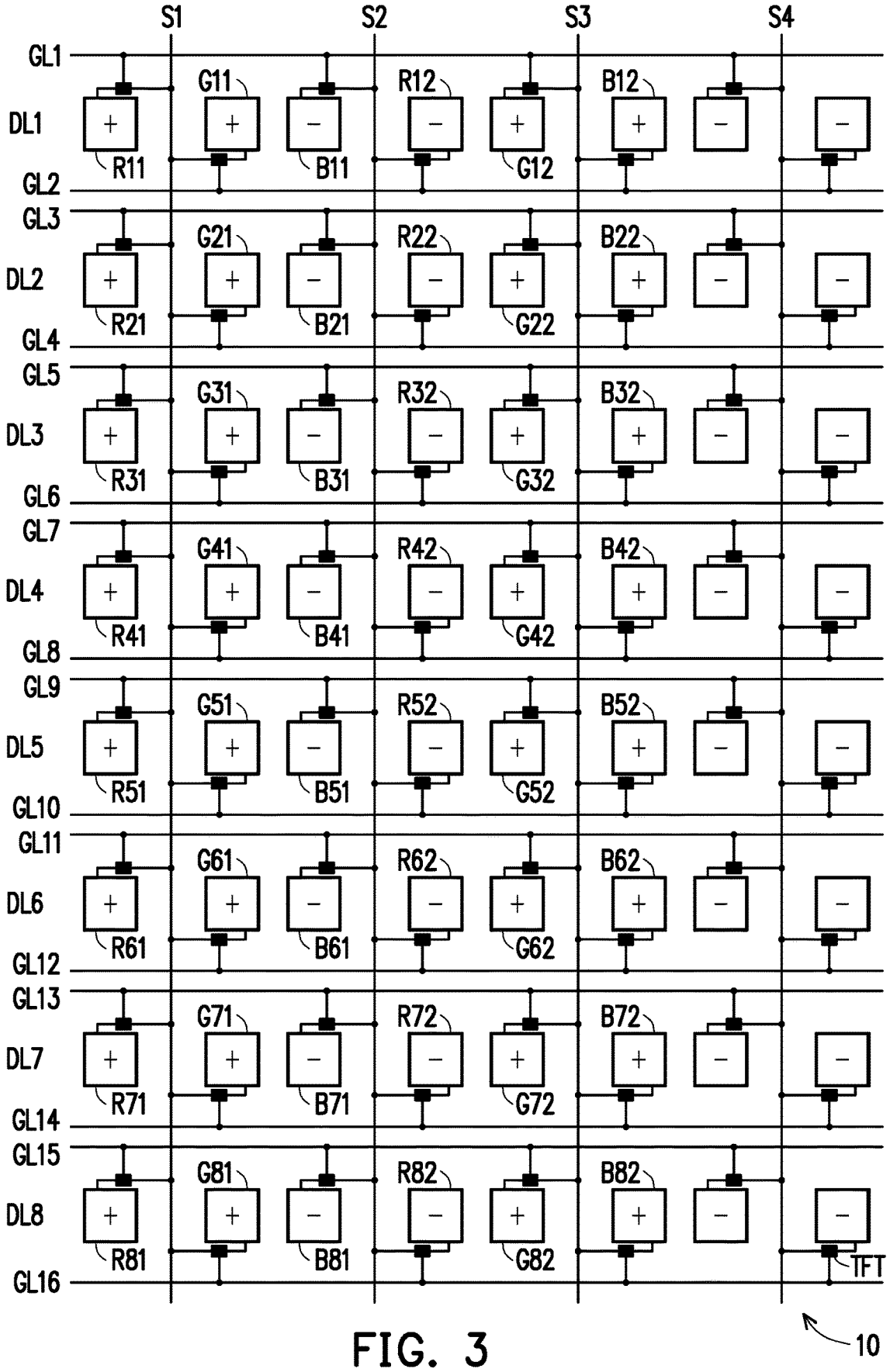
FIG. 3 is a schematic layout diagram of the display panel depicted in FIG. 1 according to an embodiment of the invention.

FIG. 3 is a schematic layout diagram of the display panel 10 depicted in FIG. 1 according to an embodiment of the invention. In the embodiment illustrated in FIG. 3, the display panel 10 can be a non-zigzag dual-gate display panel. The display panel 10 can includes a plurality of data lines (e.g., S1 to S4), a plurality of scan lines (e.g., GL1 to GL16), and a plurality of sub-pixels connected to the data lines and the scan lines. The source driving circuit 122 can output the sub-pixel voltage string Vd to the data lines of the display panel 10. The gate driving circuit 130 can scan (drive) the scan lines of the display panel 10. The sub-pixels of the display panel 10 can include red sub-pixels (e.g., R11 to R12, R21 to R22, R31 to R32, R41 to R42, R51 to R52, R61 to R62, R71 to R72 and R81 to R82), green sub-pixels (e.g., G11 to G12, G21 to G22, G31 to G32, G41 to G42, G51 to G52, G61 to G62, G71 to G72 and G81 to G82) and blue sub-pixels (e.g., B11 to B12, B21 to B22, B31 to B32, B41 to B42, B51 to B52, B61 to B62, B71 to B72 and B81 to B82). A target data line of the data lines can be connected to different colors of the sub-pixels. In addition, the sub-pixels can be arranged as a plurality of display lines, for example, DL1-DL8 along an extension direction of the scan lines GL1 to GL16. The sub-pixels arranged on a same display line and connected to the target data line may have different colors. The sub-pixels connected to the target data line of the data lines S1-S4 can have a same color every N display line(s), wherein N is a positive integer. In the embodiment, N can be 1. Each of the black solid squares shown in FIG. 3 represents a switch TFT.

More specifically, the red sub pixel R11, the green sub pixel G11, the blue sub pixel B11, the red sub pixel R12, the green sub pixel G12 and the blue sub pixel B12 are arranged on a display line (display row) DLL The red sub pixel R21, the green sub pixel G21, the blue sub pixel B21, the red sub pixel R22, the green sub pixel G22 and the blue sub pixel B22 are arranged on a display line DL2. The red sub pixel R31, the green sub pixel G31, the blue sub pixel B31, the red sub pixel R32, the green sub pixel G32 and the blue sub pixel B32 are arranged on a display line DL3. The red sub pixel R41, the green sub pixel G41, the blue sub pixel B41, the red sub pixel R42, the green sub pixel G42 and the blue sub pixel B42 are arranged on a display line DL4. The red sub pixel R51, the green sub pixel G51, the blue sub pixel B51, the red sub pixel R52, the green sub pixel G52 and the blue sub pixel B52 are arranged on a display line DL5. The red sub pixel R61, the green sub pixel G61, the blue sub pixel B61, the red sub pixel R62, the green sub pixel G62 and the blue sub pixel B62 are arranged on a display line DL6. The red sub pixel R71, the green sub pixel G71, the blue sub pixel B71, the red sub pixel R72, the green sub pixel G72 and the blue sub pixel B72 are arranged on a display line DL7. The red sub pixel R81, the green sub pixel G81, the blue sub pixel B81, the red sub pixel R82, the green sub pixel G82 and the blue sub pixel B82 are arranged on a display line DL8.

Figure 4:
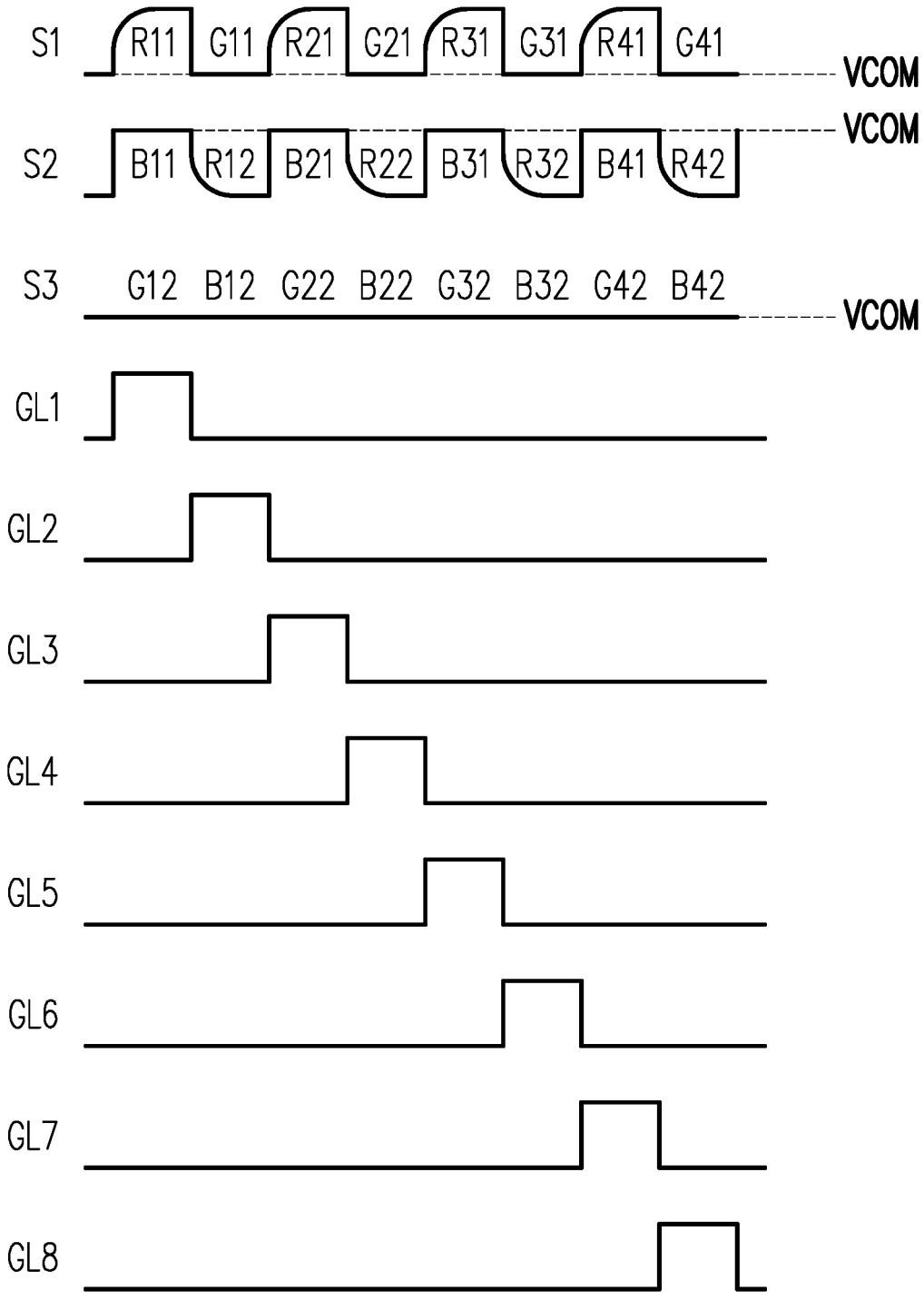
FIG. 4 is a data timing diagram of the display panel shown in FIG. 3.

FIG. 4 is an example signal timing diagram of the display panel 10 shown in FIG. 3 in an implementation where the reordering circuit 121 does not reorder the plurality of sub-pixel data of the input data string DS1. The signal timings of the data lines S1 to S3 and the scan lines GL1 to GL8 are shown in FIG. 4. VCOM shown in FIG. 4 represents the common voltage of the display panel 10. An output sequence of the sub-pixel voltage string Vd of the data line S2 (i.e., referred to as the target data line) is taken as an example for description set forth below, and other data lines may be analogously inferred with reference to the description related to the data line S2 and will not be repeatedly described.

For the data line S2, the output sequence of the input data string DS1 can be B11, R12, B21, R22, B31, R32, B41, R42, . . . and etc. In the implementation, it is assumed that the reordering circuit 121 does not reorder the plurality of sub-pixel data of the input data string DS1, i.e., it is assumed that an output sequence of the input data string DS2 is "B11, R12, B21, R22, B31, R32, B41, R42, . . . " Correspondingly, the scanning sequence of the gate driving circuit 130 without the reordering operation is "GL1, GL2, GL3, GL4, GL5, GL6, GL7, GL8, GL9, GL10, GL11, GL12, GL13, GL14, GL15, GL16, . . . and etc." As shown, the scanning operation for the display lines is performed sequentially without jumping any display line. The scanning operation completes scanning all of the sub-pixels on the same display line (e.g., the sub-pixels B11 and R12 on the first display line GL1) before scanning the sub-pixels on the next display line (e.g., the sub-pixels B21 and R22 on the second display line GL2). In addition, the scanning operation for the display lines is also performed along a same direction, rather than in a forth-and-back manner.

When the input data string DS1 is a pattern in all the same color (e.g., red) (i.e., the red sub-pixel data has the highest gray level, while the other sub-pixel data have the lowest gray level), a voltage transition may occur to the sub-pixel voltage string Vd of the data lines S1 and S2 quite frequently. The frequent voltage transition indicates that power consumption of the source driving circuit 122 may be high.

Figure 5:
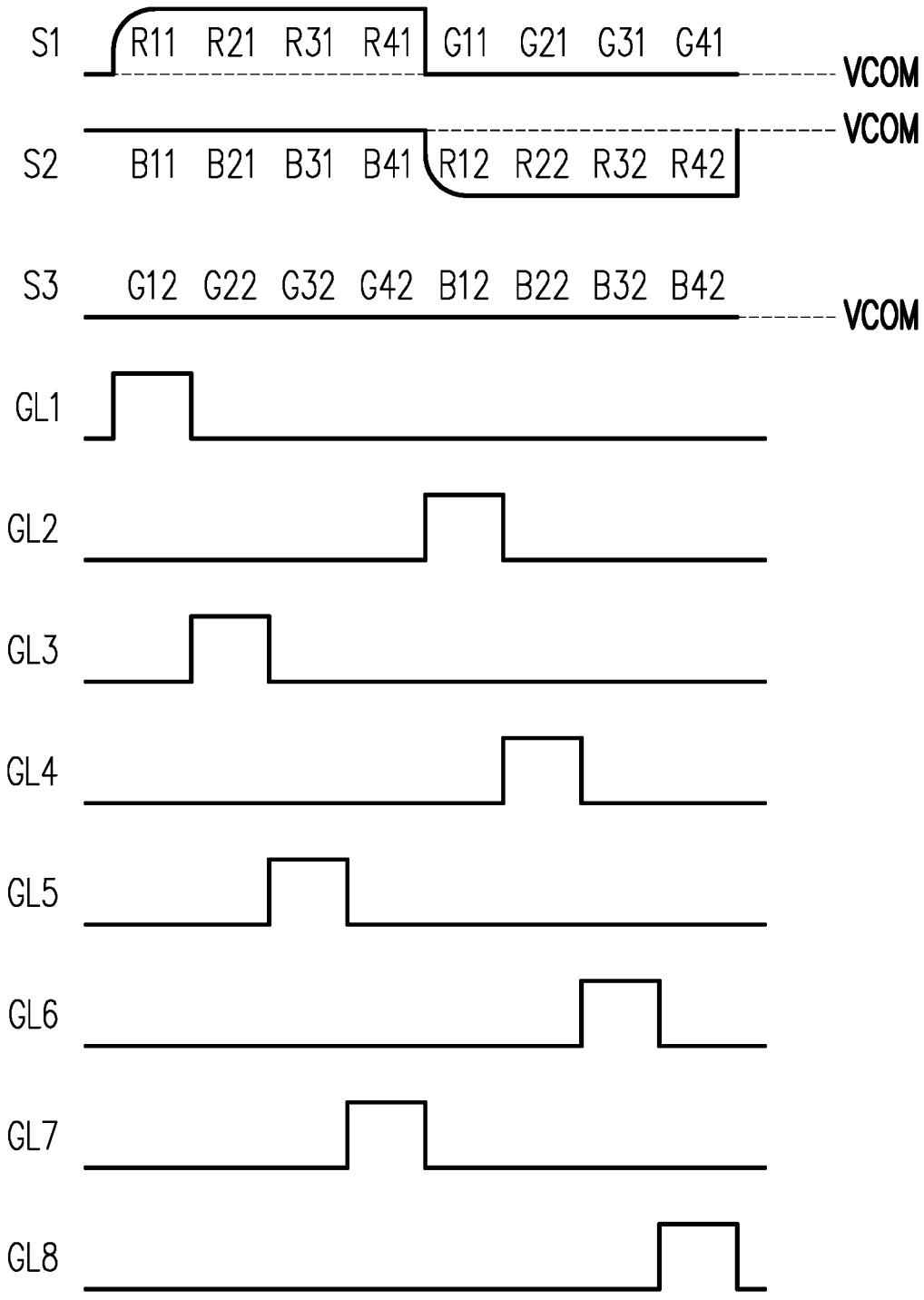
FIG. 5 is a signal timing diagram of the display panel shown in FIG. 3 according to an embodiment of the invention.

FIG. 5 is a signal timing diagram of the display panel 10 shown in FIG. 3 according to another implementation which can reduce the power consumption. VCOM shown in FIG. 5 represents the common voltage of the display panel 10. Referring to FIG. 1, FIG. 2 and FIG. 5, the reordering circuit 121 may reorder the plurality of sub-pixel data of the input data string DS1 to generate the reordered data string DS2 so as to reduce a color switching number associated with the data line S2 (i.e., the target data line) of the display panel 10. For example, the reordering circuit 121 may reorder the sub-pixel data corresponding to the blue sub-pixels B11, B21, B31 and B41 to the reordered sub string of the reordered data string DS2 and reorder the sub-pixel data corresponding to the red sub-pixels R12, R22, R32 and R42 to the reordered sub string of the reordered data string DS2. Thus, the output sequence (sub-pixel sequence) of the reordered sub string of the reordered data string DS2 corresponding to the data line S2 is "B11, B21, B31, B41, R12, R22, R32, R42, B51, . . . ," as shown in FIG. 5. This means that four sub-pixels having the same color are clustered together as a group. Correspondingly, the scanning sequence of the gate driving circuit 130 is "GL1, GL3, GL5, GL7, GL2, GL4, GL6, GL8, GL9, GL11, GL13, GL15, GL10, GL12, GL14, GL16, . . . ," as shown in FIG. 5. In other words, a first group of sub-pixels having a first same color (e.g., blue) and a second group of sub-pixels having a second same color (e.g., red) can be scanned sequentially. The first group of pixels comprise B11, B21, B31, B41 scanned sequentially, and the second group of pixels comprise R12, R22, R32, R42 scanned sequentially after the first group of the sub-pixels are scanned. The first group of the sub-pixels comprise the a first sub-pixel arranged on an $i^{th}$ display line and a second sub-pixel arranged on an $j^{th}$ display line scanned sequentially in time sequence, wherein i and j are integers, and j=i+p1*N, wherein i, j and p1 are positive integers and N=1 for the display panel of FIG. 3. Similarly, the first group of the sub-pixels comprise the a first sub-pixel arranged on an $i^{th}$ display line and a second sub-pixel arranged on an $k^{th}$ display line scanned sequentially in time sequence, wherein i and j are integers, and k=i+p2*N, wherein k and p2 are positive integers.

When the input data string DS1 is the pattern in all the same color (e.g., red) (i.e., the red sub-pixel data has the highest gray level, while other sub-pixel data have the lowest gray level), because the sub-pixel data corresponding to the red sub-pixels are clustered together, the color switching number (i.e., the number of voltage transition times) associated with the data lines S1 and S2 may be effectively reduced. The reduction of the color switching number represents that the power consumption of the source driving circuit 122 may be effectively reduced.

The scanning operation shown in FIG. 5 can be referred to as being performed in a "forth-and-back manner" without first completing scanning all of the sub-pixels (e.g., B11 and R12) connected to the target data line (e.g., the data line S2) and arranged on a same display line, (e.g., the first display line DL1). A first group of the sub-pixels having a first color (e.g., blue) can comprise a first sub-pixel B11 and at least one second sub-pixel B21, B31, B41 and a second group of the sub-pixels having a second color (e.g., red) can comprise a third sub-pixel R12 scanned sequentially in time sequence. The first sub-pixel B11 is arranged on the first display line DL1, the at least one second sub-pixel B21, B31, B41 are arranged on at least one display line DL2, DL3, and DL4 other than the first display line DL1, and the third sub-pixel R12 is arranged on the first display line DLL In other words, without first complete the scanning for all of the sub-pixels B11 and R12 on the first display line DL1, the scanning operation is performed from the first display line DL1, sequentially through the second display line DL2, the third display line DL3, and the fourth display line DL4, and then back to the first display line DL1.

It is noted that the reordering operation of the reordering circuit 121 should not be limited to the contents set forth above. According to a design requirement, in some other embodiments, the output sequence of the reordered data string DS2 can have different numbers of the same-color sub-pixels clustered together.

Figure 6:
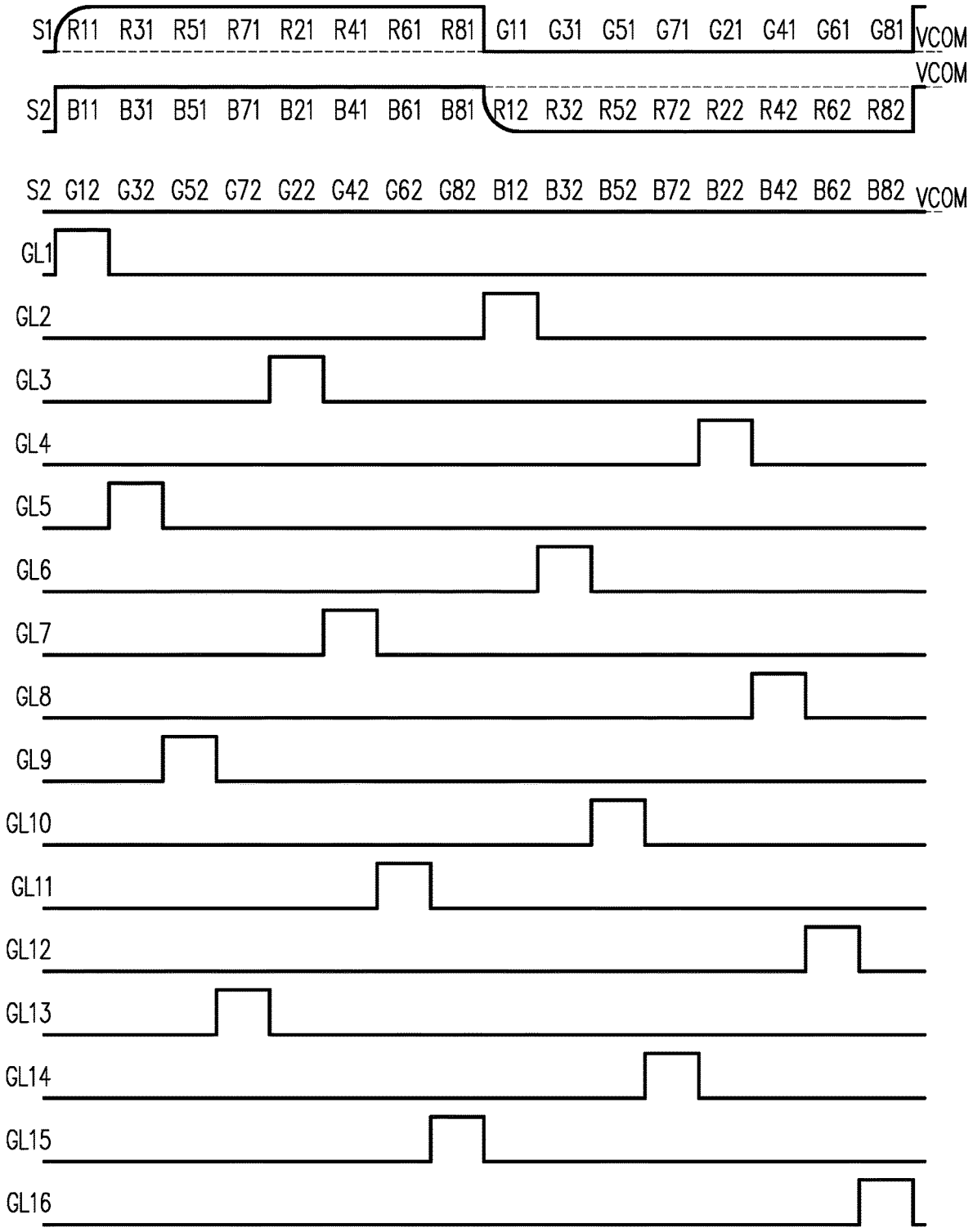
FIG. 6 is a signal timing diagram of the display panel shown in FIG. 3 according to another embodiment of the invention.

FIG. 6 is a signal timing diagram of the display panel 10 shown in FIG. 3 according to another embodiment of the invention. VCOM shown in FIG. 6 represents the common voltage of the display panel 10. In this example implementation, the output sequence (sub-pixel sequence) of the reordered data string DS2 corresponding to the data line S2 may be "B11, B31, B51, B71, B21, B41, B61, B81, R12, R32, R52, R72, R22, R42, R62, R82, . . . , and etc." This means that more sub-pixels (eight) having the same color are clustered together compared to FIG. 5. Correspondingly, the scanning sequence of the gate driving circuit 130 may be "GL1, GL5, GL9, GL13, GL3, GL7, GL11, GL15, GL2, GL6, GL10, GL14, GL4, GL8, GL12, GL16, . . . , and etc." In other words, a first group of sub-pixels having a first same color (e.g., blue) and a second group of sub-pixels having a second same color (e.g., red) can be scanned sequentially. The first group of pixels comprise B11, B31, B51, B71, B21, B41, B61, B81 scanned sequentially, and the second group of pixels comprise R12, R32, R52, R72, R22, R42, R62, R82 scanned sequentially after the first group of the sub-pixels are scanned. The first group of the sub-pixels comprise the a first sub-pixel arranged on an $i^{th}$ display line and a second sub-pixel arranged on an $i^{th}$ display line scanned sequentially in time sequence, wherein i and j are integers, and j=i+p1*N, wherein i, j and p1 are positive integers and N=1 for the display panel of FIG. 3. Similarly, the first group of the sub-pixels comprise the a first sub-pixel arranged on an $i^{th}$ display line and a second sub-pixel arranged on an $k^{th}$ display line scanned sequentially in time sequence, wherein i and j are integers, and k=i+p2*N, wherein k and p2 are positive integers.

When the input data string DS1 is the pattern in all the same color (e.g., red), because the sub-pixel data corresponding to the red sub-pixels are clustered together, the color switching number (i.e., the number of voltage transition times) associated with the data lines S1 and S2 may be effectively reduced.

The scanning operation shown in FIG. 6 can be referred to as being performed in a manner of "jumping-across at least one display line". A first group of the blue sub-pixels can comprise a first sub-pixel B11 arranged on the first display line DL1 and a second sub-pixel B31 arranged on the third display line DL3 scanned sequentially in time sequence. The display line DL3 is not the display line DL2 adjacent to the display line DLL The number of jumped display line(s) (i.e., DL2) is (3−1)−1=1 display lines, which can be equal to an integer multiple (denoted as a positive integer "p1") of N (where N=1 for the display panel of FIG. 3) subtracted by 1. In other words, the number of the jumped display line(s)=(p1*N−1) (namely 1=(2*1−1) in this case). Similarly, more "jumping-across at least one display line" can be performed. The scanning can be performed by jumping from the sub-pixel B31 on the display line DL3, across the display line DL4, to the sub-pixel B51 on the display line DL5. The scanning can be performed by jumping from the sub-pixel B51 on the display line DL5, across the display line DL6, to the sub-pixel B71 on the display line DL7. The scanning can be performed by jumping from the sub-pixel B71 on the display line DL7, across the display lines DL6, DL5, DL4, and DL3, to the sub-pixel B21 on the display line DL2. The scanning can be performed by jumping from the sub-pixel B21 on the display line DL2, across the display line DL3, to the sub-pixel B41 on the display line DL4. The scanning can be performed by jumping from the sub-pixel B41 on the display line DL4 across the display line DL5, to the sub-pixel B61 on the display line DL6. The scanning can be performed by jumping from the sub-pixel B61 on the display line DL6 across the display line DL7, to the sub-pixel B81 on the display line DL8.

Similarly, after the first group of the blue sub-pixels B11, B31, B51, B71, B41, B61, and B81 are scanned in the manner of "jumping-across at least one display line," a second group of the red sub-pixels R12, B32, R52, R72, R42, R62, and R82 can be scanned in the manner of "jumping-across at least one display line For example, a first sub-pixel R12 arranged on the first display line DL1 and a second sub-pixel B32 arranged on the third display line DL3 can be scanned sequentially in time sequence. The number of jumped display line(s) (i.e., DL2) is (3−1)−1=1 display lines, which can be equal to an integer multiple (denoted as a positive integer "p2") of N (where N=1 for the display panel of FIG. 3) subtracted by 1. In other words, the number of the jumped display line(s)=p2*N (namely 1=(2*1−1) in this case).

It is noted that the scanning operation shown in FIG. 6 can be also referred to as being performed in a "forth-and-back manner" without first completing scanning all of the sub-pixels B11 and R12 connected to the target data line S2 and arranged on a same display line, e.g., DL1. A first group of the sub-pixels having a first color (e.g., blue) can comprise a first sub-pixel B11 and at least one second sub-pixel B31, B51, B71, B21, B41, B61, and B81 and a second group of the sub-pixels having a second color (e.g., red) can comprise a third sub-pixel R12 scanned sequentially in time sequence. The first sub-pixel B11 is arranged on the first display line DL1, the at least one second sub-pixel B31, B51, B71, B21, B41, B61, and B81 are arranged on at least one display line DL3, DL5, DL7, DL2, DL4, DL6, and DL8 other than the first display line DL1, and the third sub-pixel R12 is arranged on the first display line DL1. In other words, without first complete the scanning for all of the sub-pixels B11 and R12 on the first display line DL1, the scanning operation is performed from the first display line DL1, sequentially through the display lines DL3, DL5, DL7, DL2, DL4, DL6, and DL8, and then back to the first display line DL1.

Figure 7:
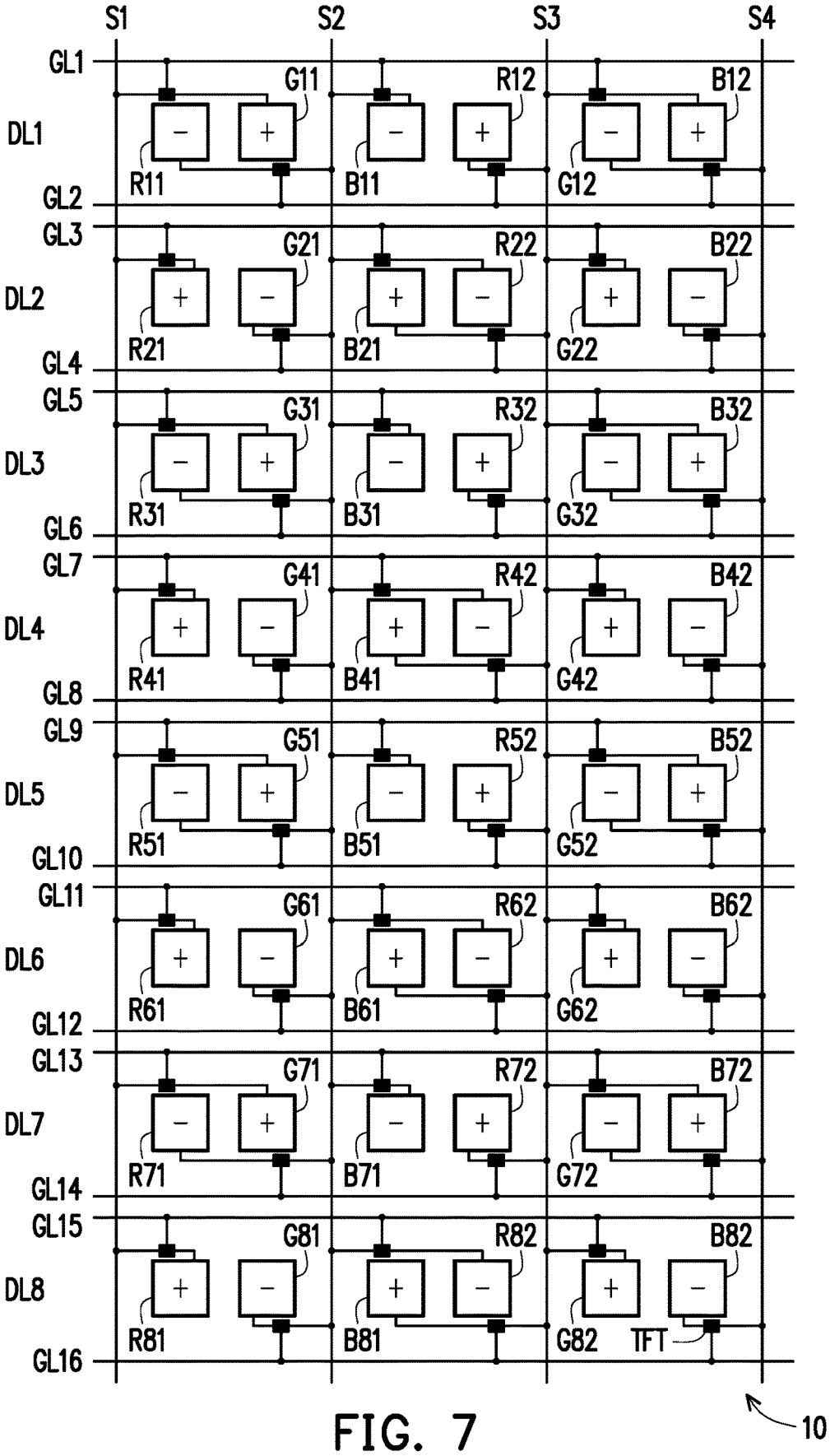
FIG. 7 is a schematic layout diagram of the display panel depicted in FIG. 1 according to another embodiment of the invention.

FIG. 7 is a schematic layout diagram of the display panel 10 depicted in FIG. 1 according to another embodiment of the invention. In the embodiment illustrated in FIG. 7, the display panel 10 can be a zigzag dual-gate display panel. The display panel 10 can includes a plurality of data lines (e.g., S1 to S4) a plurality of scan lines (e.g., GL1 to GL16) and a plurality of sub-pixels connected to the data lines and the scan lines. The source driving circuit 122 can output the sub-pixel voltage string Vd to drive the data lines of the display panel 10. The gate driving circuit 130 can scan (drive) the scan lines of the display panel 10. The sub-pixels of the display panel 10 can includes red sub-pixels (e.g., R11 to R12, R21 to R22, R31 to R32, R41 to R42, R51 to R52, R61 to R62, R71 to R72 and R81 to R82), green sub-pixels (e.g., G11 to G12, G21 to G22, G31 to G32, G41 to G42, G51 to G52, G61 to G62, G71 to G72 and G81 to G82) and blue sub-pixels (e.g., B11 to B12, B21 to B22, B31 to B32, B41 to B42, B51 to B52, B61 to B62, B71 to B72 and B81 to B82). A target data line of the data lines can be connected to different colors of the sub-pixels. In addition, the sub-pixels can be arranged as a plurality of display lines, for example, DL1-DL8 along an extension direction of the scan lines. The sub-pixels arranged on a same display line and connected to the target data line may have different colors. The sub-pixels connected to a target data line of the data lines S1-S4 can have a same color every N display line(s), wherein N is a positive integer. In the embodiment, N can be 2. Each of the black solid squares shown in FIG. 7 represents a switch TFT.

More specifically, the red sub pixel R11, the green sub pixel G11, the blue sub pixel B11, the red sub pixel R12, the green sub pixel G12 and the blue sub pixel B12 are arranged on a display line (display row) DLL The red sub pixel R21, the green sub pixel G21, the blue sub pixel B21, the red sub pixel R22, the green sub pixel G22 and the blue sub pixel B22 are arranged on a display line DL2. The red sub pixel R31, the green sub pixel G31, the blue sub pixel B31, the red sub pixel R32, the green sub pixel G32 and the blue sub pixel B32 are arranged on a display line DL3. The red sub pixel R41, the green sub pixel G41, the blue sub pixel B41, the red sub pixel R42, the green sub pixel G42 and the blue sub pixel B42 are arranged on a display line DL4. The red sub pixel R51, the green sub pixel G51, the blue sub pixel B51, the red sub pixel R52, the green sub pixel G52 and the blue sub pixel B52 are arranged on a display line DL5. The red sub pixel R61, the green sub pixel G61, the blue sub pixel B61, the red sub pixel R62, the green sub pixel G62 and the blue sub pixel B62 are arranged on a display line DL6. The red sub pixel R71, the green sub pixel G71, the blue sub pixel B71, the red sub pixel R72, the green sub pixel G72 and the blue sub pixel B72 are arranged on a display line DL7. The red sub pixel R81, the green sub pixel G81, the blue sub pixel B81, the red sub pixel R82, the green sub pixel G82 and the blue sub pixel B82 are arranged on a display line DL8.

Figure 8:
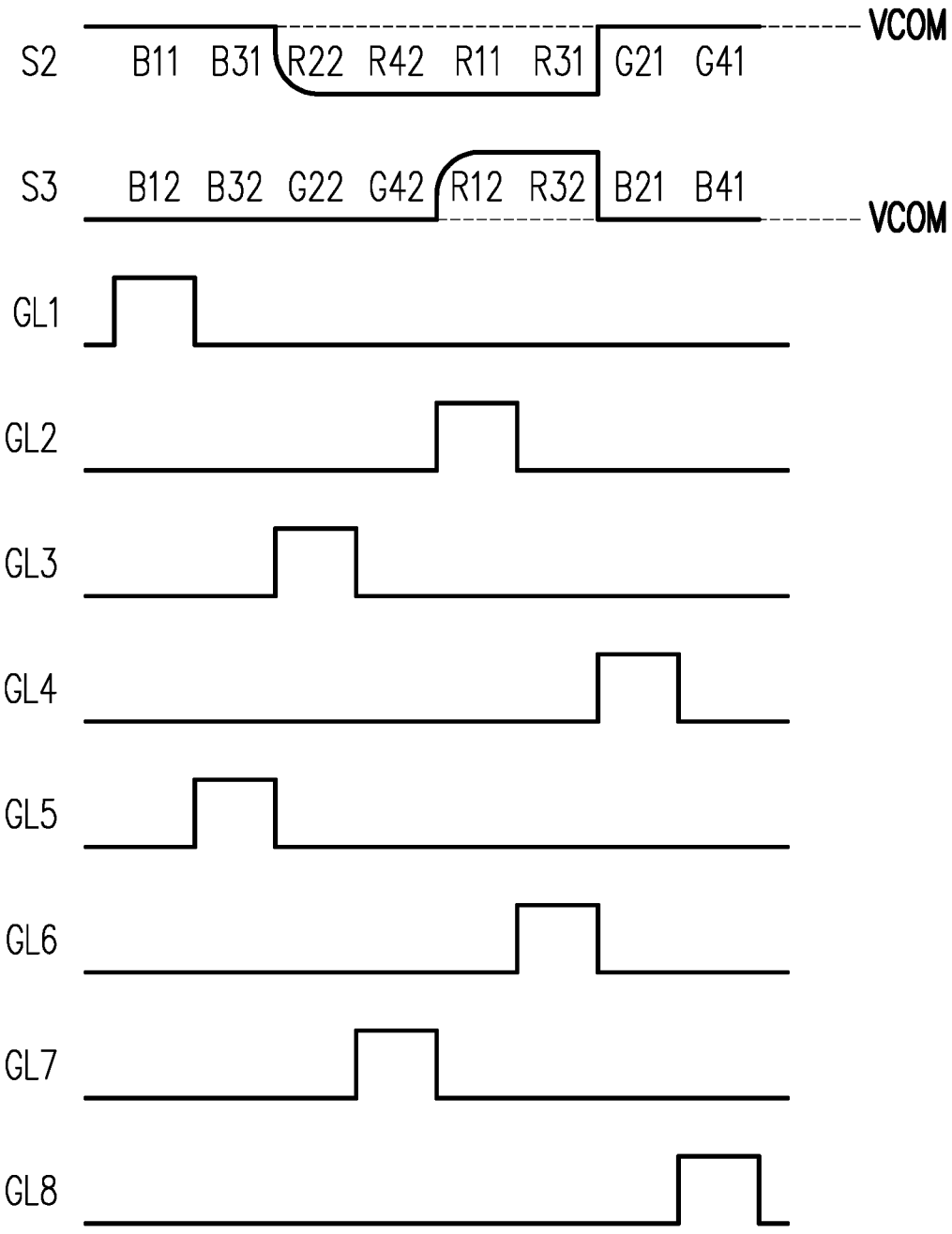
FIG. 8 is a signal timing diagram of the display panel shown in FIG. 7 according to an embodiment of the invention.

FIG. 8 is a signal timing diagram of the display panel 10 shown in FIG. 7 according to an embodiment of the invention. VCOM shown in FIG. 8 represents the common voltage of the display panel 10. In the example implementation, the output sequence of the sub-pixel voltage string Vd of the data line S2 (referred to as the target data line) is taken as an example for description below, and other data lines may be analogously inferred with reference to the description related to the data line S2 and will not be repeatedly described.

For the data line S2, the output sequence of the input data string DS1 can be B11, R11, R22, G21, B31, R31, R42, G41, . . . , and etc. . . . . The reordering circuit 121 may reorder the plurality of sub-pixel data of the input data string DS1 to generate the reordered data string DS2. This can reduce the color switching number associated with the data line S2 (i.e., the target data line) of the display panel 10, further reducing the power consumption, t. For example, the output sequence of the reordered sub string of the reordered data string DS2 is B11, B31, R22, R42, R11, R31, G21, G41, B51, . . . . Correspondingly, the scanning sequence of the gate driving circuit 130 is GL1, GL5, GL3, GL7, GL2, GL6, GL4, GL8, GL9, GL13, GL11, GL15, GL10, GL14, GL12, GL16, . . . , and etc. In other words, a first group of sub-pixels having a first same color (e.g., blue) and a second group of sub-pixels having a second same color (e.g., red) can be scanned sequentially. The first group of pixels comprise B11 and B31 scanned sequentially, and the second group of pixels comprise R22, R42, R11 and R31 scanned sequentially after the first group of the sub-pixels are scanned. The first group of the sub-pixels comprise the a first sub-pixel arranged on an $i^{th}$ display line and a second sub-pixel arranged on an $j^{th}$ display line scanned sequentially in time sequence, wherein i and j are integers, and $j=i+p1*N$, wherein i, j and p1 are positive integers and N=2 for the display panel of FIG. 7. Similarly, the first group of the sub-pixels comprise the a first sub-pixel arranged on an $i^{th}$ display line and a second sub-pixel arranged on an $k^{th}$ display line scanned sequentially in time sequence, wherein i and j are integers, and $k=i+p2*N$, wherein k and p2 are positive integers.

Because the sub-pixel data corresponding to the same color sub-pixel are clustered together, the color switching number (i.e., the number of voltage transition times) of the sub-pixel voltage string Vd may be effectively reduced. The reduction of the color switching number represents that the power consumption of the source driving circuit 122 may be effectively reduced. For example, when the input data string DS1 is the pattern in all the same color (e.g., red), because the sub-pixel data corresponding to the red sub-pixels are clustered together, the color switching number (i.e., the number of voltage transition times) associated with the data line S2 may be effectively reduced.

The scanning operation shown in FIG. 8 can be referred to as being performed in a manner of "jumping-across at least one display line". A first group of the blue sub-pixels can comprise a first sub-pixel B11 arranged on the first display line DL1 and a second sub-pixel B31 arranged on the third display line DL3 scanned sequentially in time sequence. The display line DL3 is not the display line DL2 adjacent to the display line DLL The number of jumped display line(s) (i.e., DL2) is (3−1)−1=1 display lines, which can be equal to an integer multiple (denoted as a positive integer "p1") of N (where N=2 for the display panel of FIG. 7) subtracted by 1. In other words, the number of the jumped display line(s)=p1*N−1 (namely 1=(1*2−1) in this case).

Similarly, after the first group of the blue sub-pixels B11 and B31 are scanned in the manner of "jumping-across at least one display line," a second group of the red sub-pixels R22, R42, R11 and R31 can be scanned in the manner of "jumping-across at least one display line. For example, a first sub-pixel R22 arranged on the first display line DL2 and a second sub-pixel B42 arranged on the third display line DL4 can be scanned sequentially in time sequence. The number of jumped display line(s) (DL3) is (4−2)−1=1, which can be equal to an integer multiple (denoted as a positive integer "p2") of N (where N=2 for the display panel of FIG. 7) subtracted by 1. In other words, the number of the jumped display line(s)=p2*N−1 (namely 1=(1*2−1) in this case).

It is noted that the scanning operation shown in FIG. 8 can be also referred to as being performed in a "forth-and-back manner" without first completing scanning all of the sub-pixels B11 and R11 connected to the target data line S2 and arranged on a same display line, e.g., DLL A first group of the sub-pixels having a first color (e.g., blue) can comprise a first sub-pixel B11 and at least one second sub-pixel B31 and a second group of the sub-pixels having a second color (e.g., red) can comprise sub-pixels R22, R42 and a third sub-pixels R11 scanned sequentially in time sequence. The first sub-pixel B11 is arranged on the first display line DL1, the at least one second sub-pixel B31 is arranged on at least one display line DL3 other than the first display line DL1, the sub-pixels R22 and R42 are arranged on DL2 and DL4, and the third sub-pixel R11 is arranged on the first display line DLL In other words, without first complete the scanning for all of the sub-pixels B11 and R11 on the first display line DL1, the scanning operation is performed from the first display line DL1, sequentially through the display lines DL3, DL2, and DL4, and then back to the first display line DL1.

It is noted that, referring to FIG. 1 and FIG. 7, the reordering operation of the reordering circuit 121 should not be limited to the contents set forth above. According to a design requirement, in some other embodiments, the output sequence of the reordered data string DS2 can have different numbers of the same-color sub-pixels clustered together.

Figure 9:
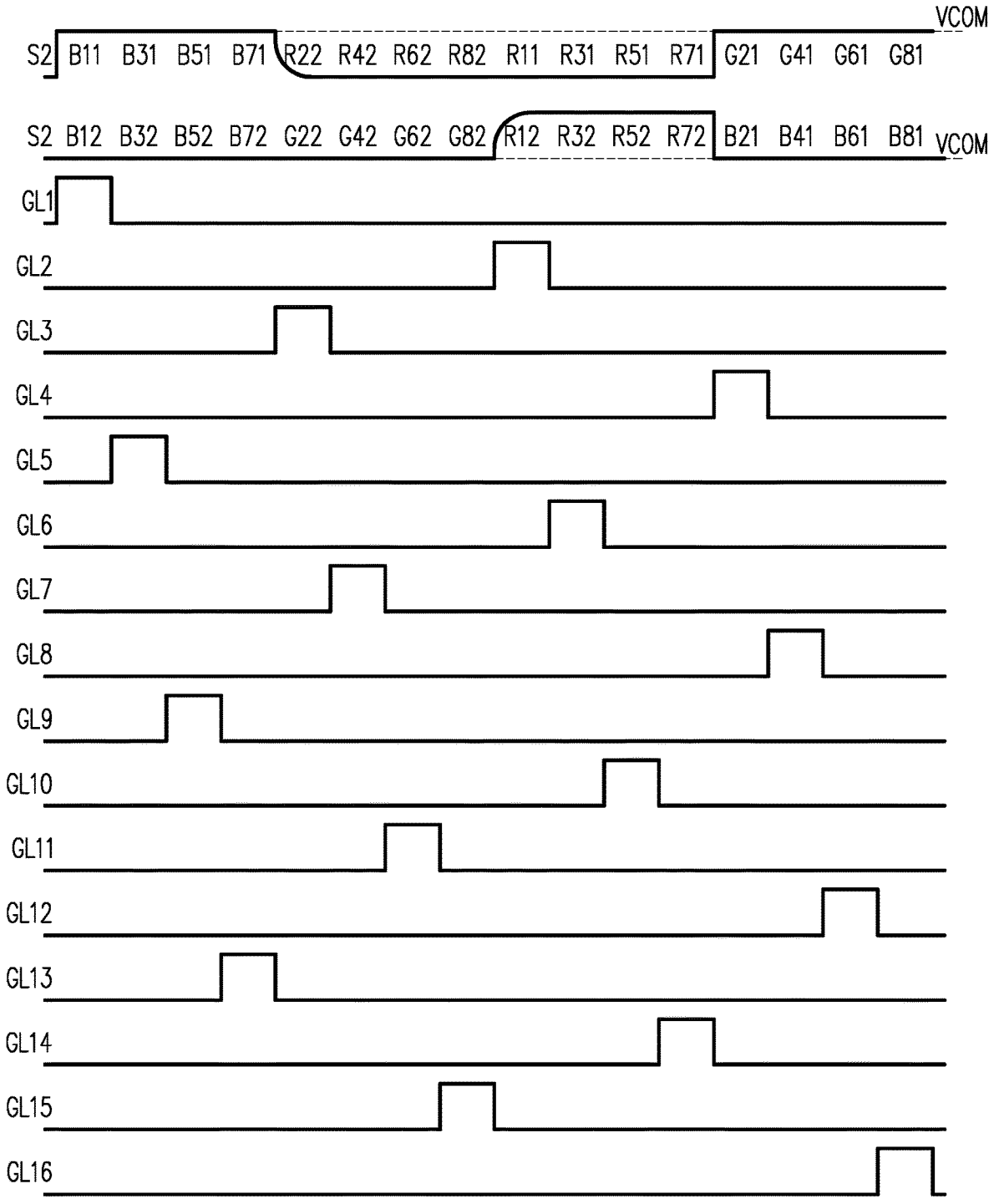
FIG. 9 is a signal timing diagram of the display panel shown in FIG. 7 according to another embodiment of the invention.

FIG. 9 is a signal timing diagram of the display panel 10 shown in FIG. 7 according to another embodiment of the invention. VCOM shown in FIG. 9 represents the common voltage of the display panel 10. In the example implementation, the output sequence (sub-pixel sequence) of the reordered data string DS2 of the reordering circuit 121 may be "B11, B31, B51, B71, R22, R42, R62, R82, R11, R31, R51, R71, G21, G41, G61, G81, . . . , and etc." This means that more sub-pixels having the same color are clustered together compared to FIG. 8. Correspondingly, the scanning sequence of the gate driving circuit 130 may be "GL1, GL5, GL9, GL13, GL3, GL7, GL11, GL15, GL2, GL6, GL10, GL14, GL4, GL8, GL12, GL16, . . . , and etc." In other words, a first group of sub-pixels having a first same color (e.g., blue) and a second group of sub-pixels having a second same color (e.g., red) can be scanned sequentially. The first group of pixels comprise B11, B31, B51, and B71 scanned sequentially, and the second group of pixels comprise R22, R42, R62, R82, R11, R31, R51, R71 scanned sequentially after the first group of the sub-pixels are scanned. The first group of the sub-pixels comprise the a first sub-pixel arranged on an $i^{th}$ display line and a second sub-pixel arranged on an $j^{th}$ display line scanned sequentially in time sequence, wherein i and j are integers, and j=i+p1*N, wherein i, j and p1 are positive integers and N=2 for the display panel of FIG. 7. Similarly, the first group of the sub-pixels comprise the a first sub-pixel arranged on an $i^{th}$ display line and a second sub-pixel arranged on an 0 display line scanned sequentially in time sequence, wherein i and j are integers, and k=i+p2*N, wherein k and p2 are positive integers.

When the input data string DS1 is the pattern in all the same color (e.g., red), because the sub-pixel data corresponding to the red sub-pixels are clustered together, the color switching number (i.e., the number of voltage transition times) associated with the data line S2 may be effectively reduced.

The scanning operation shown in FIG. 9 can be referred to as being performed in a manner of "jumping-across at least one display line". A first group of the blue sub-pixels can comprise a first sub-pixel B11 arranged on the first display line DL1 and a second sub-pixel B31 arranged on the third display line DL3 scanned sequentially in time sequence. The display line DL3 is not the display line DL2 adjacent to the display line DL1. The number of jumped display line(s) (DL2) is (3−1)−1=1 display lines, which can be equal to an integer multiple (denoted as a positive integer "p1") of N (where N=2 for the display panel of FIG. 7) subtracted by 1. In other words, the number of the jumped line(s)=p1*N−1 (namely 1=(1*2−1) in this case). Similarly, more "jumping-across at least one display line" can be performed. The scanning can be performed by jumping from the sub-pixel B31 on the display line DL3, across the display line DL4, to the sub-pixel B51 on the display line DL5. The scanning can be performed by jumping from the sub-pixel B51 on the display line DL5, across the display line DL6, to the sub-pixel B71 on the display line DL7.

Similarly, after the first group of the blue sub-pixels B11, B31, B51, and B71 are scanned in the manner of "jumping-across at least one display line," a second group of the red sub-pixels R22, R42, R62, R82, R11, R31, R51, and R71 can be scanned in the manner of "jumping-across at least one display line For example, a first sub-pixel R22 arranged on the first display line DL2 and a second sub-pixel R42 arranged on the third display line DL4 can be scanned sequentially in time sequence. The number of jumped display line(s) (DL3) is (4−2)−1=1 display lines, which can be equal to an integer multiple (denoted as a positive integer "p2") of N (where N=2 for the display panel of FIG. 7). In other words, the number of the jumped display line(s)=p2*N (2=1*2 in this case).

It is noted that the scanning operation shown in FIG. 9 can be also referred to as being performed in a "forth-and-back manner" without first completing scanning all of the sub-pixels B11 and R11 connected to the target data line S2 and arranged on a same display line, e.g., DLL A first group of the sub-pixels having a first color (e.g., blue) can comprise a first sub-pixel B11 and at least one second sub-pixel B31, B51 and B71 and a second group of the sub-pixels having a second color (e.g., red) can comprise sub-pixels R22, R42, R62, and R82 and a third sub-pixels R11 scanned sequentially in time sequence. The first sub-pixel B11 is arranged on the first display line DL1, the at least one second sub-pixel B31, B51 and B71 are arranged on at least one display line DL3, DL5, DL7 other than the first display line DL1, the sub-pixels R22, R42, R62, and R82 are arranged on DL2, DL4, DL6, and DL8, and the third sub-pixel R11 is arranged on the first display line DL1. In other words, without first complete the scanning for all of the sub-pixels B11 and R11 on the first display line DL1, the scanning operation is performed from the first display line DL1, sequentially through the display lines DL3, DL5, DL7, DL2, DL4, DL6, and DL8, and then back to the first display line DL1.

Figure 10:
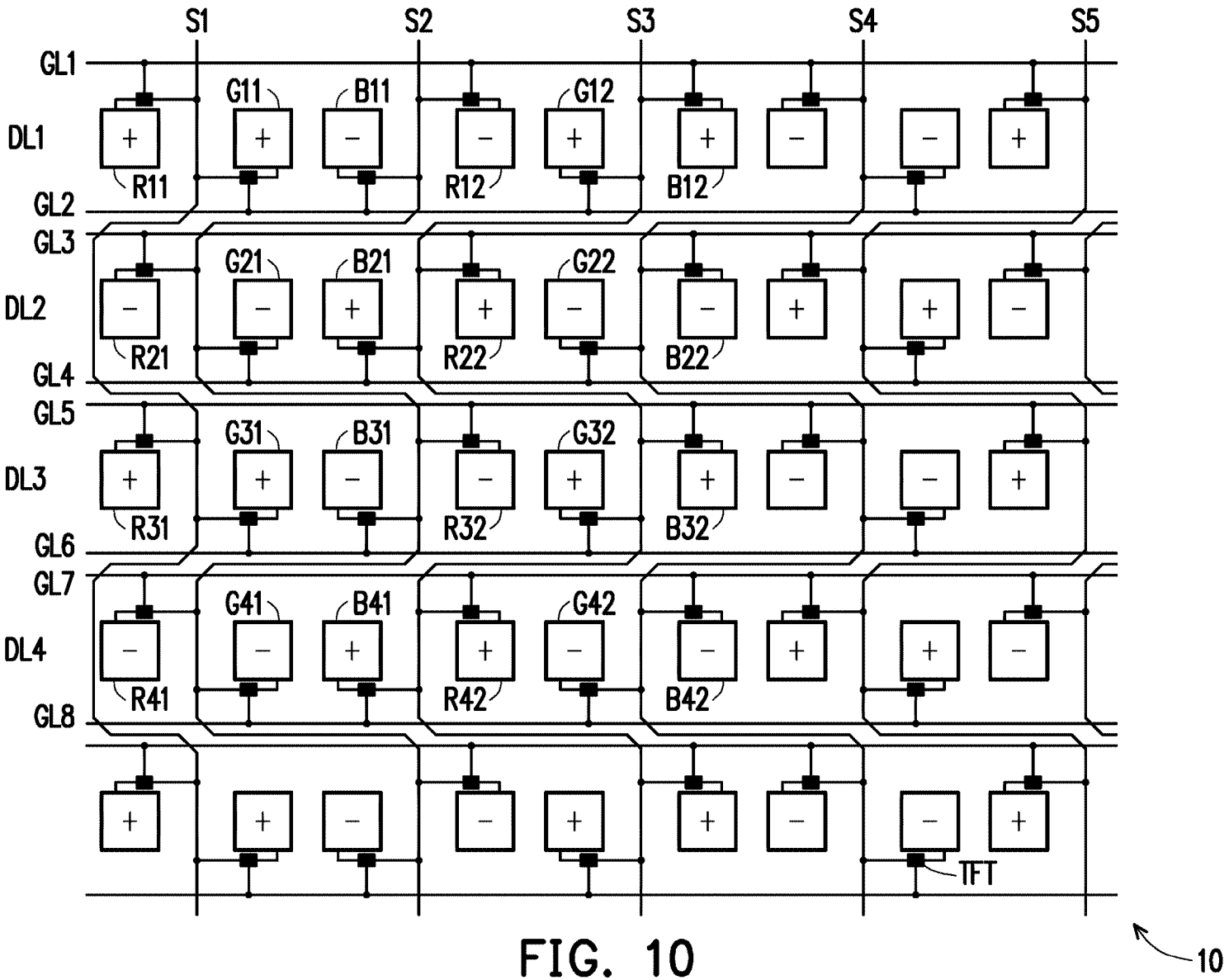
FIG. 10 is a schematic layout diagram of the display panel depicted in FIG. 1 according to yet another embodiment of the invention.

FIG. 10 is a schematic layout diagram of the display panel 10 depicted in FIG. 1 according to yet another embodiment of the invention. In the embodiment illustrated in FIG. 10, the display panel 10 is a zigzag dual-gate display panel. The display panel 10 can include a plurality of data lines (e.g., S1 to S5), a plurality of scan lines (e.g., GL1 to GL8) and a plurality of sub-pixels connected to the data lines and the scan lines. The source driving circuit 122 can output the sub-pixel voltage string Vd to drive the data lines of the display panel 10. The gate driving circuit 130 can scan (drive) the scan lines of the display panel 10. The sub-pixels of the display panel 10 can include red sub-pixels (e.g., R11 to R12, R21 to R22, R31 to R32 and R41 to R42), green sub-pixels (e.g., G11 to G12, G21 to G22, G31 to G32 and G41 to G42) and blue sub-pixels (e.g., B11 to B12, B21 to B22, B31 to B32 and B41 to B42). A target data line of the data lines is connected to different colors of the sub-pixels. In addition, the sub-pixels can be arranged as a plurality of display lines, for example, DL1-DL4 along an extension direction of the scan lines. The sub-pixels connected to a target data line of the data lines S1-S5 can have a same color every N display line(s), wherein N is a positive integer. In the embodiment, N can be 2. Each of the black solid squares shown in FIG. 10 represents a switch TFT.

More specifically, the red sub pixel R11, the green sub pixel G11, the blue sub pixel B11, the red sub pixel R12, the green sub pixel G12 and the blue sub pixel B12 are arranged on a display line (display row) DLL The red sub pixel R21, the green sub pixel G21, the blue sub pixel B21, the red sub pixel R22, the green sub pixel G22 and the blue sub pixel B22 are arranged on a display line DL2. The red sub pixel R31, the green sub pixel G31, the blue sub pixel B31, the red sub pixel R32, the green sub pixel G32 and the blue sub pixel B32 are arranged on a display line DL3. The red sub pixel R41, the green sub pixel G41, the blue sub pixel B41, the red sub pixel R42, the green sub pixel G42 and the blue sub pixel B42 are arranged on a display line DL4.

Figure 11:
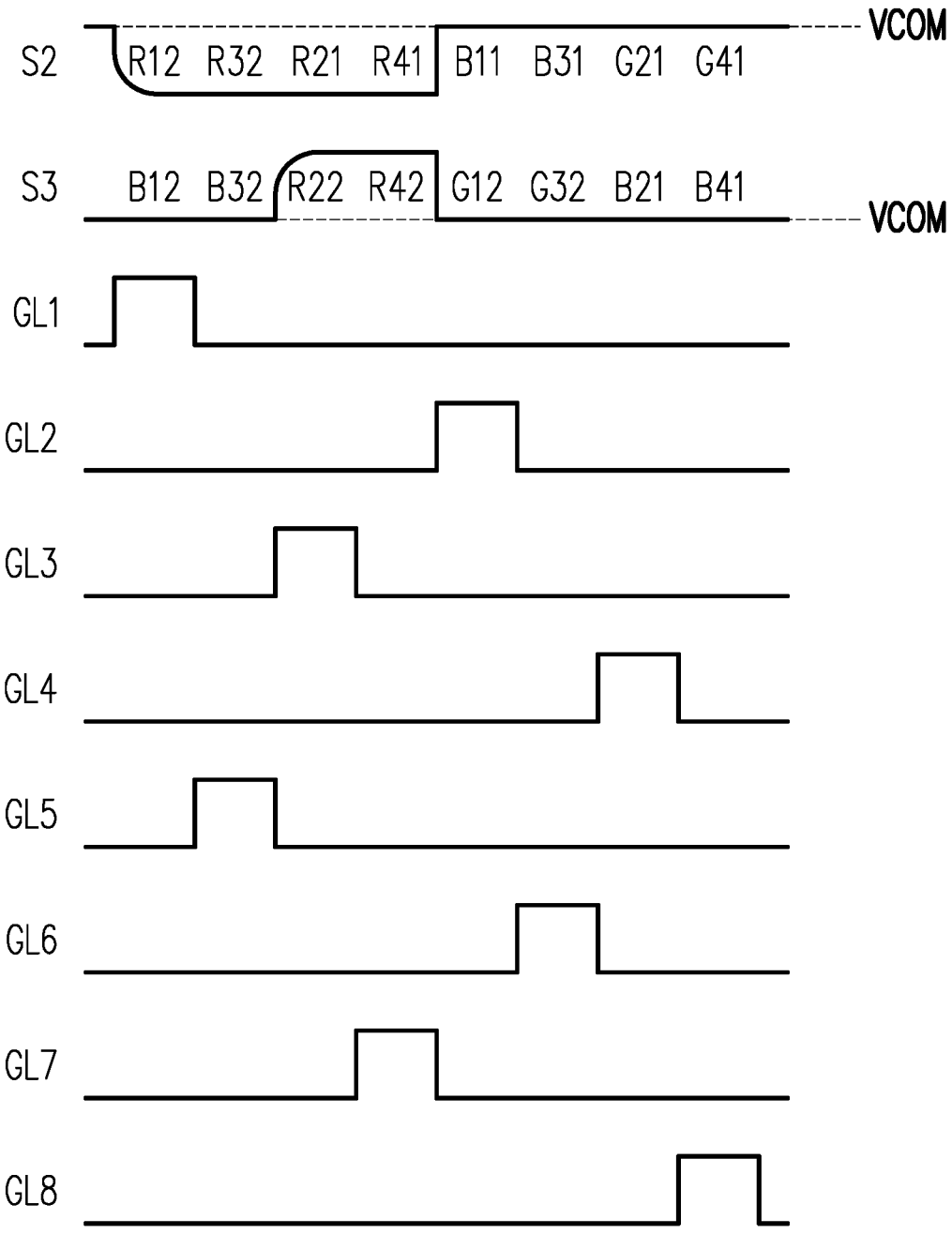
FIG. 11 is a signal timing diagram of the display panel shown in FIG. 10 according to an embodiment of the invention.

FIG. 11 is a signal timing diagram of the display panel 10 shown in FIG. 10 according to an embodiment of the invention. VCOM shown in FIG. 11 represents the common voltage of the display panel 10. The output sequence (sub-pixel sequence) of the sub-pixel voltage string Vd of the data line S2 (referred to as the target data line) is taken as an example for description below, and other data lines may be analogously inferred with reference to the description related to the data line S2 and will not be repeatedly described.

In the example implementation, for the data line S2, the output sequence (sub-pixel sequence) of the input data string DS1 is "R12, B11, R21, G21, R32, B31, R41, G41, . . . ". In order to reduce the power consumption, the reordering circuit 121 may reorder the plurality of sub-pixel data of the input data string DS1 to generate the reordered data string DS2 so as to reduce the color switching number associated with the data line S2 (i.e., the target data line) of the display panel 10. For example, the output sequence (sub-pixel sequence) of the reordered sub string of the reordered data string DS2 is "R12, R32, R21, R41, B11, B31, G21, G41, . . . " Correspondingly, the scanning sequence of the gate driving circuit 130 may be "GL1, GL5, GL3, GL7, GL2, GL6, GL4, GL8, . . . , and etc." In other words, a first group of sub-pixels having a first same color (e.g., red) and a second group of sub-pixels having a second same color (e.g., blue) can be scanned sequentially. The first group of pixels comprise R12, R32, R21, and R41 scanned sequentially, and the second group of pixels comprise B11 and B31 scanned sequentially after the first group of the sub-pixels are scanned. The first group of the sub-pixels comprise the a first sub-pixel arranged on an $i^{th}$ display line and a second sub-pixel arranged on an $j^{th}$ display line scanned sequentially in time sequence, wherein i and j are integers, and j=i+p1*N, wherein i, j and p1 are positive integers and N=2 for the display panel of FIG. 10. Similarly, the first group of the sub-pixels comprise the a first sub-pixel arranged on an $i^{th}$ display line and a second sub-pixel arranged on an 0 display line scanned sequentially in time sequence, wherein i and j are integers, and k=i+p2*N, wherein k and p2 are positive integers.

Because the sub-pixel data corresponding to the same color sub-pixel are clustered together, the color switching number (i.e., the number of voltage transition times) may be effectively reduced. The reduction of the color switching number represents that the power consumption of the source driving circuit 122 may be effectively reduced. For example, when the input data string DS1 is the pattern in all the same color (e.g., red), because the sub-pixel data corresponding to the red sub-pixels are clustered together, the color switching number (i.e., the number of voltage transition times) associated with the data line S2 may be effectively reduced.

The scanning operation shown in FIG. 11 can be referred to as being performed in a manner of "jumping-across at least one display line". A first group of the red sub-pixels can comprise a first sub-pixel R12 arranged on the first display line DL1 and a second sub-pixel R32 arranged on the third display line DL3 scanned sequentially in time sequence. The display line DL3 is not the display line DL2 adjacent to the display line DL1. The number of jumped display line(s) (DL2) is (3−1)−1=1, which can be equal to an integer multiple (denoted as a positive integer "p1") of N (where N=2 for the display panel of FIG. 7) subtracted by 1. In other words, the number of the jumped display line(s)=p1*N−1 (namely 1=1*2−1 in this case). The scanning can be performed then from the sub-pixel R32 on the display line DL3 to the sub-pixel B21 on the display line DL2. Similarly, more "jumping-across at least one display line" can be performed. The scanning can be performed by jumping from the sub-pixel B21 on the display line DL2, across the display line DL3, to the sub-pixel B41 on the display line DL4.

Similarly, after the first group of the red sub-pixels B12, B32, B21, and B41 are scanned in the manner of "jumping-across at least one display line," a second group of the blue sub-pixels B11, B31 can be scanned in the manner of "jumping-across at least one display line For example, a first sub-pixel B11 arranged on the first display line DL1 and a second sub-pixel B31 arranged on the third display line DL3 are scanned sequentially in time sequence. The number of jumped display line(s) (DL2) is (3−1)−1=1, which can be equal to an integer multiple (denoted as a positive integer "p2") of N (where N=2 for the display panel of FIG. 7) subtracted by 1. In other words, the number of the jumped display line(s)=p2*N−1 (namely 1=1*2−1 in this case).

It is noted that the scanning operation shown in FIG. 11 can be also referred to as being performed in a "forth-and-back manner" without first completing scanning all of the sub-pixels B11 and R12 connected to the target data line S2 and arranged on a same display line, e.g., DL1. A first group of the sub-pixels having a first color (e.g., red) can comprise a first sub-pixel R12 and at least one second sub-pixel R32, R21 and R41 and a second group of the sub-pixels having a second color (e.g., blue) can comprise a third sub-pixel B11 scanned sequentially in time sequence. The first sub-pixel R11 is arranged on the first display line DL1, the at least one second sub-pixel R32, R21 and R41 are arranged on at least one display line DL3, DL2, DL4 other than the first display line DL1, and the third sub-pixel B11 is arranged on the first display line DL1. In other words, without first complete the scanning for all of the sub-pixels R12 and B11 on the first display line DL1, the scanning operation is performed from the first display line DL1, sequentially through the display lines DL3, DL2, DL4, and then back to the first display line DL1.

It is worth noting that the same or different output sequences (sub-pixel sequences) or scanning sequences can be used in different frames. Depending on the design requirements, there are various possible implementations, which can be regular or partially or completely random. In some embodiments, a plurality of consecutive frames may be transformed in turn in a predetermined order in a plurality of different orders, and may be transformed once every one or more frames. As long as any frame has an adjustment output sequences or scanning sequences, it is within the scope of this disclosure.

In a condition that sub-pixel sequences of reordered data string (sub-pixel voltage string) in a plurality of consecutive frames are the same, some regular dark lines may likely occur to the display panel 10. The display panel illustrated in FIG. 10 is taken as an example for describing a solution in this case. In any way, the display panel (or other display panels) illustrated in FIG. 3, FIG. 7 and FIG. 14 may also have the same situation, and the solution illustrated in FIG. 10 may also be applicable thereto.

The example of "a pattern in all red" is continuously used in FIG. 11. The source driving circuit 122 needs a sufficient time to transit voltages of the data lines (e.g., S1 to S5) from the common voltage VCOM to other voltages voltage levels. Generally, a dual-gate panel has a shorter pixel charging time. Due to the insufficiency of the pixel charging time, taking FIG. 11 as an example, it may be too late to pull voltages of the red sub-pixels R12 and R22 to target voltages because of the insufficient pixel charging time, such that luminances (gray levels) of the red sub-pixels R12 and R22 are lower than luminances (gray levels) of the other red sub-pixels illustrated in FIG. 11. The phenomenon of "insufficient luminances" of the red sub-pixels R12 and R22 may also occur to a part of red sub-pixels of other data lines (or scan lines). After going through the plurality of consecutive frames, because the sub-pixel sequences of the reordered data strings (sub-pixel voltage strings) are the same, locations of the red sub-pixels at which the "insufficient luminances" appear are fixed, such that some regular dark lines occur to the display panel 10.

The aforementioned example uses "a pattern in all red" for description. In any way, patterns in other colors may also have similar phenomenon. For example, when the input data string DS1 is a pattern in all green (i.e., the green sub-pixel data has the highest gray level, while the other sub-pixel data have the lowest gray level), luminances (gray levels) of the green sub-pixels G21 and G12 illustrated in FIG. 11 are lower than luminances (gray levels) of the other green sub-pixels illustrated in FIG. 11. After going through the plurality of consecutive frames, because the sub-pixel sequences of the reordered data strings (sub-pixel voltage strings) are the same, locations of the green sub-pixels at which the "insufficient luminances" appear are fixed, such that some regular dark lines occur to the display panel 10.

In another example, when the input data string DS1 is a pattern in all yellow (i.e., the green sub-pixel data and red sub-pixel data have the highest gray level, while the blue sub-pixel data has the lowest gray level), the luminances (gray levels) of the red sub-pixels R12 and R22 and the green sub-pixel G21 illustrated in FIG. 11 are lower than luminances (gray levels) of the other red sub-pixels and the other green sub-pixels illustrated in FIG. 11. After going through the plurality of consecutive frames, because the sub-pixel sequences of the reordered data strings (sub-pixel voltage strings) are the same, locations of the red sub-pixels and the green sub-pixels at which the "insufficient luminances" appear are fixed, such that some regular dark lines occur to the display panel 10.

In order to solve the phenomenon of "regular dark lines", the reordering circuit 121 may use different output sequences (sub-pixel sequences) in different frames. Namely, a sub-pixel sequence of the reordered data string (sub-pixel voltage string) in a current frame is different from a sub-pixel sequence of the reordered data string (sub-pixel voltage string) in a previous frame ° However, the application of this method is not limited to solving this problem.

Figure 12:
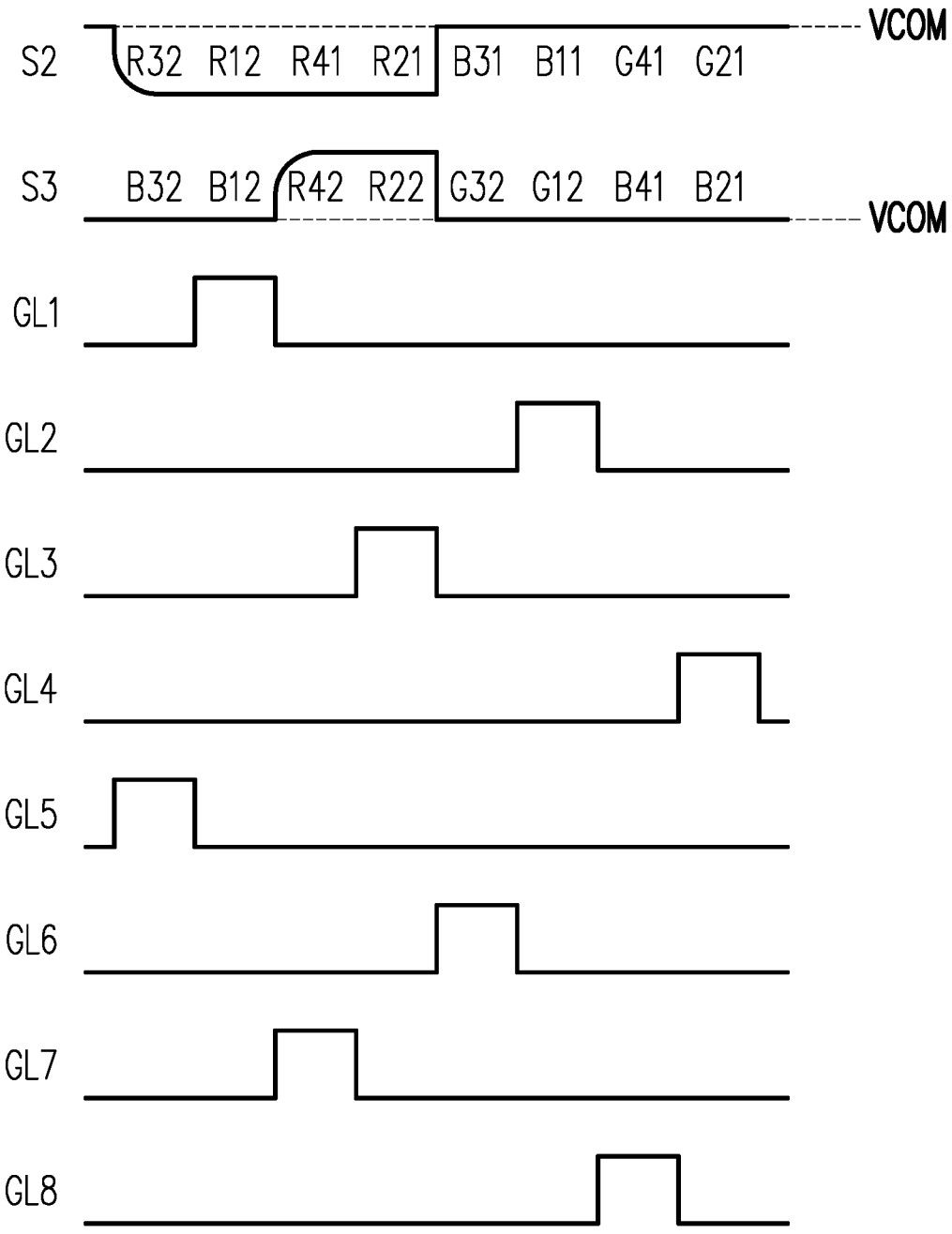
FIG. 12 is a signal timing diagram of the display panel shown in FIG. 10 according to another embodiment of the invention.

FIG. 12 is a signal timing diagram of the display panel 10 shown in FIG. 10 according to another embodiment of the invention. VCOM shown in FIG. 12 represents the common voltage of the display panel 10. In order to reduce the power consumption, the reordering circuit 121 may reorder the plurality of sub-pixel data of the input data string DS1 to generate the reordered data string DS2 so as to reduce the color switching number associated with the data line S2 (i.e., the target data line) of the display panel 10. For example, the output sequence (sub-pixel sequence) of the reordered sub string of the reordered data string DS2 is "R32, R12, R41, R21, B31, B11, G41, G21, . . . " Namely, the scanning sequence of the gate driving circuit 130 may be "GL5, GL1, GL7, GL3, GL6, GL2, GL8, GL4, . . . " Because the sub-pixel data corresponding to the same color sub-pixel are clustered together, the color switching number (i.e., the number of voltage transition times) may be effectively reduced. The reduction of the color switching number represents that the power consumption of the source driving circuit 122 may be effectively reduced.

The reordering circuit 121 may use different output sequences (sub-pixel sequences) in different frames. There are various possible implementations. For example, the reordering circuit 121 may use a scanning sequence (sub-pixel sequence) illustrated in FIG. 11 in an $(n-1)^{th}$ frame (a previous frame) and use a scanning sequence (sub-pixel sequence) illustrated in FIG. 12 in an $n^{th}$ frame (a current frame). By deducing analogously, the reordering circuit 121 may use the scanning sequence (sub-pixel sequence) illustrated in FIG. 11 in an $(n+1)^{th}$ frame (a next frame) and use the scanning sequence (sub-pixel sequence) illustrated in FIG. 12 in an $(n+2)^{th}$ frame. Namely, the change in the sub-pixel sequence between different frames is regular.

For the dual-gate panel, the reordering circuit 121 may change scanning sequences of the scan lines in different frames. Thus, the locations of the pixels that are insufficiently charged in the current frame may be different from the locations of the pixels that are insufficiently charged in the previous frame. By changing the locations of the pixels that are insufficiently charged, i.e., using a spatial and temporal averaging technique, the phenomenon of "regular dark lines" may be effectively solved. "Changing the scanning sequence (sub-pixel sequence)" may not only improve the phenomenon of "regular dark lines", but also keep an advantage of "saving power consumption" at the same time.

The implementation of "changing the scanning sequence (sub-pixel sequence)" is not limited to the description contents set forth above. The implementation of "changing the scanning sequence (sub-pixel sequence)" may be determined according to a visual effect. The change in the sub-pixel sequence between different frames is regular, and a period of the change in the sub-pixel sequence is a plurality of frames. For example, in other embodiments, the reordering circuit 121 may use the scanning sequence (sub-pixel sequence) illustrated in FIG. 12 in the $(n-1)^{th}$ frame (previous frame), use the scanning sequence (sub-pixel sequence) illustrated in FIG. 11 in the $n^{th}$ frame (current frame) and the $(n+1)^{th}$ frame (next frame) and use the scanning sequence (sub-pixel sequence) illustrated in FIG. 12 in an $(n+2)^{th}$ frame and an $(n+3)^{th}$ frame, while the rest of the frames are deduced in this way analogously.

Figure 13:
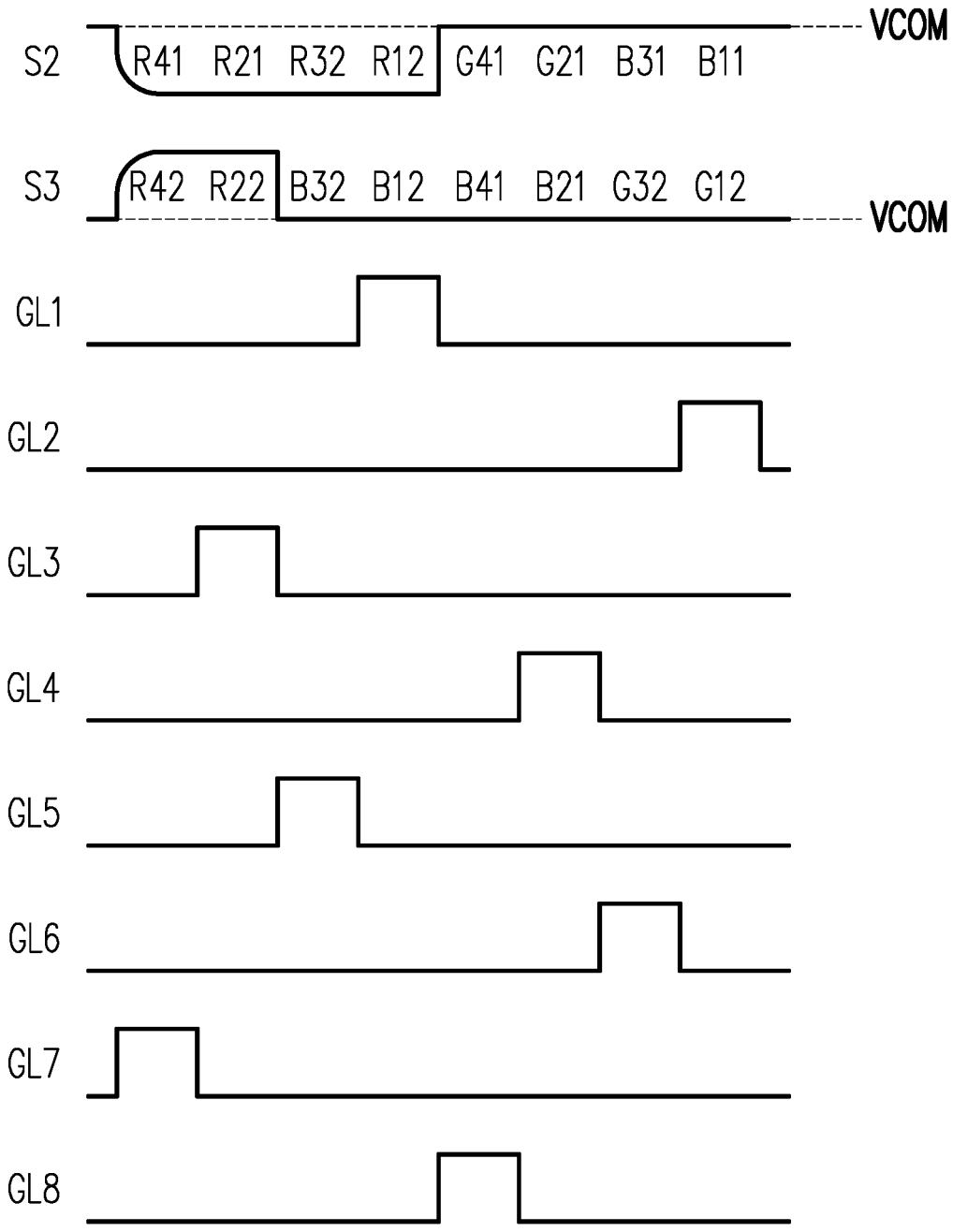
FIG. 13 is a signal timing diagram of the display panel shown in FIG. 10 according to still another embodiment of the invention.

FIG. 13 is a signal timing diagram of the display panel 10 shown in FIG. 10 according to still another embodiment of the invention. VCOM shown in FIG. 13 represents the common voltage of the display panel 10. In order to reduce the power consumption, the reordering circuit 121 may reorder the plurality of sub-pixel data of the input data string DS1 to generate the reordered data string DS2 so as to reduce the color switching number associated with the data line S2 (i.e., the target data line) of the display panel 10. For example, the output sequence (sub-pixel sequence) of the reordered sub string of the reordered data string DS2 is "R41, R21, R32, R12, G41, G21, B31, B11, . . . " Namely, the scanning sequence of the gate driving circuit 130 may be "GL7, GL3, GL5, GL1, GL8, GL4, GL6, GL2, . . . " Because the sub-pixel data corresponding to the same color sub-pixel are clustered together, the color switching number (i.e., the number of voltage transition times) may be effectively reduced. The reduction of the color switching number represents that the power consumption of the source driving circuit 122 may be effectively reduced.

The reordering circuit 121 may use different output sequences (sub-pixel sequences) in different frames. For example, in some embodiments, the reordering circuit 121 may use the scanning sequence (sub-pixel sequence) illustrated in FIG. 11 in the $(n-1)^{th}$ frame (previous frame) and use a scanning sequence (sub-pixel sequence) illustrated in FIG. 13 in the $n^{th}$ frame (current frame). By deducing analogously, the reordering circuit 121 may use the scanning sequence (sub-pixel sequence) illustrated in FIG. 11 in the $(n+1)^{th}$ frame and use the scanning sequence (sub-pixel sequence) illustrated in FIG. 13 in the $(n+2)^{th}$ frame.

The implementation of "changing the scanning sequence (sub-pixel sequence)" may be determined according to a visual effect. For example, in some other embodiments, the reordering circuit 121 may use the scanning sequence (sub-pixel sequence) illustrated in FIG. 11 in the $n^{th}$ frame and the $(n+1)^{th}$ frame and use the scanning sequence (sub-pixel sequence) illustrated in FIG. 13 in the $(n+2)^{th}$ frame and the $(n+3)^{th}$ frame, while the rest of the frames are deduced in this way analogously.

In some other embodiments, the reordering circuit 121 may use the scanning sequence (sub-pixel sequence) illustrated in FIG. 11 in the $(n-1)^{th}$ frame (previous frame), use the scanning sequence (sub-pixel sequence) illustrated in FIG. 12 in the $n^{th}$ frame (current frame) and use the scanning sequence (sub-pixel sequence) illustrated in FIG. 13 in the $(n+1)^{th}$ frame (next frame). By deducing analogously, the reordering circuit 121 may use the scanning sequence (sub-pixel sequence) illustrated in FIG. 11 in the $(n+2)^{th}$ frame, use the scanning sequence (sub-pixel sequence) illustrated in FIG. 12 in the $(n+3)^{th}$ frame and use the scanning sequence (sub-pixel sequence) illustrated in FIG. 13 in an $(n+4)^{th}$ frame.

In other embodiments, the reordering circuit 121 may use the scanning sequence (sub-pixel sequence) illustrated in FIG. 11 in the $n^{th}$ frame and the $(n+1)^{th}$ frame, use the scanning sequence (sub-pixel sequence) illustrated in FIG. 12 in the $(n+2)^{th}$ frame and the $(n+3)^{th}$ frame and use the scanning sequence (sub-pixel sequence) illustrated in FIG. 13 in the $(n+4)^{th}$ frame and an $(n+5)^{th}$ frame. The rest of the frames are deduced in this way analogously.

TABLE 1

Scanning sequence applicable to FIG. 10

| | scanning sequence |
|---|---|
| A1 | GL1→GL5→GL3→GL7→GL2→GL6→GL4→GL8 |
| B1 | GL5→GL1→GL7→GL3→GL6→GL2→GL8→GL4 |
| C1 | GL7→GL3→GL5→GL1→GL8→GL4→GL6→GL2 |
| D1 | GL1→GL5→GL7→GL3→GL2→GL6→GL8→GL4 |
| E1 | GL5→GL1→GL3→GL7→GL6→GL2→GL4→GL8 |
| F1 | GL3→GL7→GL5→GL1→GL4→GL8→GL6→GL2 |
| G1 | GL3→GL7→GL1→GL5→GL4→GL8→GL2→GL6 |
| H1 | GL7→GL3→GL1→GL5→GL8→GL4→GL2→GL6 |
| I1 | GL1→GL5→GL4→GL8→GL3→GL7→GL2→GL6 |
| J1 | GL5→GL1→GL8→GL4→GL6→GL2→GL7→GL3 |

Table 1 is an example of a row table with various scanning sequences (sub-pixel sequences) applicable to the display panel 10 illustrated in FIG. 10. The reordering circuit 121 may select one scanning sequence (sub-pixel sequence) from Table 1 sequentially, thereby reordering the input data string DS1 according to the selected scanning sequence (sub-pixel sequence). For example, the reordering circuit 121 may use a scanning sequence A1 from Table 1 in the $n^{th}$ frame, use a scanning sequence B1 from Table 1 in the $(n+1)^{th}$ frame, use a scanning sequence C1 from Table 1 in the $(n+2)^{th}$ frame and use a scanning sequence D1 from Table 1 in the $(n+3)^{th}$ frame. The rest of the frames are deduced in this way analogously.

In other embodiments, the change in the sub-pixel sequence between different frames is irregular. For example, the reordering circuit 121 may select one scanning sequence (sub-pixel sequence) from Table 1 randomly (in a pseudo random manner, in fact), thereby reordering the input data string DS1 according to the selected scanning sequence (sub-pixel sequence).

Figure 14:
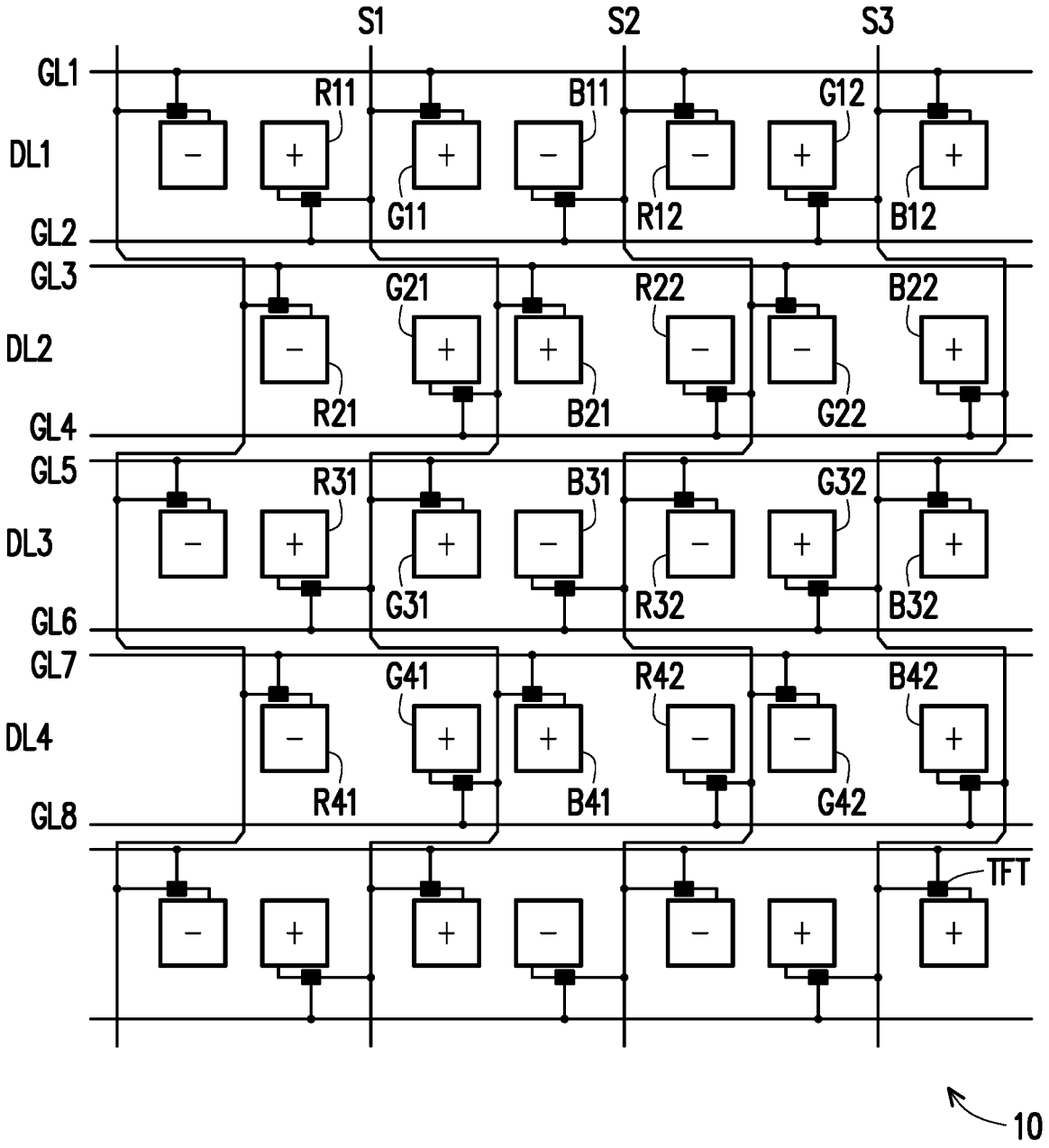
FIG. 14 is a schematic layout diagram of the display panel depicted in FIG. 1 according to still another embodiment of the invention.

FIG. 14 is a schematic layout diagram of the display panel 10 depicted in FIG. 1 according to still another embodiment of the invention. In the embodiment illustrated in FIG. 14, the display panel 10 is a zigzag dual-gate display panel. The display panel 10 can include a plurality of data lines (e.g., S1 to S3), a plurality of scan lines (e.g., GL1 to GL8) and a plurality of sub-pixels connected to the data lines and the scan lines. The source driving circuit 122 can output the sub-pixel voltage string Vd to drive the data lines of the display panel 10. The gate driving circuit 130 can scan (drive) the scan lines of the display panel 10. The sub-pixels of the display panel 10 can include red sub-pixels (e.g., R11 to R12, R21 to R22, R31 to R32 and R41 to R42), green sub-pixels (e.g., G11 to G12, G21 to G22, G31 to G32 and G41 to G42) and blue sub-pixels (e.g., B11 to B12, B21 to B22, B31 to B32 and B41 to B42). A target data line of the data lines is connected to different colors of the sub-pixels. In addition, the sub-pixels can be arranged as a plurality of display lines, for example, DL1-DL4 along an extension direction of the scan lines. The sub-pixels connected to a target data line of the data lines S1-S3 can have a same color every N display line(s), wherein N is a positive integer. In the embodiment, N can be 2. Each of the black solid squares shown in FIG. 14 represents a switch TFT.

More specifically, the red sub pixel R11, the green sub pixel G11, the blue sub pixel B11, the red sub pixel R12, the green sub pixel G12 and the blue sub pixel B12 are arranged on a display line (display row) DLL The red sub pixel R21, the green sub pixel G21, the blue sub pixel B21, the red sub pixel R22, the green sub pixel G22 and the blue sub pixel B22 are arranged on a display line DL2. The red sub pixel R31, the green sub pixel G31, the blue sub pixel B31, the red sub pixel R32, the green sub pixel G32 and the blue sub pixel B32 are arranged on a display line DL3. The red sub pixel R41, the green sub pixel G41, the blue sub pixel B41, the red sub pixel R42, the green sub pixel G42 and the blue sub pixel B42 are arranged on a display line DL4.

Figure 15:
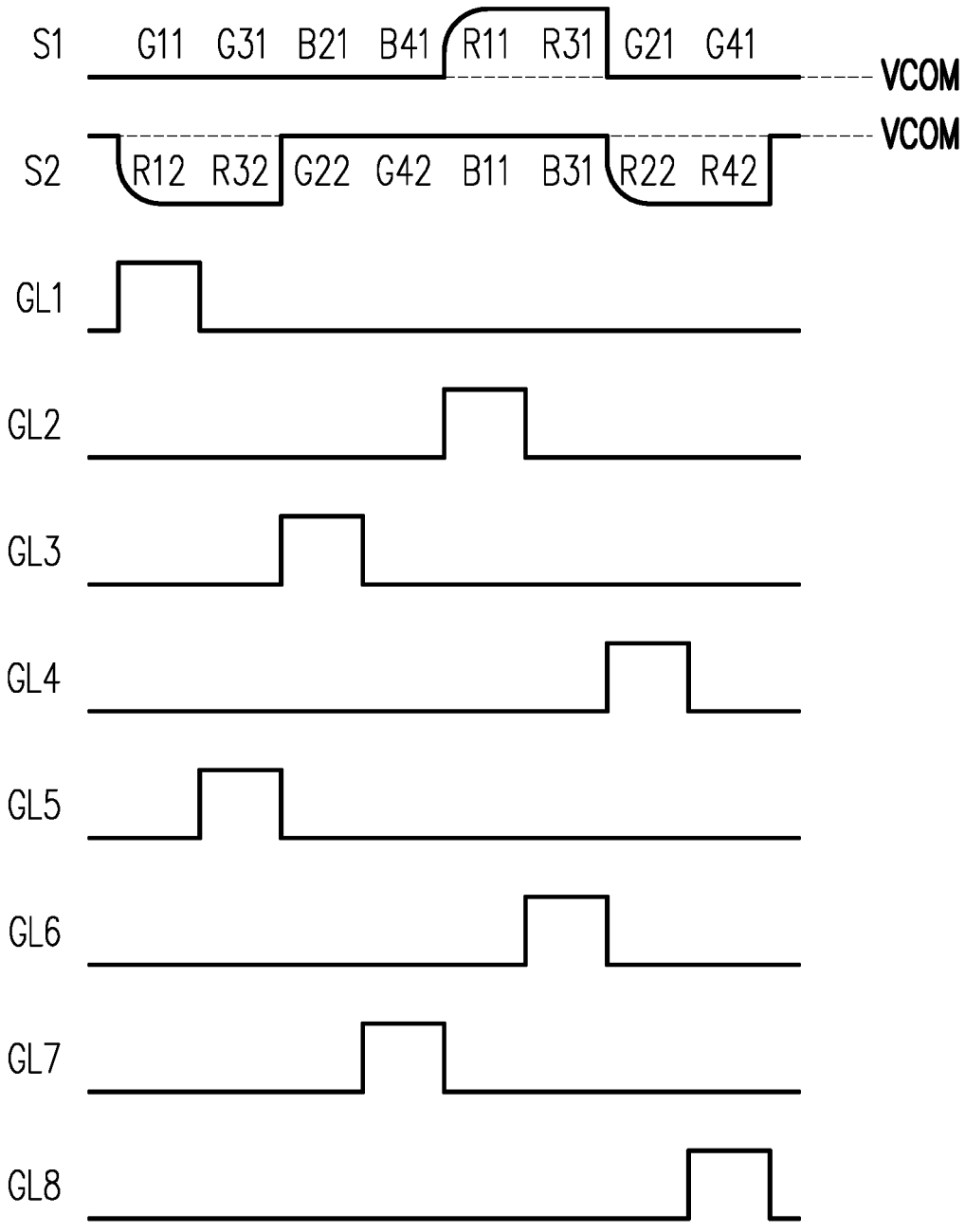
FIG. 15 is a signal timing diagram of the display panel shown in FIG. 14 according to an embodiment of the invention.

FIG. 15 is a signal timing diagram of the display panel 10 shown in FIG. 14 according to an embodiment of the invention. VCOM shown in FIG. 15 represents the common voltage of the display panel 10. The output sequence (sub-pixel sequence) of the sub-pixel voltage string Vd of the data line S2 (referred to as the target data line) is taken as an example for description below, and other data lines may be analogously inferred with reference to the description related to the data line S2 and will not be repeatedly described.

For the data line S2, the output sequence (sub-pixel sequence) of the input data string DS1 is "R12, B11, G22, R22, R32, B31, G42, R42, . . . " In order to reduce the power consumption, the reordering circuit 121 may reorder the plurality of sub-pixel data of the input data string DS1 to generate the reordered data string DS2 so as to reduce the color switching number associated with the data line S2 (i.e., the target data line) of the display panel 10. For example, the output sequence (sub-pixel sequence) of the reordered sub string of the reordered data string DS2 is "R12, R32, G22, G42, B11, B31, R22, R42, . . . " Correspondingly, the scanning sequence of the gate driving circuit 130 may be "GL1, GL5, GL3, GL7, GL2, GL6, GL4, GL8, . . . , and etc." In other words, a first group of sub-pixels having a first same color (e.g., red) and a second group of sub-pixels having a second same color (e.g., blue) can be scanned sequentially. The first group of pixels comprise R12 and R32 scanned sequentially, and the second group of pixels comprise G22 and G42 scanned sequentially after the first group of the sub-pixels are scanned. The first group of the sub-pixels comprise the a first sub-pixel arranged on an $i^{th}$ display line and a second sub-pixel arranged on an $j^{th}$ display line scanned sequentially in time sequence, wherein i and j are integers, and j=i+p1*N, wherein i, j and p1 are positive integers and N=2 for the display panel of FIG. 14. Similarly, the first group of the sub-pixels comprise the a first sub-pixel arranged on an $i^{th}$ display line and a second sub-pixel arranged on an $k^{th}$ display line scanned sequentially in time sequence, wherein i and j are integers, and k=i+p2*N, wherein k and p2 are positive integers.

Because the sub-pixel data corresponding to the same color sub-pixel are clustered together, the color switching number (i.e., the number of voltage transition times) may be effectively reduced. The reduction of the color switching number represents that the power consumption of the source driving circuit 122 may be effectively reduced. For example, when the input data string DS1 is the pattern in all the same color (e.g., red), because the sub-pixel data corresponding to the red sub-pixels are clustered together, the color switching number (i.e., the number of voltage transition times) associated with the data line S2 may be effectively reduced.

The scanning operation shown in FIG. 15 can be referred to as being performed in a manner of "jumping-across at least one display line". A first group of the red sub-pixels can comprise a first sub-pixel R12 arranged on the first display line DL1 and a second sub-pixel R32 arranged on the third display line DL3 scanned sequentially in time sequence. The display line DL3 is not the display line DL2 adjacent to the display line DL1. The number of jumped display line(s) (DL2) is (3−1)−1=1, which can be equal to an integer multiple (denoted as a positive integer "p1") of N (where N=2 for the display panel of FIG. 7) subtracted by 1. In other words, the number of the jumped display line(s)=p1*N−1 (1=1*2−1 in this case).

Similarly, after the first group of the red sub-pixels R12 and R32 are scanned in the manner of "jumping-across at least one display line," a second group of the green sub-pixels G22, G42 can be scanned in the manner of "jumping-across at least one display line For example, a first sub-pixel G22 is arranged on the second display line DL2 and a second sub-pixel G42 is arranged on the third display line DL4 are scanned sequentially in time sequence. The number of jumped display line(s) (DL3) is (4−2)−1=1, which can be equal to an integer multiple (denoted as a positive integer "p2") of N (where N=2 for the display panel of FIG. 7) subtracted by 1. In other words, the number of the jumped display line(s)=p2*N−1 (1=1*2−1 in this case).

It is noted that the scanning operation shown in FIG. 11 can be also referred to as being performed in a "forth-and-back manner" without first completing scanning all of the sub-pixels R12 and B11 connected to the target data line S2 and arranged on a same display line, e.g., DL1. A first group of the sub-pixels having a first color (e.g., red) can comprise a first sub-pixel R12 and at least one second sub-pixel R32 and a second group of the sub-pixels having a second color (e.g., green) can comprise sub-pixels G22 and G42, and a third group of the sub pixels can comprise a third sub-pixel B11 scanned sequentially in time sequence. The first sub-pixel R12 is arranged on the first display line DL1, the at least one second sub-pixel R32 is arranged on at least one display line DL3 other than the first display line DL1, the sub-pixels G22 and G42 are arranged on the display lines GL2 and G14, and the third sub-pixel B11 is arranged on the first display line DL1. In other words, without first complete the scanning for all of the sub-pixels R12 and B11 on the first display line DL1, the scanning operation is performed from the first display line DL1, sequentially through the display lines DL3, DL2, DL4, and then back to the first display line DL1.

Figure 16:
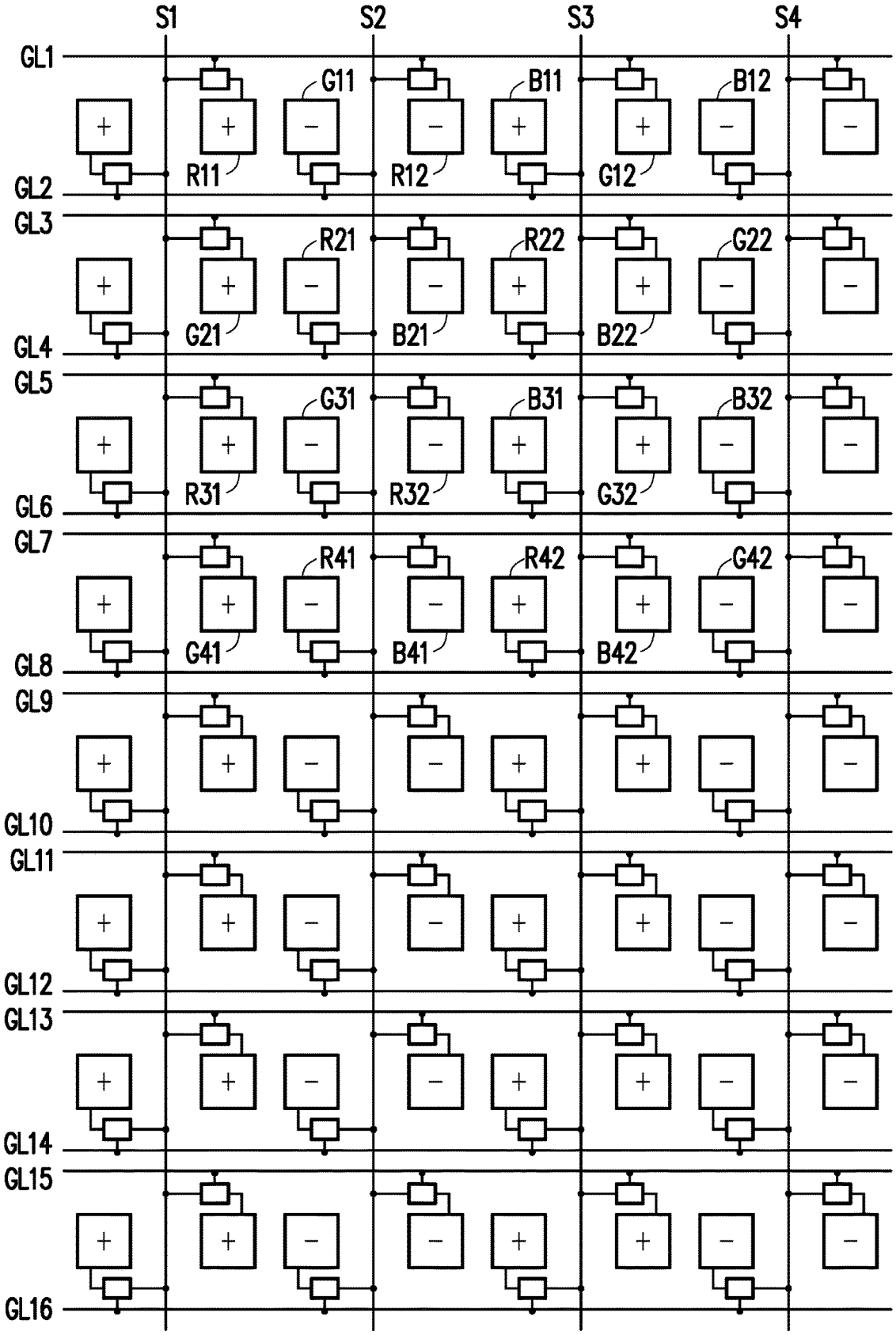
FIG. 16 is a schematic layout diagram of the display panel depicted in FIG. 1 according to still another embodiment of the invention.

FIG. 16 is a schematic layout diagram of the display panel 10 depicted in FIG. 1 according to still another embodiment of the invention. In the embodiment illustrated in FIG. 16, the display panel 10 may be a dual-gate panel. The display panel 10 includes data lines (e.g., S1 to S4) and scan lines (e.g., GL1 to GL16). The source driving circuit 122 can output the sub-pixel voltage string Vd to the data lines of the display panel 10. The gate driving circuit 130 can scan (drive) the scan lines of the display panel 10. The display panel 10 further includes red sub-pixels (e.g., R11, R12, R21, R22, R31, R32, R41 and R42), green sub-pixels (e.g., G11, G12, G21, G22, G31, G32, G41 and G42) and blue sub-pixels (e.g., B11, B12, B21, B22, B31, B32, B41 and B42).

Figure 17:
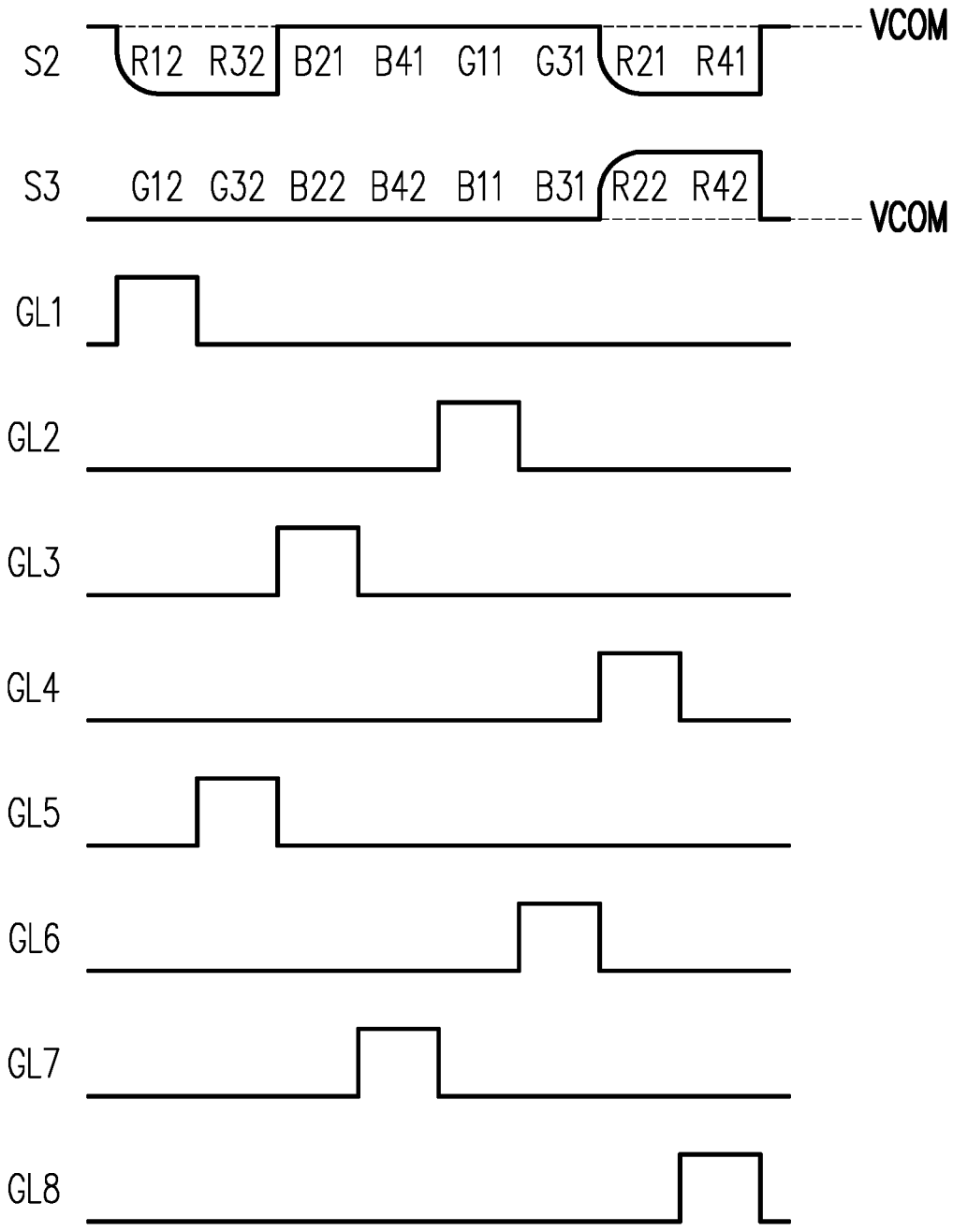
FIG. 17 is a signal timing diagram of the display panel shown in FIG. 16 according to an embodiment of the invention.

FIG. 17 is a signal timing diagram of the display panel 10 shown in FIG. 16 according to an embodiment of the invention. VCOM shown in FIG. 17 represents the common voltage of the display panel 10. The output sequence (sub-pixel sequence) of the sub-pixel voltage string Vd of the data line S3 is taken as an example for description below, and other data lines may be analogously inferred with reference to the description related to the data line S3 and will not be repeatedly described. For the data line S3, the output sequence (sub-pixel sequence) of the input data string DS1 is "G12, B11, B22, R22, G32, B31, B42, R42, . . . " In order to reduce the power consumption, the reordering circuit 121 may reorder the plurality of sub-pixel data of the input data string DS1 to generate the reordered data string DS2 so as to reduce the color switching number associated with the data line S3 (i.e., the target data line) of the display panel 10. For example, the output sequence (sub-pixel sequence) of the reordered sub string of the reordered data string DS2 is "G12, G32, B22, B42, B11, B31, R22, R42, . . . " Namely, the scanning sequence of the gate driving circuit 130 may be "GL1, GL5, GL3, GL7, GL2, GL6, GL4, GL8, . . . " Because the sub-pixel data corresponding to the same color sub-pixel are clustered together, the color switching number (i.e., the number of voltage transition times) may be effectively reduced. The reduction of the color switching number represents that the power consumption of the source driving circuit 122 may be effectively reduced.

Figure 18:
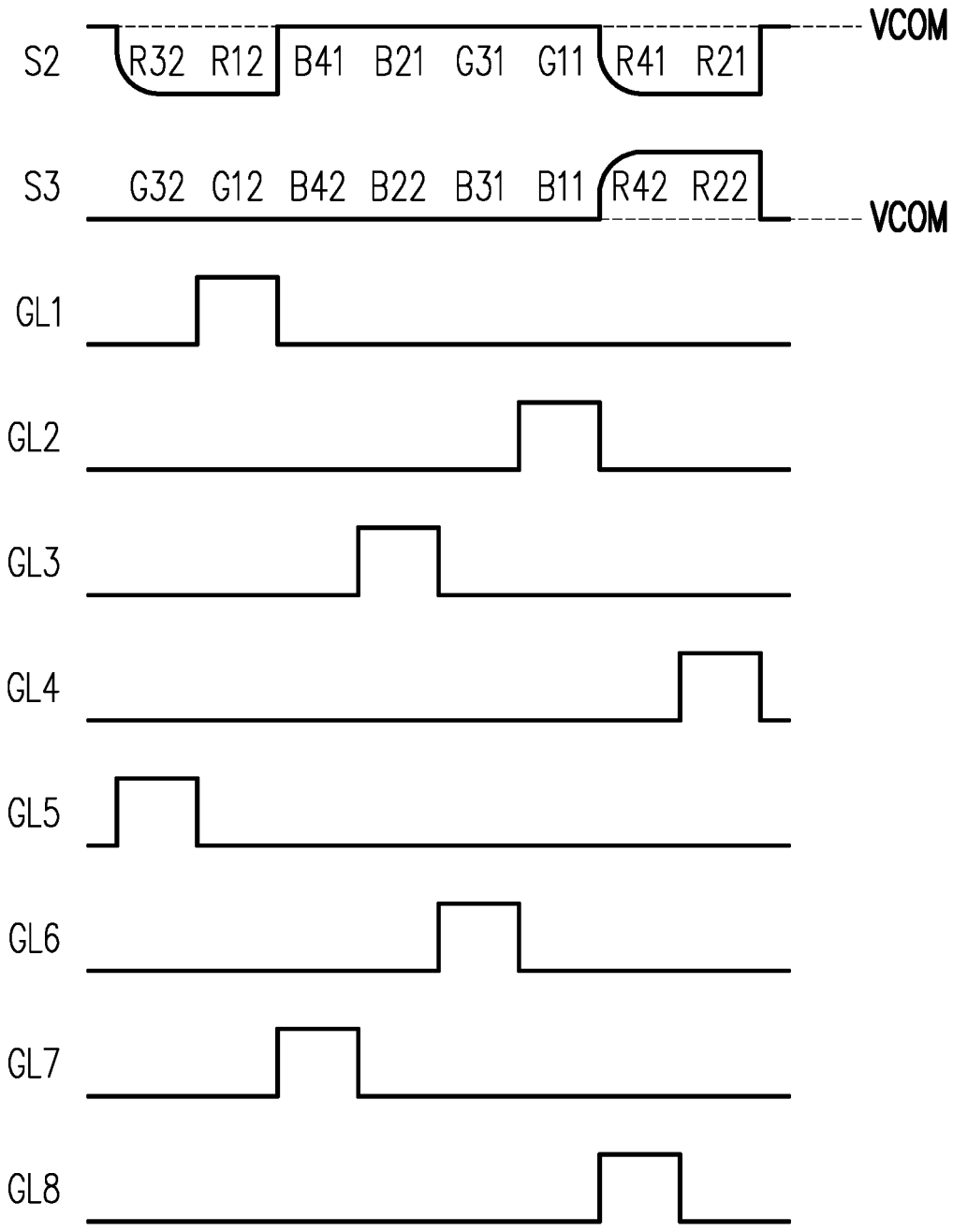
FIG. 18 is a signal timing diagram of the display panel shown in FIG. 16 according to another embodiment of the invention.

FIG. 18 is a signal timing diagram of the display panel 10 shown in FIG. 16 according to another embodiment of the invention. VCOM shown in FIG. 18 represents the common voltage of the display panel 10. In order to reduce the power consumption, the reordering circuit 121 may reorder the plurality of sub-pixel data of the input data string DS1 to generate the reordered data string DS2 so as to reduce the color switching number associated with the data line S1 (i.e., the target data line) of the display panel 10. For example, the output sequence (sub-pixel sequence) of the reordered sub string of the reordered data string DS2 is "G32, G12, B42, B22, B31, B11, R42, R22, . . . " Namely, the scanning sequence of the gate driving circuit 130 may be "GL5, GL1, GL7, GL3, GL6, GL2, GL8, GL4, . . . " Because the sub-pixel data corresponding to the same color sub-pixel are clustered together, the color switching number (i.e., the number of voltage transition times) may be effectively reduced. The reduction of the color switching number represents that the power consumption of the source driving circuit 122 may be effectively reduced.

The reordering circuit 121 may use different output sequences (sub-pixel sequences) in different frames. For example, the reordering circuit 121 may use a scanning sequence (sub-pixel sequence) illustrated in FIG. 17 in the $(n-1)^{th}$ frame (previous frame) and use a scanning sequence (sub-pixel sequence) illustrated in FIG. 18 in the $n^{th}$ frame (current frame). By deducing analogously, the reordering circuit 121 may use the scanning sequence (sub-pixel sequence) illustrated in FIG. 17 in the $(n+1)^{th}$ frame and use the scanning sequence (sub-pixel sequence) illustrated in FIG. 18 in the $(n+2)^{th}$ frame.

For the dual-gate panel, the reordering circuit 121 may change the scanning sequences of the scan lines in different frames. Thus, the locations of the pixels that are insufficiently charged in the current frame may be different from the locations of the pixels that are insufficiently charged in the previous frame. By changing the locations of the pixels that are insufficiently charged, i.e., using the spatial and temporal averaging technique, the phenomenon of "regular dark lines" may be effectively solved. "Changing the scanning sequence (sub-pixel sequence)" may not only improve the phenomenon of "regular dark lines", but also keep the advantage of "saving power consumption" at the same time.

The implementation of "changing the scanning sequence (sub-pixel sequence)" is not limited to the description contents set forth above. The implementation of "changing the scanning sequence (sub-pixel sequence)" may be determined according to a visual effect. For example, in other embodiments, the reordering circuit 121 may use the scanning sequence (sub-pixel sequence) illustrated in FIG. 17 in the $n^{th}$ frame and the $(n+1)^{th}$ frame and use the scanning sequence (sub-pixel sequence) illustrated in FIG. 18 in the $(n+2)^{th}$ frame and the $(n+3)^{th}$ frame, while the rest of the frames are deduced in this way analogously.

TABLE 2

Scanning sequence applicable to FIG. 16

| | scanning sequence |
|---|---|
| A2 | GL1→GL5→GL3→GL7→GL2→GL6→GL4→GL8 |
| B2 | GL5→GL1→GL7→GL3→GL6→GL2→GL8→GL4 |
| C2 | GL1→GL5→GL2→GL6→GL3→GL7→GL4→GL8 |
| D2 | GL1→GL5→GL6→GL2→GL3→GL7→GL8→GL4 |
| E2 | GL3→GL7→GL1→GL5→GL4→GL8→GL2→GL6 |
| F2 | GL7→GL3→GL5→GL1→GL8→GL4→GL6→GL2 |
| G2 | GL2→GL6→GL4→GL8→GL1→GL5→GL3→GL7 |
| H2 | GL6→GL2→GL8→GL4→GL5→GL1→GL7→GL3 |

Table 2 is an example of a row table with various scanning sequences (sub-pixel sequences) applicable to the display panel 10 illustrated in FIG. 16. The reordering circuit 121 may select one scanning sequence (sub-pixel sequence) from Table 2 sequentially (or randomly), thereby reordering the input data string DS1 according to the selected scanning sequence (sub-pixel sequence). For example, the reordering circuit 121 may use a scanning sequence A2 from Table 2 in the $n^{th}$ frame, use a scanning sequence B2 from Table 2 in the $(n+1)^{th}$ frame, use a scanning sequence C2 from Table 2 in the $(n+2)^{th}$ frame and use a scanning sequence D2 from Table 2 in the $(n+3)^{th}$ frame. The rest of the frames are deduced in this way analogously.

Figure 19:
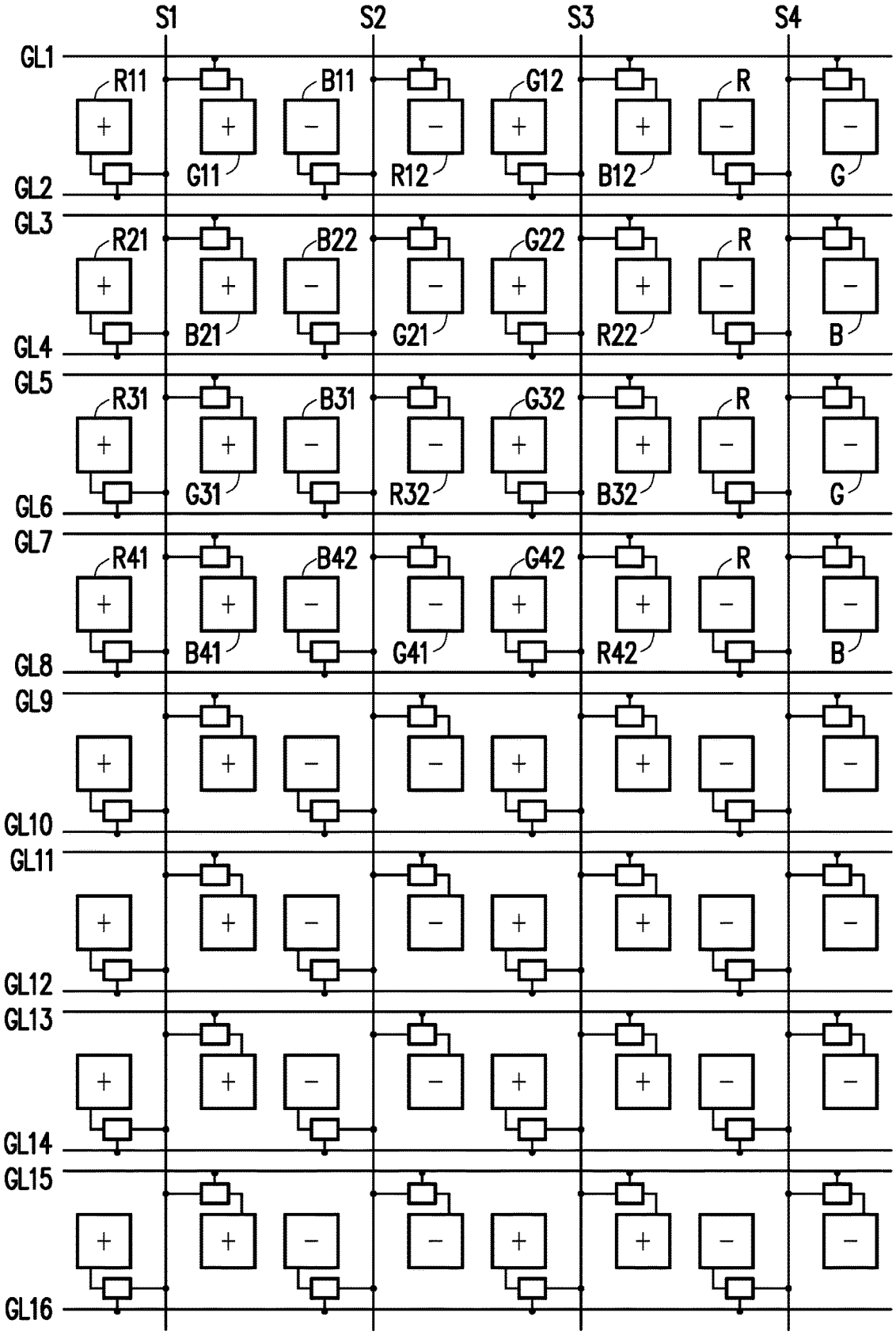
FIG. 19 is a schematic layout diagram of the display panel depicted in FIG. 1 according to still another embodiment of the invention.

FIG. 19 is a schematic layout diagram of the display panel 10 depicted in FIG. 1 according to still another embodiment of the invention. In the embodiment illustrated in FIG. 19, the display panel 10 may be a dual-gate panel. The display panel 10 includes data lines (e.g., S1 to S4) and scan lines (e.g., GL1 to GL16). The source driving circuit 122 can output the sub-pixel voltage string Vd to the data lines of the display panel 10. The gate driving circuit 130 can scan (drive) the scan lines of the display panel 10. The display panel 10 further includes red sub-pixels (e.g., R11, R12, R21, R22, R31, R32, R41 and R42), green sub-pixels (e.g., G11, G12, G21, G22, G31, G32, G41 and G42) and blue sub-pixels (e.g., B11, B12, B21, B22, B31, B32, B41 and B42).

Figure 20:
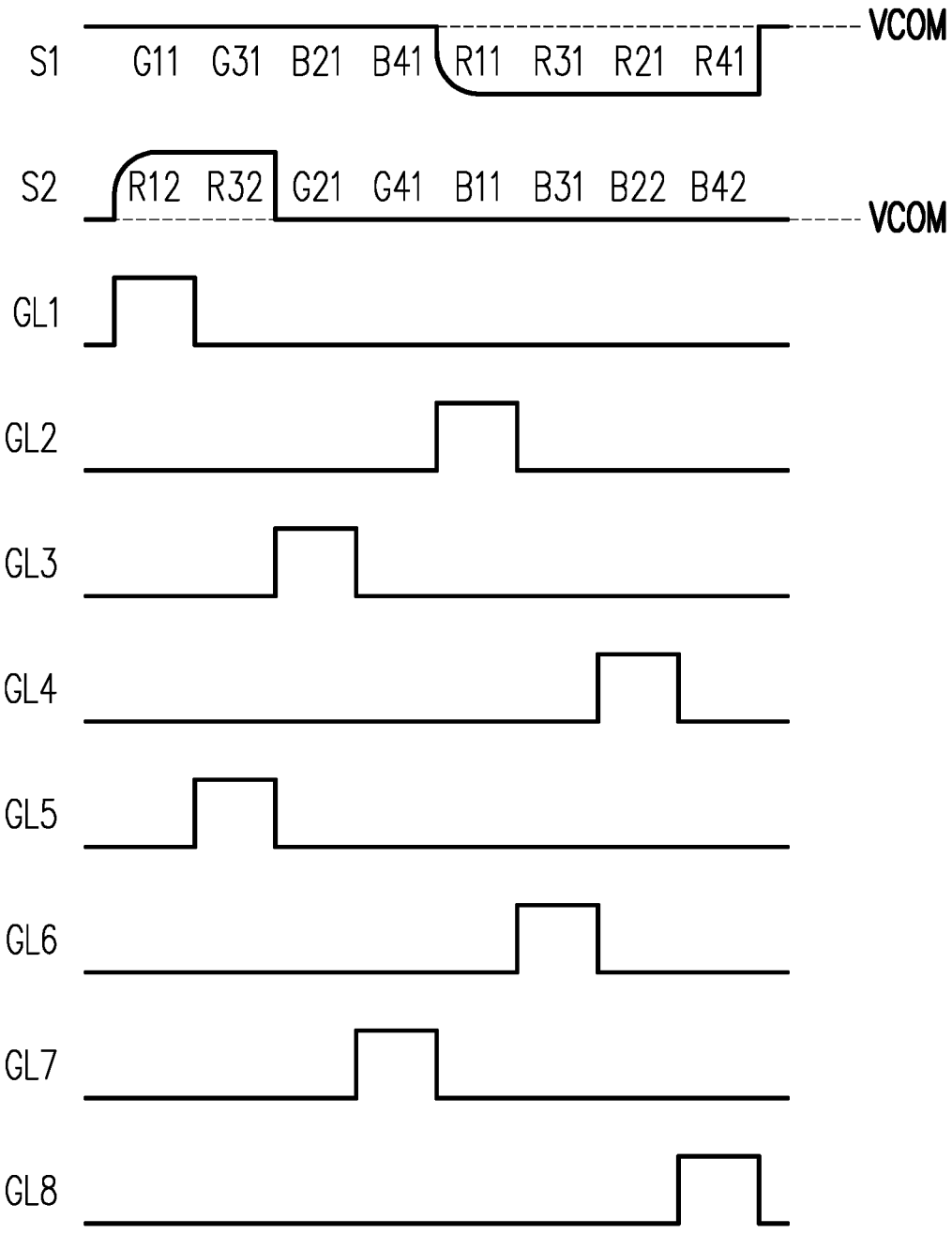
FIG. 20 is a signal timing diagram of the display panel shown in FIG. 19 according to an embodiment of the invention.

FIG. 20 is a signal timing diagram of the display panel 10 shown in FIG. 19 according to an embodiment of the invention. VCOM shown in FIG. 20 represents the common voltage of the display panel 10. The output sequence (sub-pixel sequence) of the sub-pixel voltage string Vd of the data line S1 is taken as an example for description below, and other data lines may be analogously inferred with reference to the description related to the data line S1 and will not be repeatedly described. For the data line S1, the output sequence (sub-pixel sequence) of the input data string DS1 is "G11, R11, B21, R21, G31, R31, B41, R41, . . . " In order to reduce the power consumption, the reordering circuit 121 may reorder the plurality of sub-pixel data of the input data string DS1 to generate the reordered data string DS2 so as to reduce the color switching number associated with the data line S1 (i.e., the target data line) of the display panel 10. For example, the output sequence (sub-pixel sequence) of the reordered sub string of the reordered data string DS2 is "G11, G31, B21, B41, R11, R31, R21, R41, . . . " Namely, the scanning sequence of the gate driving circuit 130 may be "GL1, GL5, GL3, GL7, GL2, GL6, GL4, GL8, . . . " Because the sub-pixel data corresponding to the same color sub-pixel are clustered together, the color switching number (i.e., the number of voltage transition times) may be effectively reduced. The reduction of the color switching number represents that the power consumption of the source driving circuit 122 may be effectively reduced.

Figure 21:
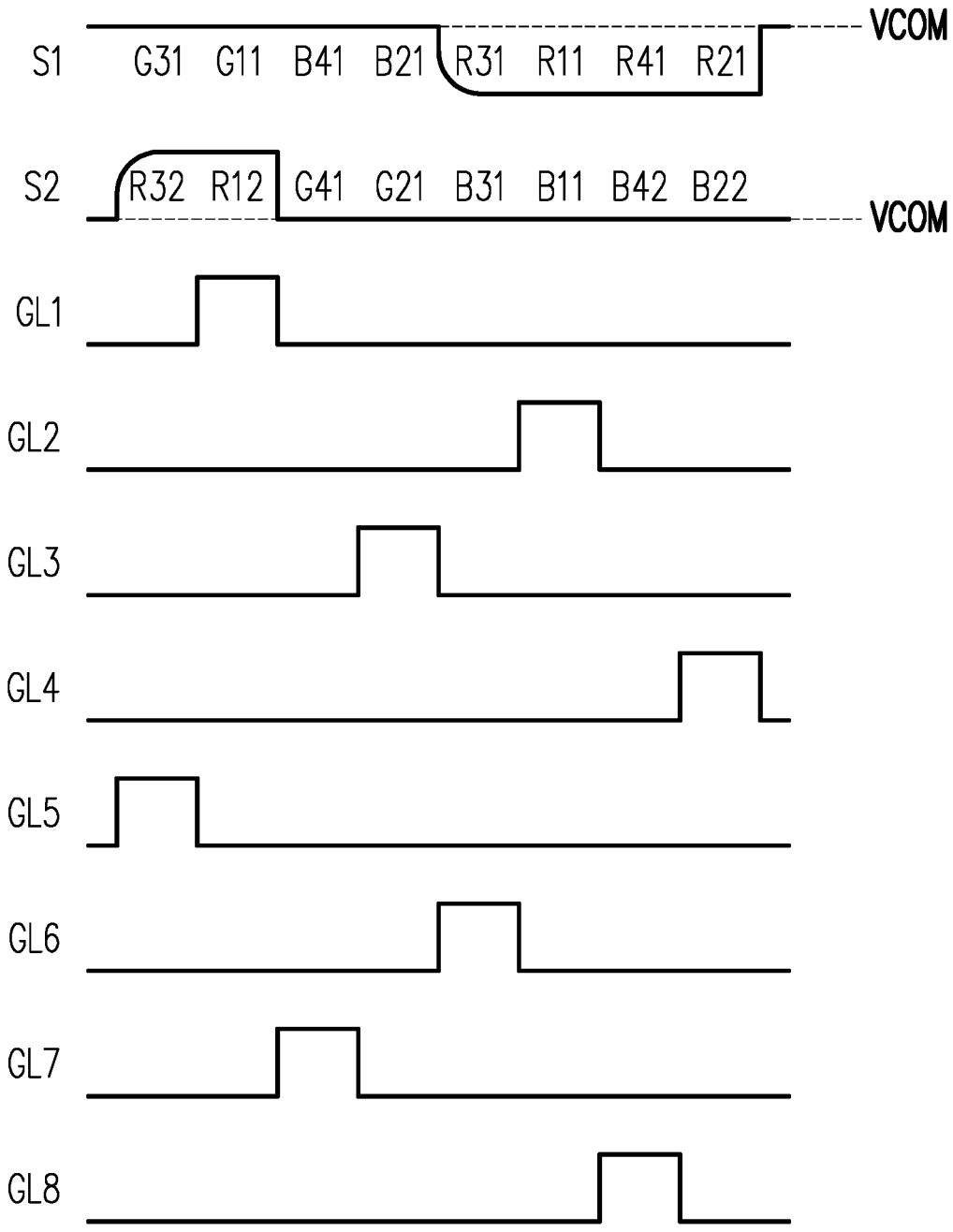
FIG. 21 is a signal timing diagram of the display panel shown in FIG. 19 according to another embodiment of the invention.

FIG. 21 is a signal timing diagram of the display panel 10 shown in FIG. 19 according to another embodiment of the invention. VCOM shown in FIG. 21 represents the common voltage of the display panel 10. In order to reduce the power consumption, the reordering circuit 121 may reorder the plurality of sub-pixel data of the input data string DS1 to generate the reordered data string DS2 so as to reduce the color switching number associated with the data line S1 (i.e., the target data line) of the display panel 10. For example, the output sequence (sub-pixel sequence) of the reordered sub string of the reordered data string DS2 is "G31, G11, B41, B21, R31, R11, R41, R21, . . . " Namely, the scanning sequence of the gate driving circuit 130 may be "GL5, GL1, GL7, GL3, GL6, GL2, GL8, GL4, . . . " Because the sub-pixel data corresponding to the same color sub-pixel are clustered together, the color switching number (i.e., the number of voltage transition times) may be effectively reduced. The reduction of the color switching number represents that the power consumption of the source driving circuit 122 may be effectively reduced.

The reordering circuit 121 may use different output sequences (sub-pixel sequences) in different frames. For example, the reordering circuit 121 may use a scanning sequence (sub-pixel sequence) illustrated in FIG. 20 in the $(n-1)^{th}$ frame (previous frame) and use a scanning sequence (sub-pixel sequence) illustrated in FIG. 21 in the $n^{th}$ frame (current frame). By deducing analogously, the reordering circuit 121 may use the scanning sequence (sub-pixel sequence) illustrated in FIG. 20 in the $(n+1)^{th}$ frame and use the scanning sequence (sub-pixel sequence) illustrated in FIG. 21 in the $(n+2)^{th}$ frame.

For the dual-gate panel, the reordering circuit 121 may change the scanning sequences of the scan lines in different frames. Thus, the locations of the pixels that are insufficiently charged in the current frame may be different from the locations of the pixels that are insufficiently charged in the previous frame. By changing the locations of the pixels that are insufficiently charged, i.e., using the spatial and temporal averaging technique, the phenomenon of "regular dark lines" may be effectively solved. "Changing the scanning sequence (sub-pixel sequence)" may not only improve the phenomenon of "regular dark lines", but also keep the advantage of "saving power consumption" at the same time.

The implementation of "changing the scanning sequence (sub-pixel sequence)" is not limited to the description contents set forth above. The implementation of "changing the scanning sequence (sub-pixel sequence)" may be determined according to a visual effect. For example, in other embodiments, the reordering circuit 121 may use the scanning sequence (sub-pixel sequence) illustrated in FIG. 20 in the $n^{th}$ frame and the $(n+1)^{th}$ frame and use the scanning sequence (sub-pixel sequence) illustrated in FIG. 21 in the $(n+2)^{th}$ frame and the $(n+3)^{th}$ frame, while the rest of the frames are deduced in this way analogously.

TABLE 3

| Scanning sequence applicable to FIG. 19 | |
|---|---|
| | scanning sequence |
| A3 | GL1→GL5→GL3→GL7→GL2→GL6→GL4→GL8 |
| B3 | GL5→GL1→GL7→GL3→GL6→GL2→GL8→GL4 |
| C3 | GL3→GL7→GL1→GL5→GL4→GL8→GL2→GL6 |
| D3 | GL7→GL3→GL5→GL1→GL8→GL4→GL6→GL2 |
| E3 | GL2→GL6→GL4→GL8→GL1→GL5→GL3→GL7 |
| F3 | GL6→GL2→GL8→GL4→GL5→GL1→GL7→GL3 |
| G3 | GL4→GL8→GL2→GL6→GL3→GL7→GL1→GL5 |
| H3 | GL8→GL4→GL6→GL2→GL7→GL3→GL5→GL1 |

Table 3 is an example of a row table with various scanning sequences (sub-pixel sequences) applicable to the display panel 10 illustrated in FIG. 19. The reordering circuit 121 may select one scanning sequence (sub-pixel sequence) from Table 3 sequentially (or randomly), thereby reordering the input data string DS1 according to the selected scanning sequence (sub-pixel sequence). For example, the reordering circuit 121 may use a scanning sequence A3 from Table 3 in the $n^{th}$ frame, use a scanning sequence B3 from Table 3 in the $(n+1)^{th}$ frame, use a scanning sequence C3 from Table 3 in the $(n+2)^{th}$ frame and use a scanning sequence D3 in the $(n+3)^{th}$ frame. The rest of the frames are deduced in this way analogously.

Figure 22:
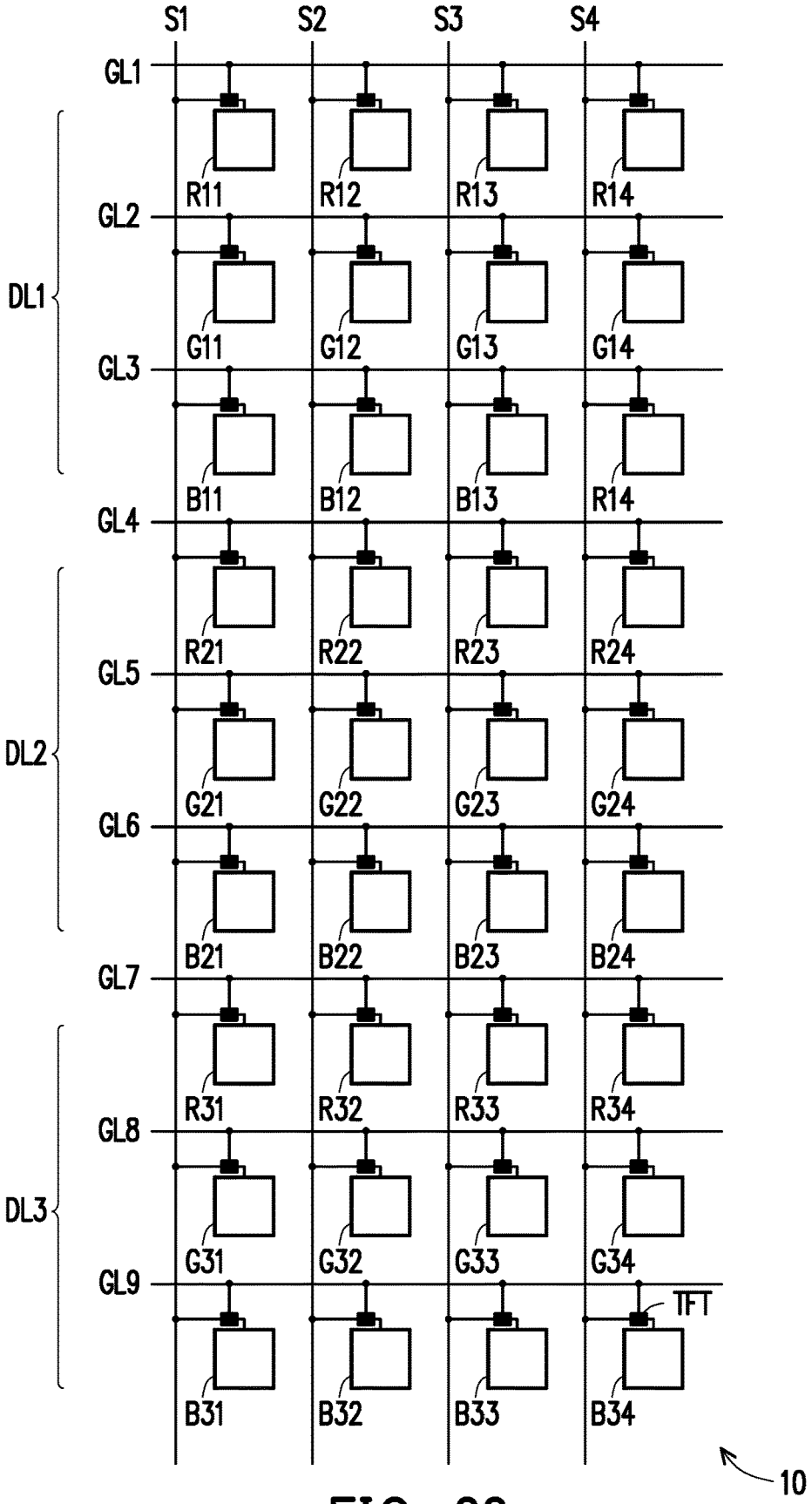
FIG. 22 is a schematic layout diagram of the display panel depicted in FIG. 1 according to another embodiment of the invention.

FIG. 22 is a schematic layout diagram of the display panel 10 depicted in FIG. 1 according to another embodiment of the invention. In the embodiment illustrated in FIG. 22, the display panel 10 can be a non-dual-gate display panel. The display panel 10 can include a plurality of data lines (e.g., S1 to S4), a plurality of scan lines (e.g., GL1 to GL9), and a plurality of sub-pixels connected to the data lines and the scan lines. The source driving circuit 122 can output the sub-pixel voltage string Vd to drive the data lines of the display panel 10. The gate driving circuit 130 can scan (drive) the scan lines of the display panel 10. The sub-pixels of the display panel 10 can include red sub-pixels (e.g., R11 to R14, R21 to R24, and R31 to R34), green sub-pixels (e.g., G11 to G14, G21 to G24, and G31 to G34) and blue sub-pixels (e.g., B11 to B14, B21 to B24, and B31 to B34). A target data line of the data lines can be connected to different colors of the sub-pixels. In addition, the sub-pixels can be arranged as a plurality of display lines, for example, DL1-DL3 along an extension direction of the scan lines GL1 to GL9. The sub-pixels arranged on a same display line may have a same color. The sub-pixels connected to the target data line of the data lines S1-S4 can have a same color every N display line(s), wherein N is a positive integer. In the embodiment, N can be 3. Each of the black solid squares shown in FIG. 22 represents a switch TFT.

More specifically, the red sub pixel R11, the red sub pixel R12, the red sub pixel R13, the red sub pixel R14, the green sub pixel G11, the green sub pixel G12, the green sub pixel G13, the green sub pixel G14, the blue sub pixel B11, the blue sub pixel B12, the blue sub pixel B13 and the blue sub pixel B14 are arranged on a display line DLL The red sub pixel R21, the red sub pixel R22, the red sub pixel R23, the red sub pixel R24, the green sub pixel G21, the green sub pixel G22, the green sub pixel G23, the green sub pixel G24, the blue sub pixel B21, the blue sub pixel B22, the blue sub pixel B23 and the blue sub pixel B24 are arranged on a display line DL2. The red sub pixel R31, the red sub pixel R32, the red sub pixel R33, the red sub pixel R34, the green sub pixel G31, the green sub pixel G32, the green sub pixel G33, the green sub pixel G34, the blue sub pixel B31, the blue sub pixel B32, the blue sub pixel B33 and the blue sub pixel B34 are arranged on a display line DL3.

Figure 23:
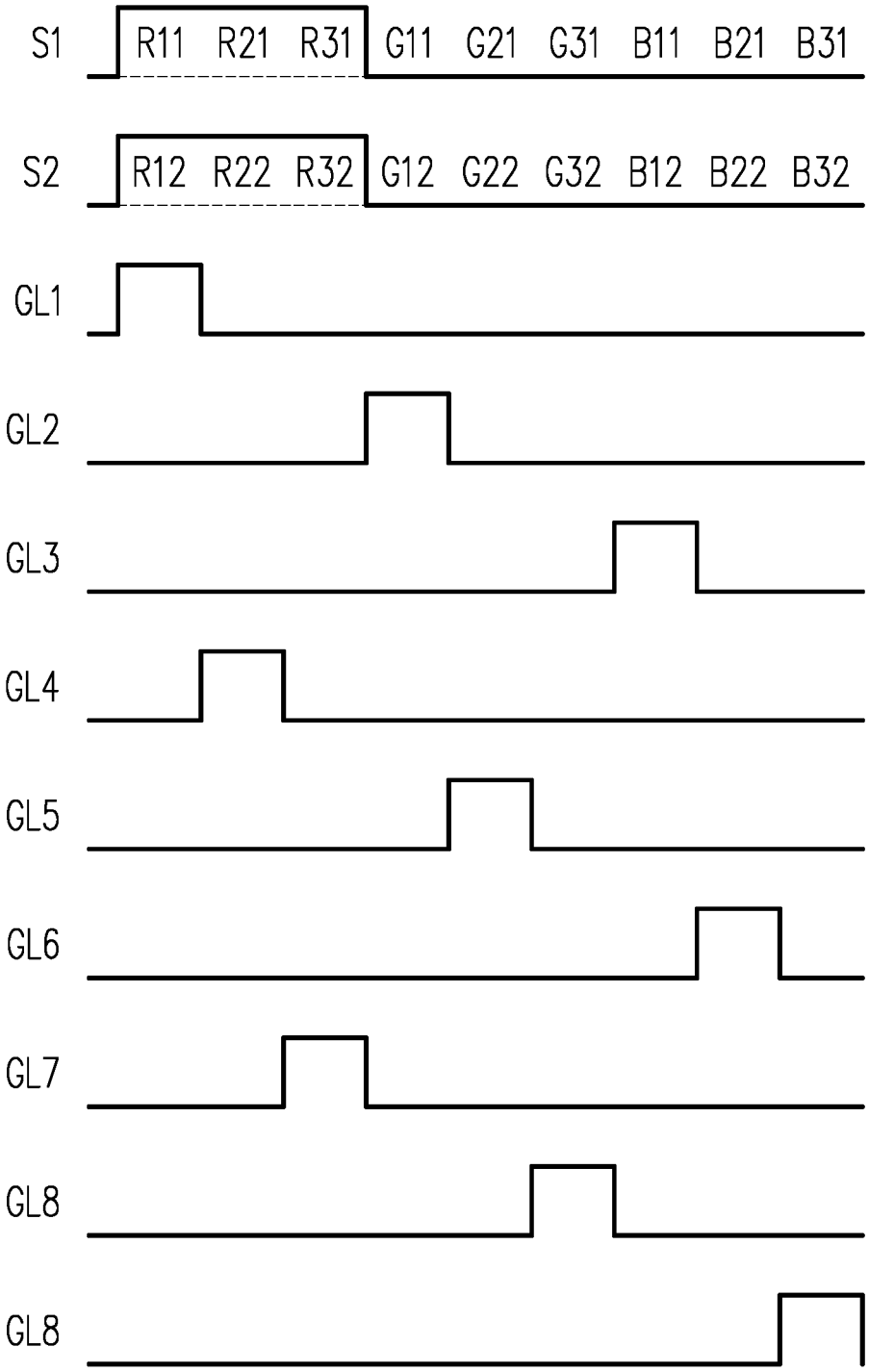
FIG. 23 is a signal timing diagram of the display panel shown in FIG. 22 according to another embodiment of the invention.

FIG. 23 is a signal timing diagram of the display panel 10 shown in FIG. 22 according to another embodiment of the invention. In the example implementation, the output sequence of the reordered data string DS2 corresponding to the data line S1 may be R11, R21, R31, G11, G21, G31, B11, B21, B31, . . . and etc. The output sequence of the reordered data string DS2 corresponding to the data line S2 may be R12, R22, R32, G12, G22, G32, B12, B22, B32, . . . and etc. This means that the sub-pixels having the same color are clustered together.

Correspondingly, the scanning sequence of the gate driving circuit 130 is GL1, GL4, GL7, GL2, GL4, GL6, GL3, GL6, GL9, . . . , and etc. When the input data string DS1 is the pattern in all the same color (e.g., red), because the sub-pixel data corresponding to the red sub-pixels are clustered together, the color switching number (i.e., the number of voltage transition times) of the data lines S1 and S2 may be effectively reduced.

Figure 24:
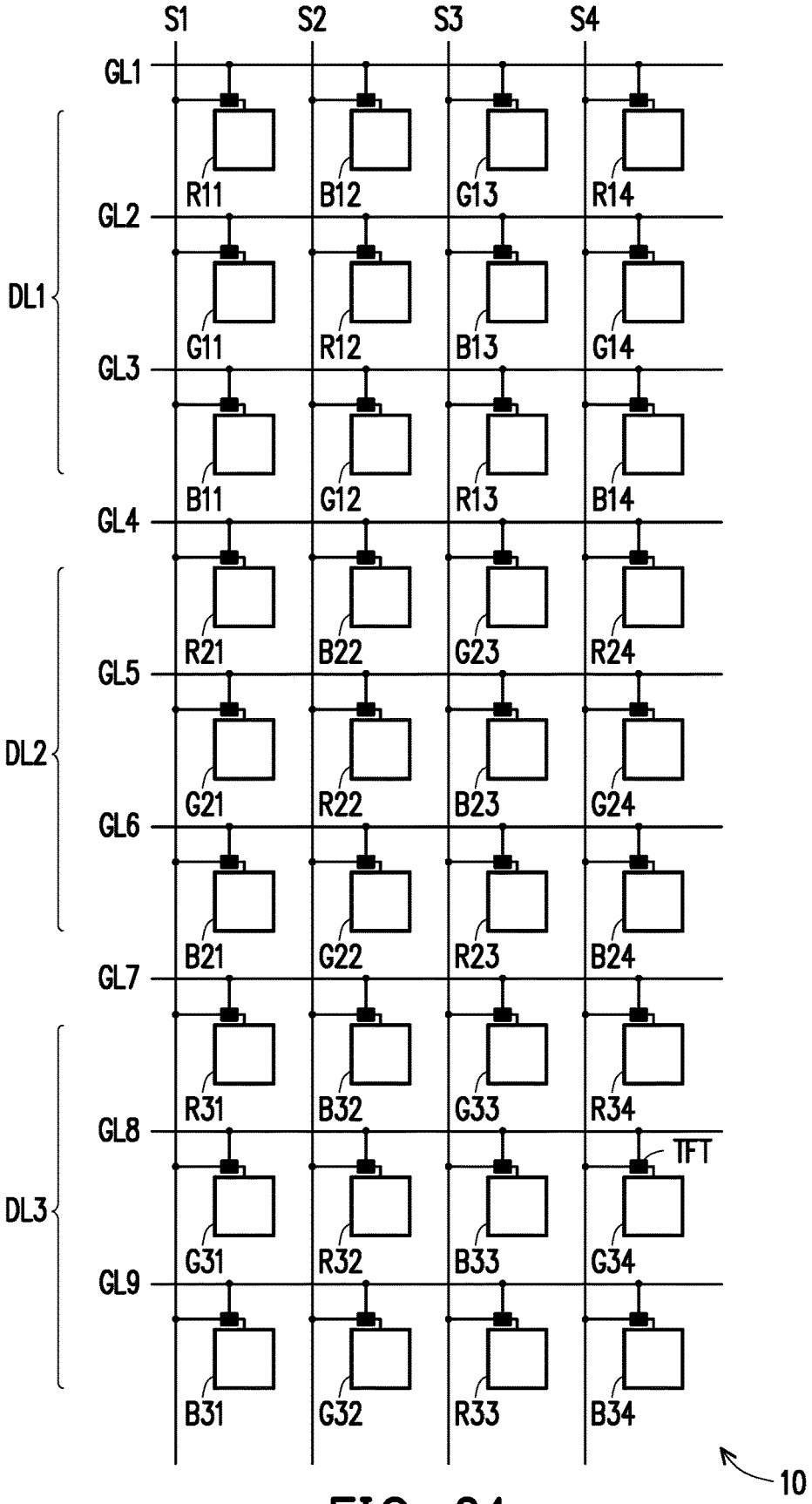
FIG. 24 is a schematic layout diagram of the display panel depicted in FIG. 1 according to another embodiment of the invention.

FIG. 24 is a schematic layout diagram of the display panel 10 depicted in FIG. 1 according to another embodiment of the invention. In the embodiment illustrated in FIG. 24, the display panel 10 can be a non-dual-gate display panel. The display panel 10 can include a plurality of data lines (e.g., S1 to S4), a plurality of scan lines (e.g., GL1 to GL9), and a plurality of sub-pixels connected to the data lines and the scan lines. The source driving circuit 122 can output the sub-pixel voltage string Vd to drive the data lines of the display panel 10. The gate driving circuit 130 can scan (drive) the scan lines of the display panel 10. The sub-pixels of the display panel 10 can include red sub-pixels (e.g., R11 to R14, R21 to R24, and R31 to R34), green sub-pixels (e.g., G11 to G14, G21 to G24, and G31 to G34) and blue sub-pixels (e.g., B11 to B14, B21 to B24, and B31 to B34). A target data line of the data lines can be connected to different colors of the sub-pixels. In addition, the sub-pixels can be arranged as a plurality of display lines, for example, DL1-DL3 along an extension direction of the scan lines GL1 to GL9. The sub-pixels arranged on a same display line may have different color. The sub-pixels connected to the target data line of the data lines S1-S4 can have a same color every N display line(s), wherein N is a positive integer. In the embodiment, N can be 3. Each of the black solid squares shown in FIG. 24 represents a switch TFT.

More specifically, the red sub pixel R11, the blue sub pixel B12, the green sub pixel G13, the red sub pixel R14, the green sub pixel G11, the red sub pixel R12, the blue sub pixel B13, the green sub pixel G14, the blue sub pixel B11, the green sub pixel G12, the red sub pixel R13 and the blue sub pixel B14 are arranged on a display line DLL The red sub pixel R21, the blue sub pixel B22, the green sub pixel G23, the red sub pixel R24, the green sub pixel G21, the red sub pixel R22, the blue sub pixel B23, the green sub pixel G24, the blue sub pixel B21, the green sub pixel G22, the red sub pixel R23 and the blue sub pixel B24 are arranged on a display line DL2. The red sub pixel R31, the blue sub pixel B32, the green sub pixel G33, the red sub pixel R34, the green sub pixel G31, the red sub pixel R32, the blue sub pixel B33, the green sub pixel G34, the blue sub pixel B31, the green sub pixel G32, the red sub pixel R33 and the blue sub pixel B34 are arranged on a display line DL3.

Figure 25:
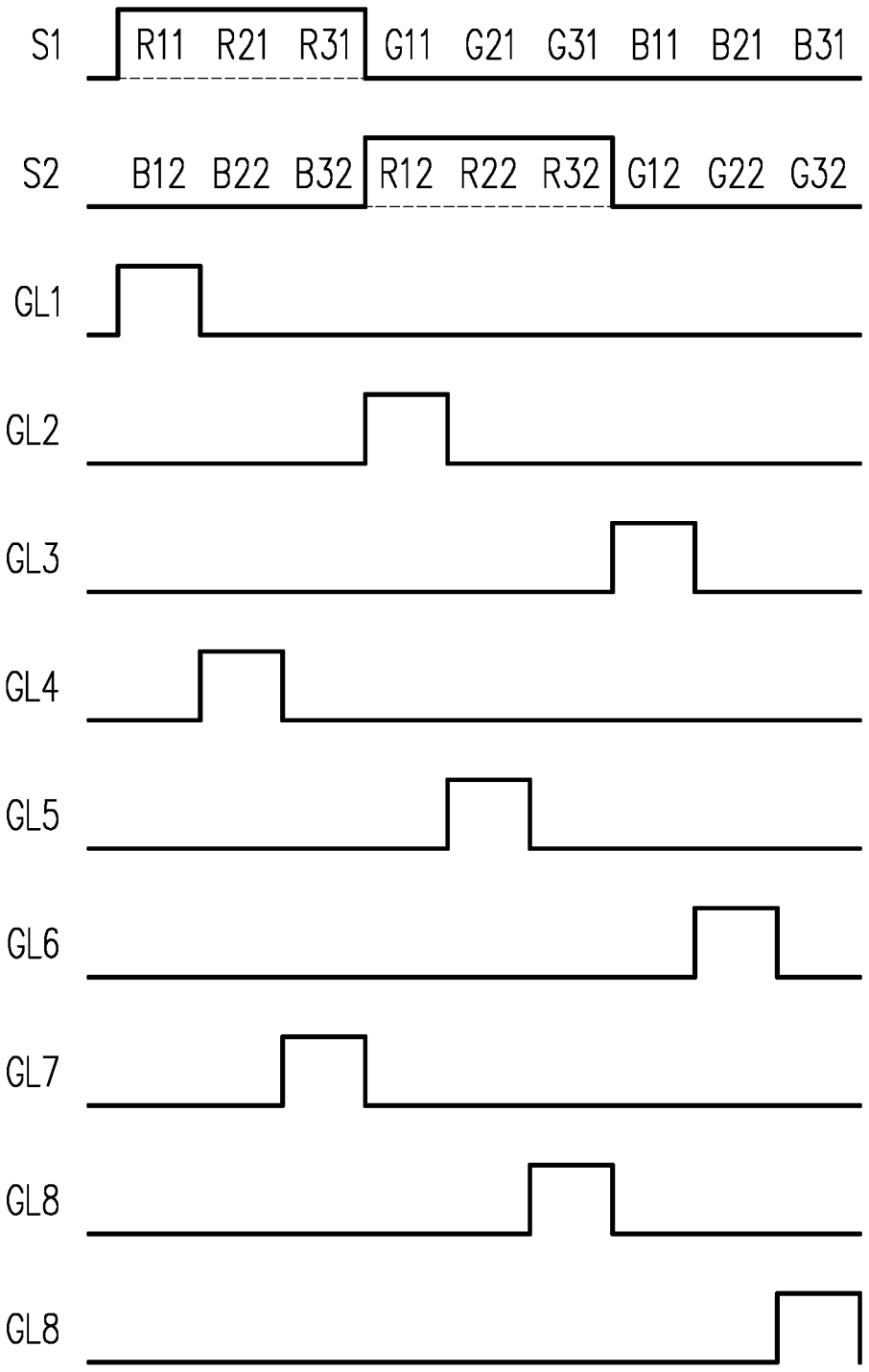
FIG. 25 is a signal timing diagram of the display panel shown in FIG. 24 according to another embodiment of the invention.

FIG. 25 is a signal timing diagram of the display panel 10 shown in FIG. 24 according to another embodiment of the invention. In the example implementation, the output sequence of the reordered data string DS2 corresponding to the data line S1 may be R11, R21, R31, G11, G21, G31, B11, B21, B31, . . . and etc. The output sequence of the reordered data string DS2 corresponding to the data line S2 may be B12, B22, B32, R12, R22, R32, G12, G22, G32, . . . and etc. This means that the sub-pixels having the same color are clustered together. Correspondingly, the scanning sequence of the gate driving circuit 130 is GL1, GL4, GL7, GL2, GL4, GL6, GL3, GL6, GL9, . . . , and etc. When the input data string DS1 is the pattern in all the same color (e.g., red), because the sub-pixel data corresponding to the red sub-pixels are clustered together, the color switching number (i.e., the number of voltage transition times) of the data lines S1 and S2 may be effectively reduced.

The scanning operation shown in FIG. 17 can be also referred to as being performed in the "forth-and-back manner" without first completing scanning all of the sub-pixels R11, G11 and B11 connected to the target data line S1 and arranged on a same display line, e.g., DLL A first group of the sub-pixels having a first color (e.g., red) can comprise a first sub-pixel R11 and at least one second sub-pixel R21 and R31, and a second group of the sub-pixels having a second color (e.g., green) can comprise sub-pixel G11. The first sub-pixel R11 is arranged on the first display line DL1, the at least one second sub-pixel R21 and R31 can be arranged on at least one display line DL2 and DL3 other than the first display line DL1, and the sub-pixel G11 can be arranged on the first display line DLL In other words, without first completing the scanning for all of the sub-pixels R11, G11 and B11 on the first display line DL1, the scanning operation is performed from the first display line DL1, sequentially through the display lines DL2, DL3, and then back to the first display line DL1.

Figure 26:
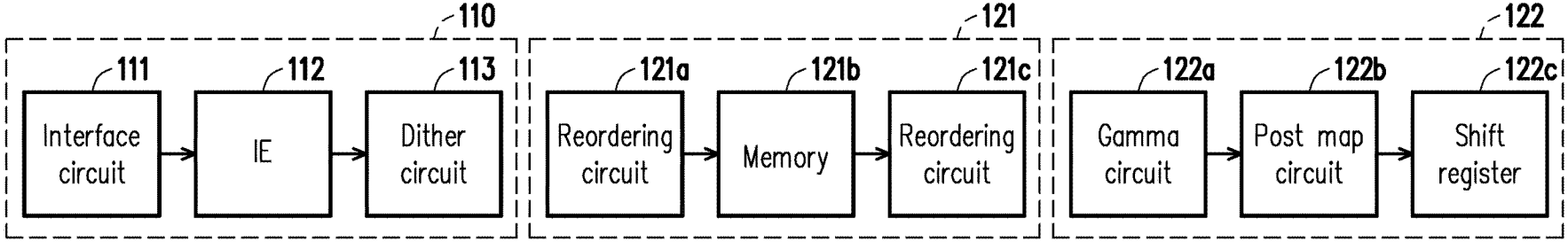
FIG. 26 is a schematic circuit block diagram illustrating the driving apparatus depicted in FIG. 1 according to another embodiment of the invention.

FIG. 26 is a schematic circuit block diagram illustrating the driving apparatus 100 depicted in FIG. 1 according to another embodiment of the invention. In the embodiment illustrated in FIG. 26, the image processing circuit 110 includes an interface circuit 111, an information element (IE) 112 and a dither circuit 113. According to a design requirement, the interface circuit 111 may be a mobile industry processor interface (MIPI) circuit or other interface circuits. The dither circuit 113 may simulate a display effect at multiple gray levels by utilizing a dither technique. In the embodiment illustrated in FIG. 26, the reordering circuit 121 includes a reordering circuit 121*a*, a memory 121*b* and a reordering circuit 121*c*, and the source driving circuit 122 includes a GAMMA circuit 122*a*, a post map circuit 122*b* and a shift register 122*c*.

Figure 27:
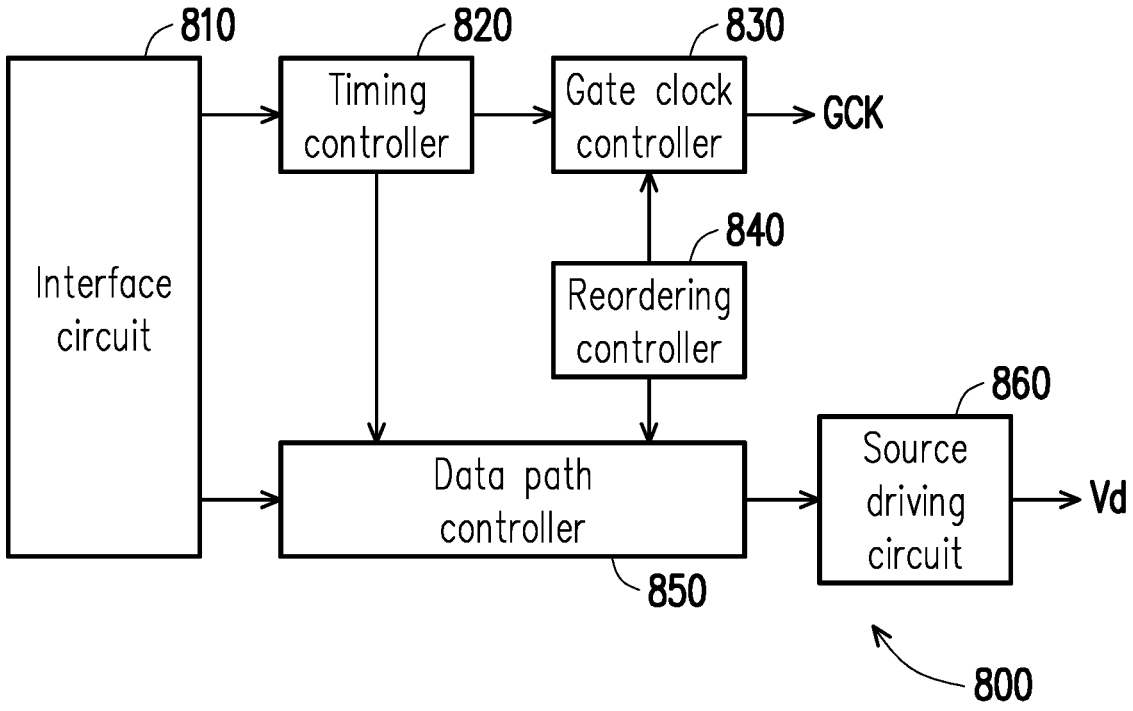
FIG. 27 is a schematic circuit block diagram illustrating a driving apparatus according to another embodiment of the invention.

FIG. 27 is a schematic circuit block diagram illustrating a driving apparatus 800 according to another embodiment of the invention. In the embodiment illustrated in FIG. 27, the driving apparatus 800 can includes an interface circuit 810, a timing controller 820, a gate clock controller 830, a reordering controller 840, a data path controller 850 and a source driving circuit 860. According to a design requirement, the interface circuit 810 may be a MIPI circuit or other interface circuits.

The timing controller 820 can be coupled to the interface circuit 810 to receive pixel data and timing data. According to the timing data, the timing controller 820 may output a gate timing signal to the gate clock controller 830. According to the gate timing signal, the gate clock controller 830 may output a gate clock GCK to a gate driver on array (GOA) of the display panel 10. A scanning sequence of the gate clock controller 840 can be controlled by the reordering controller 840. The reordering operation of the reordering controller 810 may be analogously inferred with reference the descriptions related to FIG. 3, FIG. 7, FIG. 10, FIG. 14, FIG. 16, FIG. 19, FIG. 22, and FIG. 24.

The data path controller 850 can be coupled to the interface circuit 810 to receive the pixel data. The data path controller 850 can be further coupled to the timing controller 820 to receive a timing signal. The data path controller 850 may optimize the colors, configure a GAMMA mapping relationship corresponding to the data and control a polarity thereof. Based on the control of the reordering controller 840, the data path controller 850 may perform the reordering operation on the pixel data. The data path controller 850 may be analogously inferred with reference the descriptions related to the embodiments illustrated in FIG. 3, FIG. 7, FIG. 10, FIG. 14, FIG. 16, FIG. 19, FIG. 22, and FIG. 24. The source driving circuit 860 can be coupled to the data path controller 850 to receive a reordered data string. The source driving circuit 860 may convert the reordered sub string into the sub-pixel voltage string Vd. The source driving circuit 860 may output the sub-pixel voltage string Vd to drive the data line of the display panel 10.

According to different design requirements, the image processing circuit 110 and (or) the reordering circuit 121 may be implemented in a form of hardware, firmware, software (i.e., programs) or in a combination of many of the aforementioned three forms.

In terms of the hardware form, the image processing circuit 110 and (or) the reordering circuit 121 may be implemented in a logic circuit on an integrated circuit. Related functions of the image processing circuit 110 and (or) the reordering circuit 121 may be implemented in a form of hardware by utilizing hardware description languages (e.g., Verilog HDL or VHDL) or other suitable programming languages. For example, the related functions of the image processing circuit 110 and (or) the reordering circuit 121 may be implemented in one or more controllers, micro-controllers, microprocessors, application-specific integrated circuits (ASICs), digital signal processors (DSPs), field programmable gate arrays (FPGAs) and/or various logic blocks, modules and circuits in other processing units.

In terms of the software form and/or the firmware form, the related functions of the image processing circuit 110 and (or) the reordering circuit 121 may be implemented as programming codes. For example, the image processing circuit 110 and (or) the reordering circuit 121 may be implemented by using general programming languages (e.g., C or C++) or other suitable programming languages. The programming codes may be recorded/stored in recording media, and the aforementioned recording media include, for example, a read only memory (ROM), a storage device and/or a random access memory (RAM). Additionally, the programming codes may be accessed from the recording medium and executed by a computer, a central processing unit (CPU), a controller, a micro-controller or a microprocessor to accomplish the related functions. As for the recording medium, a non-transitory computer readable medium, such as a tape, a disk, a card, a semiconductor memory or a programming logic circuit, may be used. In addition, the programs may be provided to the computer (or the CPU) through any transmission medium (e.g., a communication network or radio waves). The communication network is, for example, Internet, wired communication, wireless communication or other communication media.

Based on the above, the driving apparatus provided by the embodiments of the invention can reorder the input data string to generate the reordered data strings. Moreover, the scanning sequence for the scan lines of the display panel can be arranged to jump across at least one display line. Accordingly, the color switching number associated with the target data line of the display panel can be reduced. The reduction of the color switching number can also reduce the power consumption of the source driving circuit.

In addition to power saving, the driving apparatus may also achieve improving a visual effect for some screens. For example, when the source driving circuit converts the voltage level of the sub-pixel voltage string, the transition of the sub-pixel voltage string can induce a coupling effect to a common voltage (generally referred to as VCOM) of the display panel. When a level of the VCOM of the display panel is influenced, a liquid crystal voltage difference among the surrounding sub-pixels is jointly influenced, which leads to a visual effect issue. Based on the reordering operation performed by the driving circuit and the gate driving circuit of the driving apparatus, the color switching number (i.e., the number of voltage transition times) associated with the target data line of the display panel can be effectively reduced. Because the number of voltage transition times can be reduced, the influence extent on VCOM can be reduced, such that the visual effect issue can be effectively improved It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A driving apparatus, comprising:

a reordering circuit, configured to reorder an input data string to generate a reordered data string, wherein the input data string comprises a sub-pixel data string for a target data line of a display panel, the sub-pixel data string comprises a plurality of original sub strings respectively corresponding to different scan lines, a color of first sub-pixel data in a first original sub string among the original sub strings is the same as a color of second sub-pixel data in a second original sub string among the original sub strings, the first original sub string corresponds to a first scan line, the second original sub string corresponds to a second scan line different from the first scan line, the reordering circuit clusters the first sub-pixel data in the first original sub string and the second sub-pixel data having the same color in the second original sub string into a reordered sub string of the reordered data string, and a sub-pixel sequence of the reordered data string in a current frame is different from a sub-pixel sequence of the reordered data string in a previous frame; and a source driving circuit, coupled to the reordering circuit to receive the reordered data string, and configured to convert the reordered sub string into a sub-pixel voltage string and drive the target data line of the display panel according to the sub-pixel voltage string, wherein the sub-pixel sequence of the reordered data string in each of the plurality of frames is determined according to a selected scanning sequence for scanning a plurality of scan lines, and regarding to the target data line, the selected scanning sequence results in that a sub-pixel connected to the target data line and belonging to a display line is controlled by a first scan line which is scanned based on the selected scanning sequence, another sub-pixel connected to the target data line and belonging to another display line is controlled by a second scan line which is immediately scanned after the first scan line based on the selected scanning sequence, and the selected scanning sequence further results in that a first insufficiently-charged sub-pixel connected to the target data line that is insufficiently charged when displaying a first frame among the plurality of frames and a second insufficiently-charged sub-pixel connected to the target data line that is insufficiently charged when displaying a second frame adjacent to the first frame among the plurality of frames are located in different display lines.

2. The driving apparatus according to claim 1, wherein a location of the first sub-pixel data in the first original sub string is the same as a location of the second sub-pixel data in the second original sub string.

3. The driving apparatus according to claim 1, wherein the reordering circuit further clusters third sub-pixel data in the first original sub string and fourth sub-pixel data in the second original sub string into the reordered sub string of the reordered data string, a location of the first sub-pixel data in the first original sub string is the same as a location of the second sub-pixel data in the second original sub string, and a location of the third sub-pixel data in the first original sub string is the same as a location of the fourth sub-pixel data in the second original sub string.

4. The display apparatus according to claim 1, further comprising:

an image processing circuit, coupled to the reordering circuit to provide the input data string.

5. The driving apparatus according to claim 4, wherein the image processing circuit and the reordering circuit are disposed in a timing controller, and the source driving circuit is disposed in a source driver.

6. The driving apparatus according to claim 4, wherein the image processing circuit is disposed in a timing controller, and the reordering circuit and the source driving circuit are disposed in a source driver.

7. The driving apparatus according to claim 1, wherein the display panel is a dual-gate display panel.

8. The driving apparatus according to claim 7, wherein the display panel is a zigzag display panel.

9. The driving apparatus according to claim 7, wherein the display panel is a non-zigzag display panel.

10. The driving apparatus according to claim 1, wherein the display panel is a non-dual-gate display panel.

11. The driving apparatus according to claim 1, wherein the display panel comprises a plurality of data lines, a plurality of scan lines and a plurality of sub-pixels connected to the data lines and the scan lines and arrange as a plurality of display lines extended along an extension direction of the scan lines, and the target data line of the data lines is connected to different colors of the sub-pixels.

12. The driving apparatus according to claim 11, wherein the sub-pixels connected to a target data line of the data lines have a same color every N display line(s), wherein N is a positive integer.

13. The driving apparatus according to claim 1, wherein a sub-pixel sequence of the reordered data string in a next frame is the same as the sub-pixel sequence of the reordered data string in the previous frame.

14. The driving apparatus according to claim 1, wherein a sub-pixel sequence of the reordered data string in a next frame is different from the sub-pixel sequence of the reordered data string in the previous frame and the sub-pixel sequence of the reordered data string in the current frame.

15. The driving apparatus according to claim 1, wherein a sub-pixel sequence of the reordered data string in a next frame is different from the sub-pixel sequence of the reordered data string in the previous frame, and the sub-pixel sequence of the reordered data string in the next frame is the same as the sub-pixel sequence of the reordered data string in the current frame.

16. The driving apparatus according to claim 1, wherein the change in the sub-pixel sequence between different frames is regular.

17. The driving apparatus according to claim 16, wherein a period of the change in the sub-pixel sequence is a plurality of frames.

18. An operation method of a driving apparatus, comprising:

reordering an input data string to generate a reordered data string, wherein the input data string comprises a sub-pixel data string for a target data line of a display panel, the sub-pixel data string comprises a plurality of original sub strings respectively corresponding to different scan lines, a color of first sub-pixel data in a first original sub string among the original sub strings is the same as a color of second sub-pixel data in a second original sub string among the original sub strings, the first original sub string corresponds to a first scan line, and the second original sub string corresponds to a second scan line different from the first scan line;

clustering the first sub-pixel data in the first original sub string and the second sub-pixel data having the same color in the second original sub string into a reordered sub string of the reordered data string, wherein a sub-pixel sequence of the reordered data string in a current frame is different from a sub-pixel sequence of the reordered data string in a previous frame;

converting the reordered sub string into a sub-pixel voltage string; and driving the target data line of the display panel according to the sub-pixel voltage string, wherein the sub-pixel sequence of the reordered data string in each of the plurality of frames is determined according to a selected scanning sequence for scanning a plurality of scan lines, and regarding to the target data line, the selected scanning sequence results in that a sub-pixel connected to the target data line and belonging to a display line is controlled by a first scan line which is scanned based on the selected scanning sequence, another sub-pixel connected to the target data line and belonging to another display line is controlled by a second scan line which is immediately scanned after the first scan line based on the selected scanning sequence, and the selected scanning sequence further results in that a first insufficiently-charged sub-pixel connected to the target data line when displaying a first frame among the plurality of frames and a second insufficiently-charged sub-pixel connected to the target data line when displaying a second frame adjacent to the first frame among the plurality of frames are located in different display lines.

19. The operation method according to claim 18, wherein a location of the first sub-pixel data in the first original sub string is the same as a location of the second sub-pixel data in the second original sub string.

20. The operation method according to claim 18, further comprising:

clustering third sub-pixel data in the first original sub string and fourth sub-pixel data in the second original sub string into the reordered sub string of the reordered data string, wherein a location of the first sub-pixel data in the first original sub string is the same as a location of the second sub-pixel data in the second original sub string, and a location of the third sub-pixel data in the first original sub string is the same as a location of the fourth sub-pixel data in the second original sub string.

21. The operation method according to claim 18, further comprising:

providing the input data string by an image processing circuit.

22. The operation method according to claim 18, wherein the display panel is a dual-gate display panel.

23. The operation method according to claim 22, wherein the display panel is a zigzag display panel.

24. The operation method according to claim 22, wherein the display panel is a non-zigzag display panel.

25. The operation method according to claim 18, wherein the display panel is a non-dual-gate display panel.

26. The operation method according to claim 18, wherein the display panel comprises a plurality of data lines, a plurality of scan lines, and a plurality of sub-pixels connected to the data lines and the scan lines and arrange as a plurality of display lines extended along an extension direction of the scan lines, and the target data line of the data lines is connected to different colors of the sub-pixels.

27. The operation method according to claim 26, wherein the sub-pixels connected to a target data line of the data lines have a same color every N display line(s), wherein N is a positive integer.

28. The operation method according to claim 18, wherein a sub-pixel sequence of the reordered data string in a next frame is the same as the sub-pixel sequence of the reordered data string in the previous frame.

29. The operation method according to claim 18, wherein a sub-pixel sequence of the reordered data string in a next frame is different from the sub-pixel sequence of the reordered data string in the previous frame and the sub-pixel sequence of the reordered data string in the current frame.

30. The operation method according to claim 29, wherein a period of the change in the sub-pixel sequence is a plurality of frames.

31. The operation method according to claim 18, wherein a sub-pixel sequence of the reordered data string in a next frame is different from the sub-pixel sequence of the reordered data string in the previous frame, and the sub-pixel sequence of the reordered data string in the next frame is the same as the sub-pixel sequence of the reordered data string in the current frame.

32. The operation method according to claim 18, wherein the change in the sub-pixel sequence between different frames is regular.

33. A driving apparatus configured to drive a display panel, comprising:

a reordering circuit, configured to reorder a plurality of sub-pixel data of an input data string to generate a reordered data string so as to reduce a color switching number associated with a target data line, wherein a sub-pixel sequence of the reordered data string in a current frame is different from a sub-pixel sequence of the reordered data string in a previous frame; and a source driving circuit, coupled to the reordering circuit to receive the reordered data string, and configured to drive the target data line of the display panel according to the reordered data string, wherein the sub-pixel sequence of the reordered data string in each of the plurality of frames is for scanning a plurality of scan lines, and regarding to the target data line, the selected scanning sequence results in that a sub-pixel connected to the target data line and belonging to a display line is controlled by a first scan line which is scanned based on the selected scanning sequence, another sub-pixel connected to the target data line and belonging to another display line is controlled by a second scan line which is immediately scanned after the first scan line based on the selected scanning sequence, and the selected scanning sequence further results in that a first insufficiently-charged sub-pixel connected to the target data line when displaying a first frame among the plurality of frames and a second insufficiently-charged sub-pixel connected to the target data line when displaying a second frame adjacent to the first frame among the plurality of frames are located in different display lines.

34. The driving apparatus according to claim 33, wherein the input data string comprises a sub-pixel data string for the target data line of the display panel, the sub-pixel data string comprises a plurality of original sub strings respectively corresponding to different scan lines, and the reordering circuit is configured to reorder the original sub strings to obtain the reordered data string.

35. The driving apparatus according to claim 34, wherein the reordering circuit is configured to cluster the first sub-pixel data in the first original sub string and the second sub-pixel data having the same color in the second original sub string into a reordered sub string of the reordered data string.

36. The driving apparatus according to claim 33, wherein the display panel is a dual-gate display panel.

37. The driving apparatus according to claim 36, wherein the display panel is a zigzag display panel.

38. The driving apparatus according to claim 36, wherein the display panel is a non-zigzag display panel.

39. The driving apparatus according to claim 33, wherein the display panel is a non-dual-gate display panel.

40. The driving apparatus according to claim 33, wherein the display panel comprises a plurality of data lines, a plurality of scan lines, and a plurality of sub-pixels connected to the data lines and the scan lines and arrange as a plurality of display lines extended along an extension direction of the scan lines, and the target data line of the data lines is connected to different colors of the sub-pixels.

41. The driving apparatus according to claim 40, wherein the sub-pixels connected to a target data line of the data lines have a same color every N display line(s), wherein N is a positive integer.

42. The driving apparatus according to claim 33, wherein a sub-pixel sequence of the reordered data string in a next frame is the same as the sub-pixel sequence of the reordered data string in the previous frame.

43. The driving apparatus according to claim 33, wherein a sub-pixel sequence of the reordered data string in a next frame is different from the sub-pixel sequence of the reordered data string in the previous frame and the sub-pixel sequence of the reordered data string in the current frame.

44. The driving apparatus according to claim 33, wherein a sub-pixel sequence of the reordered data string in a next frame is different from the sub-pixel sequence of the reordered data string in the previous frame, and the sub-pixel sequence of the reordered data string in the next frame is the same as the sub-pixel sequence of the reordered data string in the current frame.

45. The driving apparatus according to claim 33, wherein the change in the sub-pixel sequence between different frames is regular.

46. The driving apparatus according to claim 45, wherein a period of the change in the sub-pixel sequence is a plurality of frames.

47. An operation method of a driving apparatus configured to drive a display panel, comprising:

reordering a plurality of sub-pixel data of an input data string to generate a reordered data string so as to reduce a color switching number associated with a target data line, wherein a sub-pixel sequence of the reordered data string in a current frame is different from a sub-pixel sequence of the reordered data string in a previous frame; and driving the target data line of the display panel according to the reordered data string, wherein the sub-pixel sequence of the reordered data string in each of the plurality of frames is for scanning a plurality of scan lines, wherein the display panel comprises a plurality of display lines, each of the plurality of display lines corresponds to a scan line group that comprises a plurality of scan lines, and regarding to the target data line, the selected scanning sequence results in that a sub-pixel connected to the target data line and belonging to a display line is controlled by a first scan line which is scanned based on the selected scanning sequence, another sub-pixel connected to the target data line and belonging to another display line is controlled by a second scan line which is immediately scanned after the first scan line based on the selected scanning sequence, and the selected scanning sequence further results in that a first insufficiently-charged sub-pixel connected to the target data line when displaying a first frame among the plurality of frames and a second insufficiently-charged sub-pixel connected to the target data line when displaying a second frame adjacent to the first frame among the plurality of frames are located in different display lines.

48. The operation method according to claim 47, wherein the input data string comprises a sub-pixel data string for the target data line of the display panel, the sub-pixel data string comprises a plurality of original sub strings respectively corresponding to different scan lines, and the operation method further comprises:

reordering the original sub strings to obtain the reordered data string.

49. The operation method according to claim 48, further comprising:

clustering the first sub-pixel data in the first original sub string and the second sub-pixel data having the same color in the second original sub string into a reordered sub string of the reordered data string.

50. The operation method according to claim 47, wherein the display panel is a dual-gate display panel.

51. The operation method according to claim 50, wherein the display panel is a zigzag display panel.

52. The operation method according to claim 50, wherein the display panel is a non-zigzag display panel.

53. The operation method according to claim 47, wherein the display panel is a non-dual-gate display panel.

54. The operation method according to claim 47, the display panel comprises a plurality of data lines, a plurality of scan lines, and a plurality of sub-pixels connected to the data lines and the scan lines and arrange as a plurality of display lines extended along an extension direction of the scan lines, and the target data line of the data lines is connected to different colors of the sub-pixels.

55. The operation method according to claim 54, wherein the sub-pixels connected to a target data line of the data lines have a same color every N display line(s), wherein N is a positive integer.

56. The operation method according to claim 47, wherein a sub-pixel sequence of the reordered data string in a next frame is the same as the sub-pixel sequence of the reordered data string in the previous frame.

57. The operation method according to claim 47, wherein a sub-pixel sequence of the reordered data string in a next frame is different from the sub-pixel sequence of the reordered data string in the previous frame and the sub-pixel sequence of the reordered data string in the current frame.

58. The operation method according to claim 47, wherein a sub-pixel sequence of the reordered data string in a next frame is different from the sub-pixel sequence of the reordered data string in the previous frame, and the sub-pixel sequence of the reordered data string in the next frame is the same as the sub-pixel sequence of the reordered data string in the current frame.

59. The operation method according to claim 47, wherein the change in the sub-pixel sequence between different frames is regular.

60. The operation method according to claim 59, wherein a period of the change in the sub-pixel sequence is a plurality of frames.

* * * * *